US010293607B2

(12) United States Patent
Moriya et al.

(10) Patent No.: US 10,293,607 B2
(45) Date of Patent: May 21, 2019

(54) RECORDING ELEMENT BOARD AND LIQUID DISCHARGE HEAD

(71) Applicant: CANON KABUSHIKI KAISHA, Tokyo (JP)

(72) Inventors: Takatsugu Moriya, Tokyo (JP); Shintaro Kasai, Yokohama (JP); Yoshiyuki Nakagawa, Kawasaki (JP); Akiko Saito, Tokyo (JP); Koichi Ishida, Tokyo (JP); Tatsuya Yamada, Kawasaki (JP); Shinji Kishikawa, Tokyo (JP); Takayuki Sekine, Kawasaki (JP); Shuzo Iwanaga, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/397,517

(22) Filed: Jan. 3, 2017

(65) Prior Publication Data

US 2017/0197411 A1 Jul. 13, 2017

(30) Foreign Application Priority Data

Jan. 8, 2016 (JP) ..... 2016-002957
Dec. 9, 2016 (JP) ..... 2016-239369

(51) Int. Cl.
*B41J 2/14* (2006.01)
*B41J 2/01* (2006.01)

(52) U.S. Cl.
CPC ..... *B41J 2/14024* (2013.01); *B41J 2/1404* (2013.01); *B41J 2/1433* (2013.01);
(Continued)

(58) Field of Classification Search
CPC .... B41J 2/1404; B41J 2/1433; B41J 2/14145; B41J 2002/14475; B41J 2002/14169; B41J 2002/14467
See application file for complete search history.

(56) References Cited

U.S. PATENT DOCUMENTS 5,754,202 A * 5/1998 Sekiya ..... B41J 2/14056 347/47
6,520,626 B1 * 2/2003 Murakami ..... B41J 2/1404 347/56

(Continued)

FOREIGN PATENT DOCUMENTS

CN 101734013 A 6/2010
CN 101746126 A 6/2010

(Continued)

*Primary Examiner* — John Zimmermann
(74) *Attorney, Agent, or Firm* — Canon USA, Inc., IP Division

(57) ABSTRACT

A recording element board includes a discharge orifice configured to discharge liquid, a pressure chamber communicating with the discharge orifice, a recording element configured to generate thermal energy to cause bubbling of the liquid, the recording element being disposed in the pressure chamber facing the discharge orifice, and a substrate on which the recording element is formed. When the recording element is driven and the liquid of within the pressure chamber is discharged, a generated bubble communicates with the atmosphere. A discharge orifice projection region where the discharge orifice has been projected on the substrate includes a region includes a region extending beyond a heat-generating region projection region where the heat-generating region of the recording element has been projected on the substrate, the outline of the discharge orifice projection region is circumscribed by the outline of the heat-generating region projection region.

16 Claims, 44 Drawing Sheets

(52) U.S. Cl.
CPC ..... *B41J 2002/012* (2013.01); *B41J 2002/14169* (2013.01); *B41J 2002/14467* (2013.01); *B41J 2002/14475* (2013.01); *B41J 2202/11* (2013.01); *B41J 2202/12* (2013.01)

(56) References Cited

U.S. PATENT DOCUMENTS 7,364,267 B2 * 4/2008 Sasaki ..... B41J 2/1404 347/47
7,887,159 B2 * 2/2011 Takei ..... B41J 2/1433 347/20
8,651,624 B2 2/2014 Pan
2002/0021326 A1 * 2/2002 Kaneko ..... B41J 2/145 347/43
2002/0057311 A1 * 5/2002 Ogawa ..... B41J 2/1404 347/56
2004/0218007 A1 * 11/2004 Tomizawa ..... B41J 2/1404 347/40
2006/0000925 A1 * 1/2006 Maher ..... B41J 2/14056 239/102.1
2006/0119663 A1 * 6/2006 Tsuchii ..... B41J 2/1404 347/47
2009/0015637 A1 * 1/2009 Worsman ..... B41J 2/211 347/47
2009/0147057 A1 6/2009 Oikawa
2010/0220148 A1 * 9/2010 Menzel ..... B41J 2/14233 347/47
2012/0256989 A1 10/2012 Uezawa

FOREIGN PATENT DOCUMENTS

CN 103502013 A 1/2014
CN 104859305 A 8/2015
CN 105082755 A 11/2015
EP 0838337 A1 4/1998
EP 0936070 A2 8/1999
EP 1088863 A1 4/2001
WO 2010-044775 A1 4/2010
WO 2012/148412 A1 11/2012
WO 2013/027368 A1 2/2013

* cited by examiner

RECORDING ELEMENT BOARD AND LIQUID DISCHARGE HEAD

BACKGROUND

Field

The present disclosure relates to a recording element board used to discharge liquid such as ink, and to a liquid discharge head having the recording element board.

Description of the Related Art

An example of a method by which a liquid discharge head, e.g., an inkjet recording head, discharges liquid, is the thermal inkjet system where the liquid is heated to cause film boiling, and force of bubbling is used. A liquid discharge head used in the thermal inkjet system has a recording element board on which are formed a discharge orifice that discharges liquid, a pressure chamber communicating with the discharge orifice, a channel that supplies liquid to the pressure chamber, and a supply port that supplies liquid to the channel. A heating resistance element (heater) is formed within the pressure chamber of the recording element board, with liquid being discharged from the discharge orifice by discharge energy that the heating resistance element has generated.

When liquid is discharged by such as liquid discharge head, the discharged liquid has a column-like shape, including a main droplet and a slender droplet tail that follows the main droplet, extending therefrom. This droplet tail often becomes separated from the main droplet in flight, due to the difference in speed between the leading end and trailing end of the liquid column, and becomes minute liquid droplets called satellites. Satellites landing at positions on the recording medium deviated from the main droplet can cause deterioration of image quality.

A known method of reducing occurrence of such satellites to cause the bubble, generated by application of thermal energy from the heating resistance element to separate liquid within the pressure chamber from liquid in the channel, to communicate with the atmosphere at the time of discharging. Using this method makes it easier for portions that can become satellites to be separated from the main droplet before exiting the discharge orifice, since the rear portion of the discharged liquid has a speed component heading toward the heating resistance element, so liquid that becomes satellites outside of the discharge orifice and flies can be reduced.

Further, International Publication No. 2010/044775 discloses art in which dimensions, such as the height of the pressure chamber, the size of the discharge orifices, and so forth, are adjusted so that the more liquid is included in the main droplet as compared to the droplet tail, thereby reducing satellites. In the art described in International Publication No. 2010/044775, the heating resistance element is larger in size than the opening of the discharge orifice.

However, the timing of the bubble communicating with the atmosphere may be late in the art described in International Publication No. 2010/044775. Accordingly, there still have been cases where the rear portion of the droplet becomes separated from the main droplet portion, and satellites occur.

SUMMARY

It has been found desirable to provide a recording element board and liquid discharge head capable of reducing satellites in a liquid discharge head of a type where bubbles are made to communicate with the atmosphere in the discharging of liquid.

A recording element board includes: a discharge orifice configured to discharge liquid; a pressure chamber communicating with the discharge orifice; a recording element configured to generate thermal energy to cause bubbling of the liquid, the recording element being disposed in the pressure chamber facing the discharge orifice; a channel communicating with the pressure chamber; and a substrate on which the recording element is formed. When the recording elements is driven and liquid within the pressure chamber is discharged, a generated bubble communicates with the atmosphere. A rectangular shape, which circumscribes an outline of a discharge orifice projection region where the discharge orifice has been projected to the substrate, which has two parallel sides facing in a direction of flow of liquid through the channel, contains a heat-generating region projection region where a heat-generating region of the recording element has been projected on the substrate.

Further features of the present invention will become apparent from the following description of exemplary embodiments with reference to the attached drawings.

DESCRIPTION OF THE EMBODIMENTS

Figure 1:
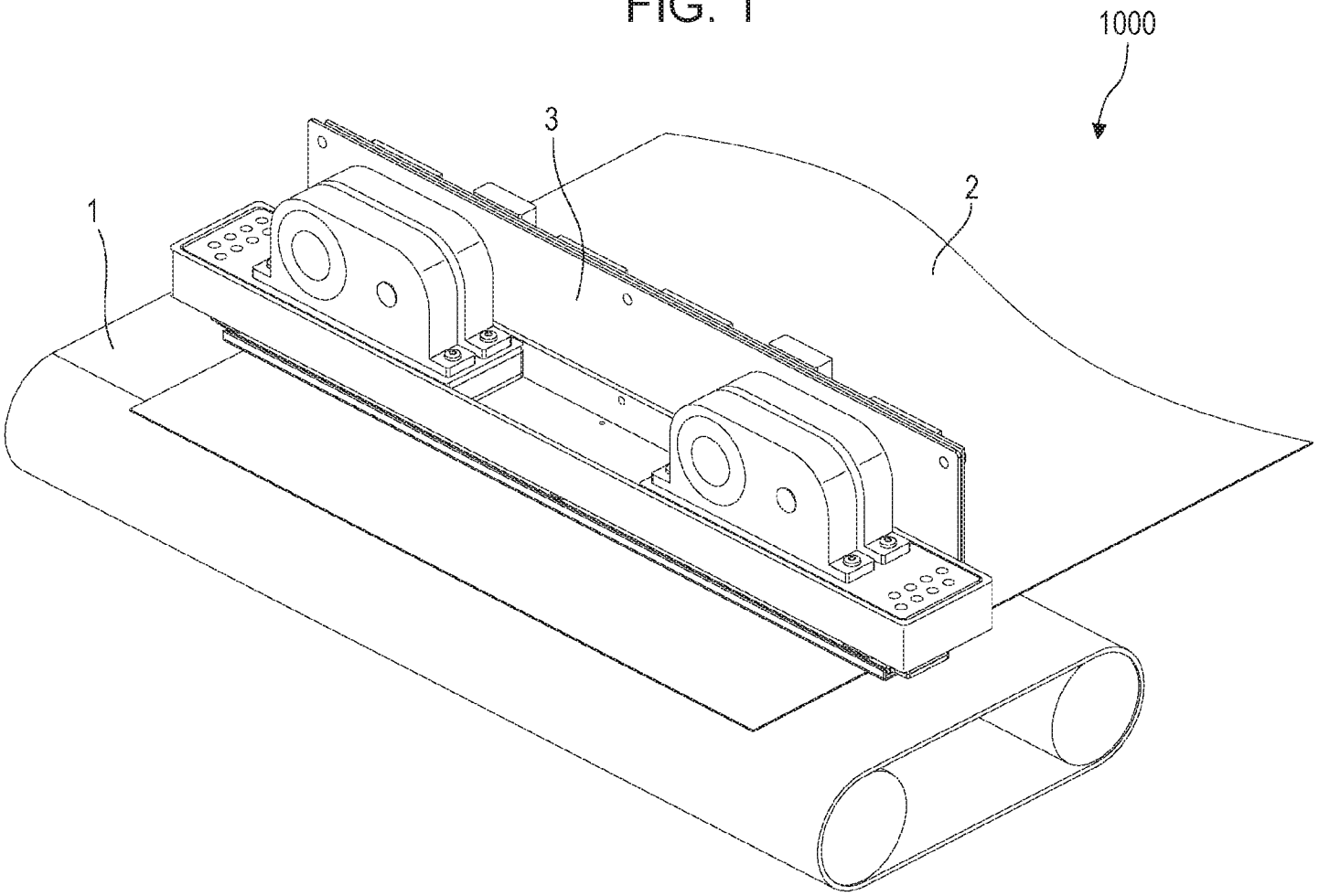
FIG. 1 is a diagram illustrating a schematic configuration of a recording apparatus according to a first application example.

Application examples and embodiments will be described below with reference to the attached drawings. Note that in the Specification and drawings, components that have the same function may be denoted by the same reference numerals and redundant description thereof omitted. Although examples of embodiments will be described with reference to the drawings, it should be understood that the description that follows does not restrict the scope of the present invention.

Although the application examples and embodiments relate to an inkjet recording apparatus (or simply "recording apparatus") of a form where a liquid such as ink or the like is circulated between a tank and liquid discharge head, other forms may be used as well. For example, a form may be employed where, instead of circulating ink, two tanks are provided, one at the upstream side of the liquid discharge head and the other on the downstream side, and ink within the pressure chamber is caused to flow by running ink from one tank to the other.

Also, the application examples and embodiments relate to a so-called line head that has a length corresponding to the width of the recording medium, but the embodiments can also be a so-called serial liquid discharge head that records while scanning over the recording medium. An example of a serial liquid discharge head is one that has one board each for recording black ink and for recording color ink, but this is not restrictive. An example of a serial liquid discharge head may be an arrangement where short line heads that are shorter than the width of the recording medium are formed, with multiple recording element boards arrayed so that orifices overlap in the discharge orifice row direction, these being scanned over the recording medium.

The following is a description of application examples that are applicable to the present invention.

First Application Example

Description of Inkjet Recording Apparatus

FIG. 1 illustrates a schematic configuration of a device that discharges liquid, and more particularly an inkjet recording apparatus 1000 (hereinafter also referred to simply as "recording apparatus") that performs recording by discharging ink. The recording apparatus 1000 has a conveyance unit 1 that conveys a recording medium 2, and a line type (page-wide) liquid discharge head 3 disposed generally orthogonal to the conveyance direction of the recording medium 2. The recording apparatus 1000 performs single-pass continuous recording while continuously or intermittently conveying multiple recording mediums 2. The recording medium 2 is not restricted to cut sheets, and may be continuous roll sheets. The liquid discharge head 3 is capable of full-color printing by cyan, magenta, yellow, and black (acronym "CMYK") ink. The liquid discharge head 3 has a liquid supply unit serving as a supply path that supplies ink to the liquid discharge head 3, a main tank, and a buffer tank (see FIG. 2) connected by fluid connection. The liquid discharge head 3 is also electrically connected to an electric control unit that transmits electric power and discharge control signals to the liquid discharge head 3. Liquid paths and electric signal paths within the liquid discharge head 3 will be described later.

Description of First Circulation Path

Figure 2:
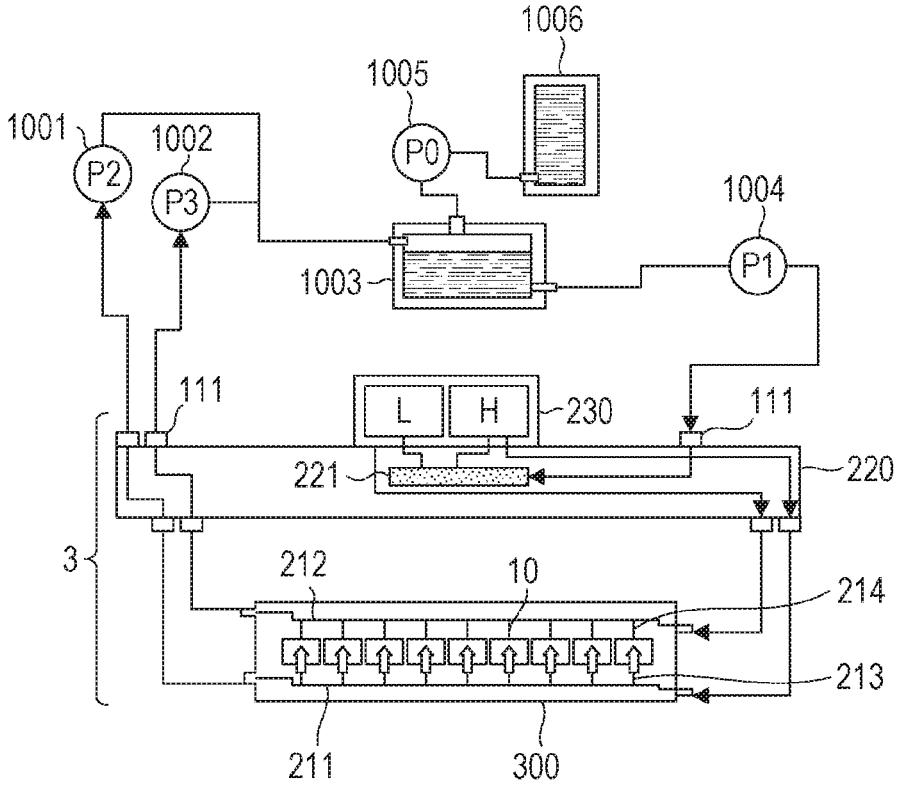
FIG. 2 is a diagram illustrating a first circulation path over which liquid circulates in the recording apparatus.

FIG. 2 is a schematic diagram illustrating a first circulation path that is a first form of a circulation path applied to the recording apparatus of the present application example. FIG. 2 is a diagram illustrating a first circulation pump (high-pressure side) 1001, a first circulation pump (low-pressure side) 1002 and a buffer tank 1003 and the like connected by fluid connection. Although FIG. 2 only illustrates the paths over which one color ink out of the CMYK ink flows, for the sake of brevity of description, in reality there are four colors worth of circulation paths provided to the liquid discharge head 3 and the recording apparatus main unit. The buffer tank 1003, serving as a sub-tank that is connected to a main tank 1006, has an atmosphere communication opening (omitted from illustration) whereby the inside and the outside of the tank communicate, and bubbles within the ink can be discharged externally. The buffer tank 1003 is also connected to a replenishing pump 1005. When ink is consumed at the liquid discharge head 3, the replenishing pump 1005 acts to send ink of an amount the same as that has been consumed from the main tank 1006 to the buffer tank 1003. Ink is consumed at the liquid discharge head 3 when discharging (ejecting) ink from the discharge orifices of the liquid discharge head 3, by discharging ink to perform recording, suction recovery, or the like, for example.

The first circulation pumps 1001 and 1002 act to extract ink from a fluid connector 111 of the liquid discharge head 3 and flow the ink to the buffer tank 1003. The first circulation pumps 1001 and 1002 preferably are positive-displacement pumps that have quantitative fluid sending capabilities. Specific examples may include tube pumps, gear pumps, diaphragm pumps, syringe pumps, and so forth. An arrangement may also be used where a constant flow is ensured by disposing a common-use constant-flow value and relief valve at the outlet of the pump. When the liquid discharge head 3 is being driven, the (high-pressure side) 1001 and first circulation pump (low-pressure side) 1002 cause a constant amount of ink to flow through a common supply channel 211 and a common recovery channel 212. The amount of flow is preferably set to a level where temperature difference among recording element boards 10 of the liquid discharge head 3 does not influence recording image quality, or higher. On the other hand, if the flow rate is set excessively high, the effects of pressure drop in the channels within a liquid discharge unit 300 causes excessively large difference in negative pressure among the recording element boards 10, resulting in unevenness in density in the image. Accordingly, the flow rate is preferably set taking into consideration temperature difference and negative pressure difference among the recording element boards 10.

A negative pressure control unit 230 is provided between paths of a second circulation pump 1004 and the liquid discharge unit 300. Accordingly, the negative pressure control unit 230 functions such that the pressure downstream from the negative pressure control unit 230 (i.e., at the liquid discharge unit 300 side) can be maintained at a present constant pressure even in cases where the flow rate of the circulation system fluctuates due to difference in duty when recording. Any mechanism may be used as two pressure adjustment mechanisms making up the negative pressure control unit 230, as long as pressure downstream from itself can be controlled to fluctuation within a constant range or smaller that is centered on a desired set pressure. As one example, a mechanism equivalent to a so-called "pressure-reducing regulator" can be employed. In a case of using a pressure-reducing regulator, the upstream side of the negative pressure control unit 230 is preferably pressurized by the second circulation pump 1004 via a liquid supply unit 220, as illustrated in FIG. 2. This enables the effects of water head pressure as to the liquid discharge head 3 of the buffer tank 1003 as to the liquid discharge head 3 to be suppressed, giving broader freedom in the layout of the buffer tank 1003 in the recording apparatus 1000. It is sufficient that the second circulation pump 1004 have a certain lift pressure or greater, within the range of the circulatory flow pressure of ink used when driving the liquid discharge head 3, and turbo pumps, positive-displacement pumps, and the like can be used. Specifically, diaphragm pumps or the like can be used. Alternatively, a water head tank disposed with a certain water head difference as to the negative pressure control unit 230, for example, may be used instead of the second circulation pump 1004.

As illustrated in FIG. 2, the negative pressure control unit 230 has two pressure adjustment mechanisms, with different control pressure from each other having been set. Of the two negative pressure adjustment mechanisms, the relatively high-pressure setting side (denoted by H in FIG. 2) and the relatively low-pressure setting side (denoted by L in FIG. 2) are respectively connected to the common supply channel 211 and the common recovery channel 212 within the liquid discharge unit 300 via the liquid supply unit 220. Provided to the liquid discharge unit 300 are individual supply channels 213 and individual recovery channels 214 communicating between the common supply channel 211, common recovery channel 212, and the recording element boards 10. Due to the individual supply channels 213 and 214 communicating with the common supply channel 211 and common recovery channel 212, flows occur where part of the ink flows from the common supply channel 211 through internal channels in the recording element board 10 and to the common recovery channel 212 (indicated by the arrows in FIG. 2). The reason is that the pressure adjustment mechanism H is connected to the common supply channel 211, and the pressure adjustment mechanism L to the common recovery channel 212, so a pressure difference is generated between the two common channels.

Thus, flows occur within the liquid discharge unit 300 where a part of the ink passes through the recording element boards 10 while ink flows through each of the common supply channel 211 and common recovery channel 212. Accordingly, heat generated at the recording element boards 10 can be externally discharged from the recording element boards 10 by the flows through the common supply channel 211 and common recovery channel 212. This configuration also enables ink flows to be generated at discharge orifices and pressure chambers not being used for recording while recording is being performed by the liquid discharge head 3, so thickening of the ink at such portions can be suppressed. Further, thickened ink and foreign substances in the ink can be discharged to the common recovery channel 212. Accordingly, the liquid discharge head 3 according to the present application example can record at high speed with high image quality.

Description of Second Circulation Path

Figure 3:
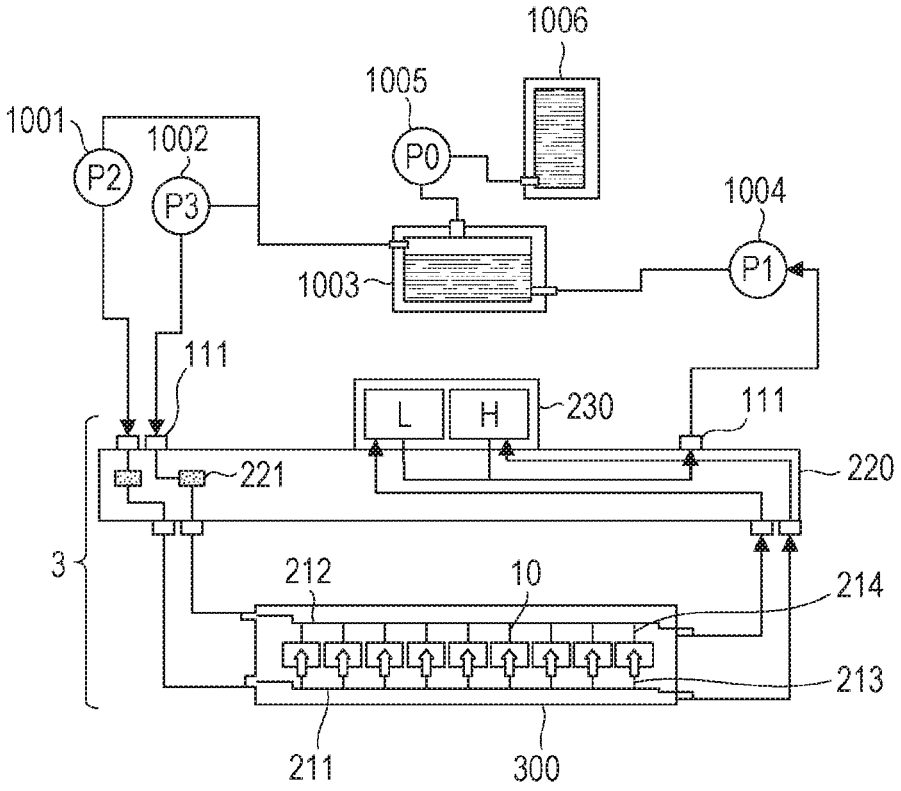
FIG. 3 is a diagram illustrating a second circulation path in the recording apparatus.

FIG. 3 illustrates, of circulation paths applied to the recording apparatus according to the present application example, a second circulation path that is a different circulation path from the above-described first circulation path. The primary points of difference as to the above-described first circulation path are as follows. First, both of the two pressure adjustment mechanisms making up the negative pressure control unit 230 have a mechanism (a mechanism part having operations equivalent to a so-called "backpressure regulator") to control pressure at the upstream side from the negative pressure control unit 230 to fluctuation within a constant range that is centered on a desired set pressure. The second circulation pump 1004 acts as a negative pressure source to depressurize the downstream side from the negative pressure control unit 230. Further, the first circulation pump (high-pressure side) 1001 and first circulation pump (low-pressure side) 1002 are disposed on the upstream side of the liquid discharge head 3, and the negative pressure control unit 230 is disposed on the downstream side of the liquid discharge head 3.

The negative pressure control unit 230 according to the second application example acts to maintain pressure fluctuation on the upstream side of itself (i.e., at the liquid discharge unit 300 side) within a constant range, even in cases where the flow rate fluctuates due to difference in duty when recording with the liquid discharge head 3. Pressure fluctuation is maintained within a constant range centered on a preset pressure, for example. The downstream side of the negative pressure control unit 230 is preferably pressurized by the second circulation pump 1004 via the liquid supply unit 220, as illustrated in FIG. 3. This enables the effects of water head of the buffer tank 1003 as to the liquid discharge head 3 to be suppressed, giving a broader range of selection for the layout of the buffer tank 1003 in the recording apparatus 1000. Alternatively, a water head tank disposed with a certain water head difference as to the negative pressure control unit 230, for example, may be used instead of the second circulation pump 1004.

The negative pressure control unit 230 illustrated in FIG. 3 has two pressure adjustment mechanisms, with different control pressure from each other having been set, in the same way as the first application example. Of the two negative pressure adjustment mechanisms, the relatively high-pressure setting side (denoted by H in FIG. 3) and the relatively low-pressure setting side (denoted by L in FIG. 3) are respectively connected to the common supply channel 211 and the common recovery channel 212 within the liquid discharge unit 300 via the liquid supply unit 220. The pressure of the common supply channel 211 is made to be relatively higher than the pressure of the common recovery channel 212 by the two negative pressure adjustment mechanisms. According to this configuration, flows occur where ink flows from the common supply channel 211 through individual channels 213 and 214 and internal channels in the recording element board 10 to the common recovery channel 212 (indicated by the arrows in FIG. 3). The second circulation path thus yields an ink flow state the same as that of the first circulation path within the liquid discharge unit 300, but has two advantages that are different from the case of the first circulation path.

One advantage is that, with the second circulation path, the negative pressure control unit 230 is disposed on the downstream side of the liquid discharge head 3, so there is little danger that dust and foreign substances generated at the negative pressure control unit 230 will flow into the head. A second advantage is that the maximum value of the necessary flow rate supplied from the buffer tank 1003 to the liquid discharge head 3 can be smaller in the second circulation path as compared to the case of the first circulation path. The reason is as follows. The total flow rate within the common supply channel 211 and common recovery channel 212 when circulating during recording standby will be represented by A. The value of A is defined as the smallest flow rate necessary to maintain the temperature difference in the liquid discharge unit 300 within a desired range in a case where temperature adjustment of the liquid discharge head 3 is performed during recording standby. Also, the discharge flow rate in a case of discharging ink from all discharge orifices of the liquid discharge unit 300 (full discharge) is defined as F. Accordingly, in the case of the first circulation path (FIG. 2), the set flow rate of the first circulation pump (high-pressure side) 1001 and the first circulation pump (low-pressure side) 1002 is A, so the maximum value of the liquid supply amount to the liquid discharge head 3 necessary for full discharge is A+F.

On the other hand, in the case of the second circulation path (FIG. 3), the liquid supply amount necessary at the time of recording standby is flow rate A. This means that the supply amount to the liquid discharge head 3 that is necessary for full discharge is flow rate F. Accordingly, in the case of the second circulation path, the total value of the set flow rate of the first circulation pump (high-pressure side) 1001 and the first circulation pump (low-pressure side) 1002, i.e., the maximum value of the necessary supply amount, is the larger value of A and F. Thus, the maximum value of the necessary supply amount in the second circulation path (A or F) is always smaller than the maximum value of the necessary supply amount in the first circulation path (A+F), as long as the liquid discharge unit 300 of the same configuration is used. Consequently, the degree of freedom regarding circulatory pumps that can be applied is higher in the case of the second circulation path. This is advantageous in that, for example, low-cost circulatory pumps having simple structure can be used, the load on a cooler (omitted from illustration) disposed on the main unit side path can be reduced, thereby reducing costs of the recording apparatus main unit. This advantage is more pronounced with line heads where the values of A or F are relatively great, and is more useful the longer the length of the line head is in the longitudinal direction.

However, there are points where the first circulation path is more advantageous than the second circulation path. That is to say, with the second circulation path, the flow rate flowing through the liquid discharge unit 300 at the time of recording standby is maximum, so the lower the recording duty of the image is, the greater a negative pressure is applied to the nozzles. Accordingly, in a case where the channel widths of the common supply channel 211 and common recovery channel 212 (the length in a direction orthogonal to the direction of flow of ink) is reduced to reduce the head width (the length of the liquid discharge head in the transverse direction), high negative pressure is applied to the nozzles in low-duty images where unevenness is conspicuous. This may result in more influence of satellite droplets. On the other hand, high negative pressure is applied to the nozzles when forming high-duty images in the case of the first circulation path, so any generated satellites are less conspicuous, which is advantageous in that influence on the image quality is small. Which of these two circulation paths is more preferable can be selected in light of the specifications of the liquid discharge head and recording apparatus main unit (discharge flow rate F, smallest circulatory flow rate A, and channel resistance within the head).

Description of Third Circulation Path

Figure 31:
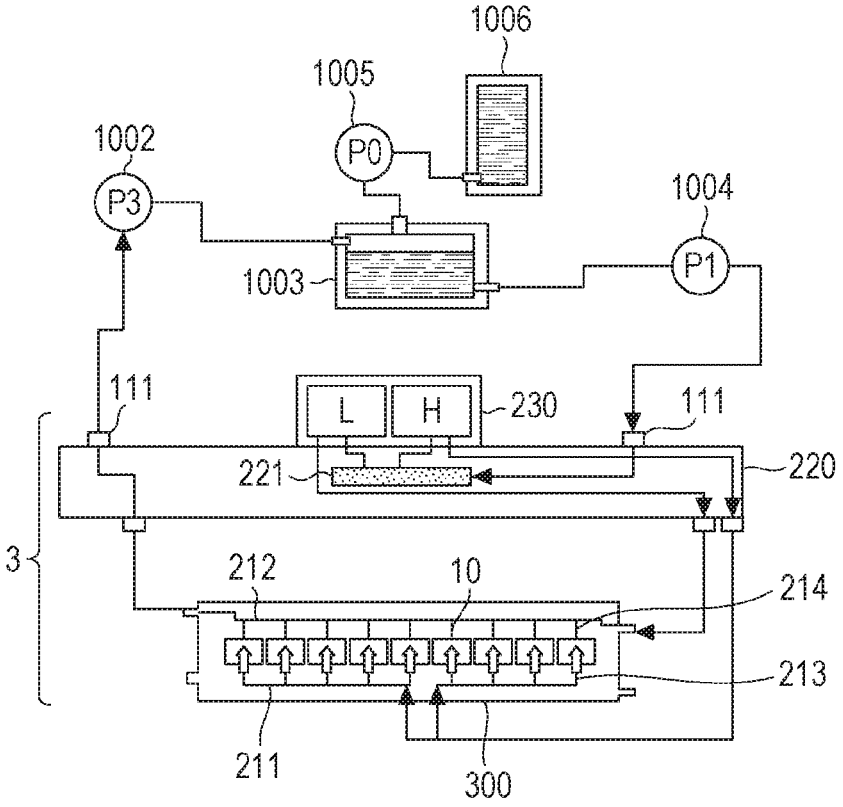
FIG. 31 is a diagram illustrating a third circulation path of the recording apparatus.

FIG. 31 is a schematic diagram illustrating a third circulation path that is a first form of a circulation path applied to the recording apparatus. Description of functions and configurations the same as the above-described first and second circulation paths will be omitted, and description is be made primarily regarding points of difference.

Liquid is supplied to inside of the liquid discharge head 3 from two places at the middle of the liquid discharge head 3, and one end side of the liquid discharge head 3, for a total of three places. The liquid passes from the common supply channel 211 through pressure chambers 23 then recovered by the common recovery channel 212, and thereafter is externally recovered from a recovery opening at the other end of the liquid discharge head 3. Individual channels 213 and 214 communicate with the common supply channel 211 and common recovery channel 212, with the recording element boards 10 and the pressure chambers 23 disposed within the recording element boards 10 being provided on the paths of the individual channels 213 and 214. Accordingly, flows occur where part of the ink which the first circulation pump 1002 pumps flows from the common supply channel 211 through pressure chambers 23 in the recording element boards 10 and to the common recovery channel 212 (indicated by the arrows in FIG. 31). The reason is that pressure difference is formed between the pressure adjustment mechanism H connected to the common supply channel 211, and the pressure adjustment mechanism L to the common recovery channel 212, and the first circulation pump 1002 is connected to just the common recovery channel 212.

Thus, a flow of liquid that passes through the common recovery channel 212, and a flow that passes from the common supply channel 211 through the pressure chambers 23 in the recording element boards 10 and flows to the common recovery channel 212, are formed in the liquid discharge unit 300. Accordingly, heat generated at the recording element boards 10 can be externally discharged from the recording element boards 10 by the flow from the common supply channel 211 to the common recovery channel 212, while suppressing increase of pressure loss. Also, according to the present circulation path, the number of pumps serving as liquid conveyance units can be reduced as compared with the first and second circulation paths described above.

Description of Configuration of Liquid Discharge Head

Figure 4A:
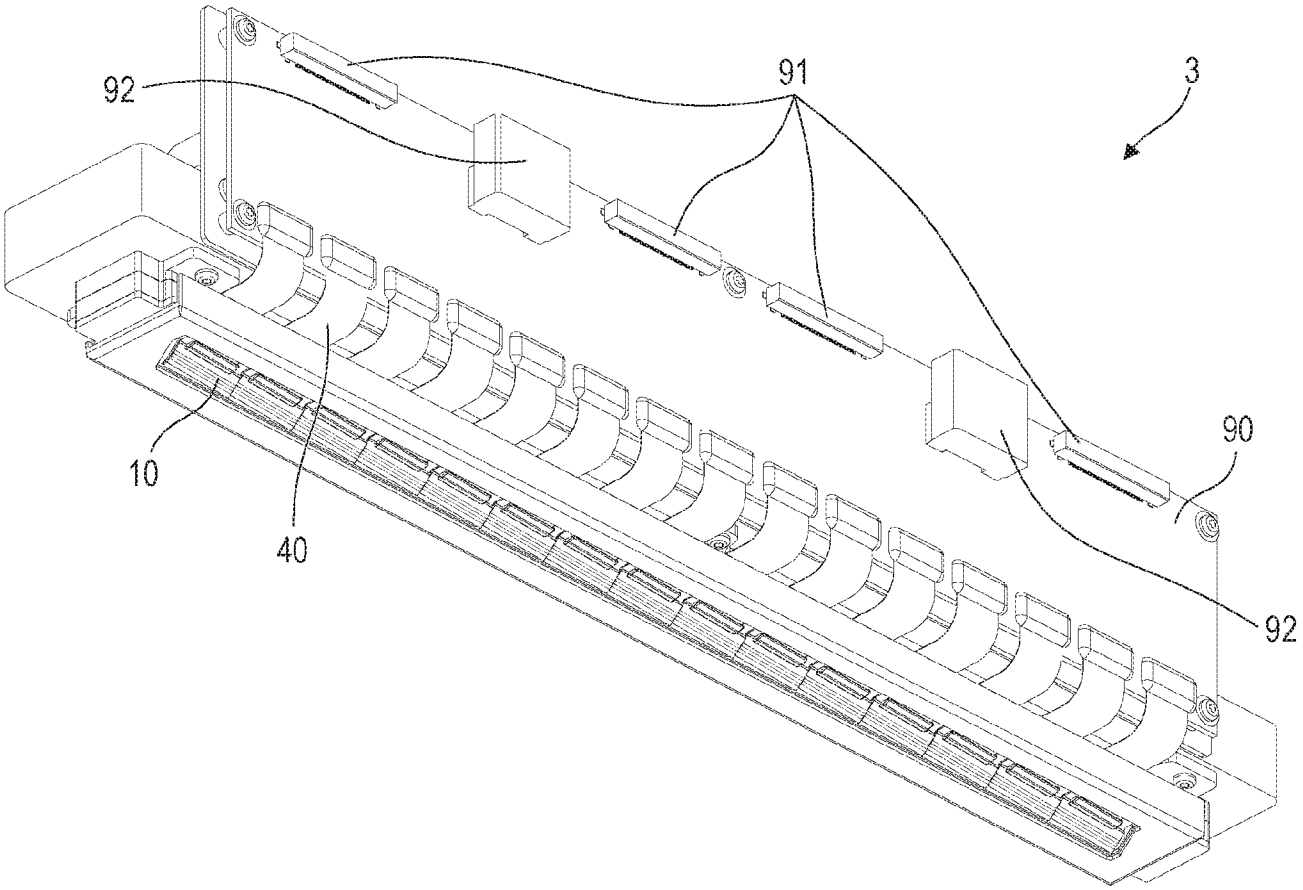
FIGS. 4A and 4B are perspective diagrams of a liquid discharge head according to the first application example.
Figure 4B:
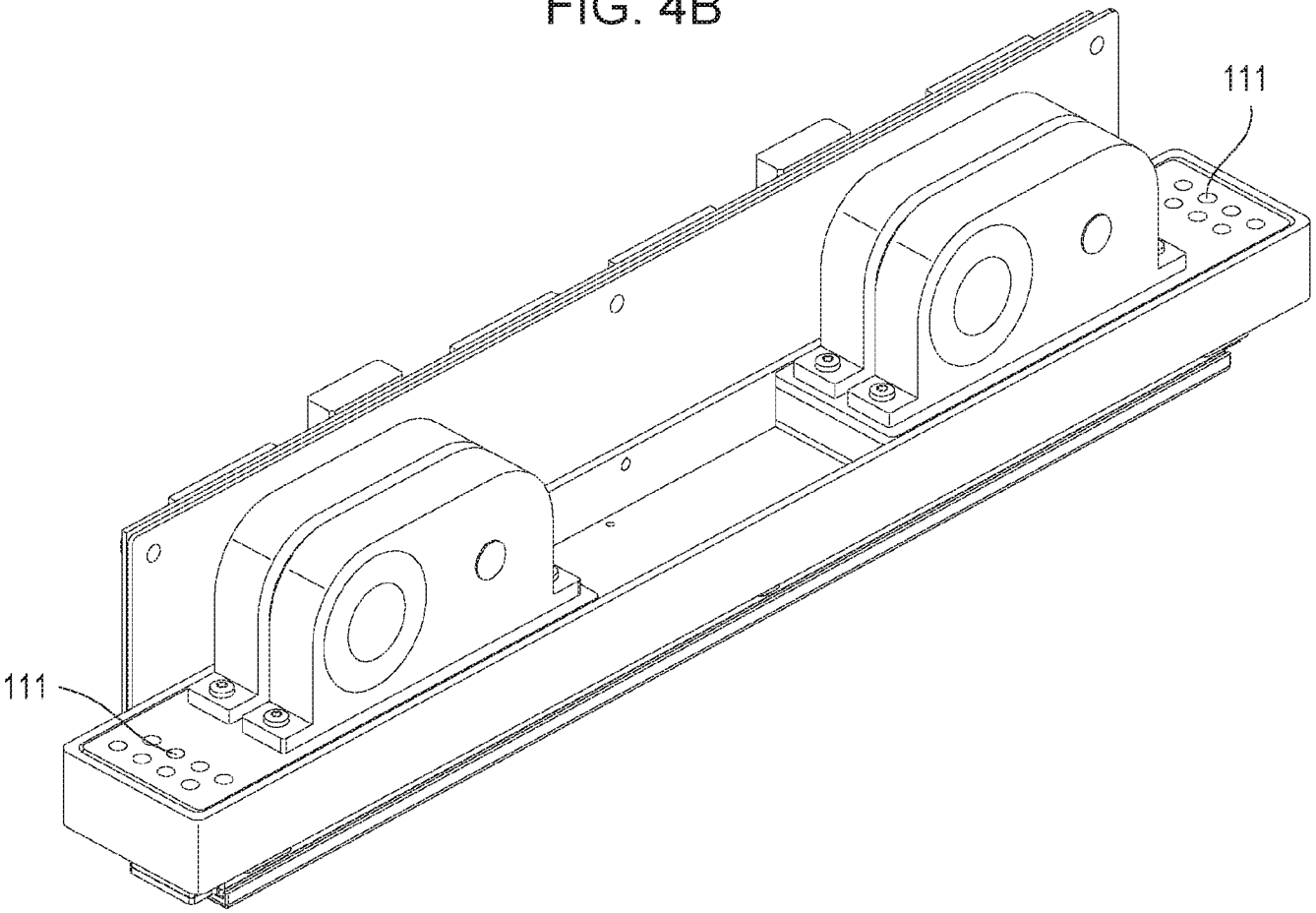

The configuration of the liquid discharge head 3 according to the first application example will be described. FIGS. 4A and 4B are perspective views of the liquid discharge head 3 according to the present application example. The liquid discharge head 3 is a line-type liquid discharge head where fifteen recording element boards 10 capable of discharging ink of the four colors of C, M, Y, and K are arrayed on a straight line (inline layout). The liquid discharge head 3 includes the recording element boards 10, and input terminals 91 and power supply terminals 92 that are electrically connected via flexible printed circuit boards 40 and an electric wiring board 90, as illustrated in FIG. 4A. The input terminals 91 and power supply terminals 92 are electrically connected to a control unit of the recording apparatus 1000, and each supply the recording element boards 10 with discharge drive signals and electric power necessary for discharge. Consolidating wiring by electric circuits in the electric wiring board 90 enables the number of input terminals 91 and power supply terminals 92 to be reduced in comparison with the number of recording element boards 10. This enables the number of electric connection portions that need to be removed when assembling the liquid discharge head 3 to the recording apparatus 1000 or when exchanging the liquid discharge head 3. Liquid connection portions 111 provided to both ends of the liquid discharge head 3 are connected with the liquid supply system of the recording apparatus 1000, as illustrated in FIG. 4B. Thus, ink of the four colors of CMYK is supplied to the liquid discharge head 3, and ink that has passed through the liquid discharge head 3 is recovered to the supply system of the recording apparatus 1000. In this way, ink of each color can circulate over the path of the recording apparatus 1000 and the path of the liquid discharge head 3.

Figure 5:
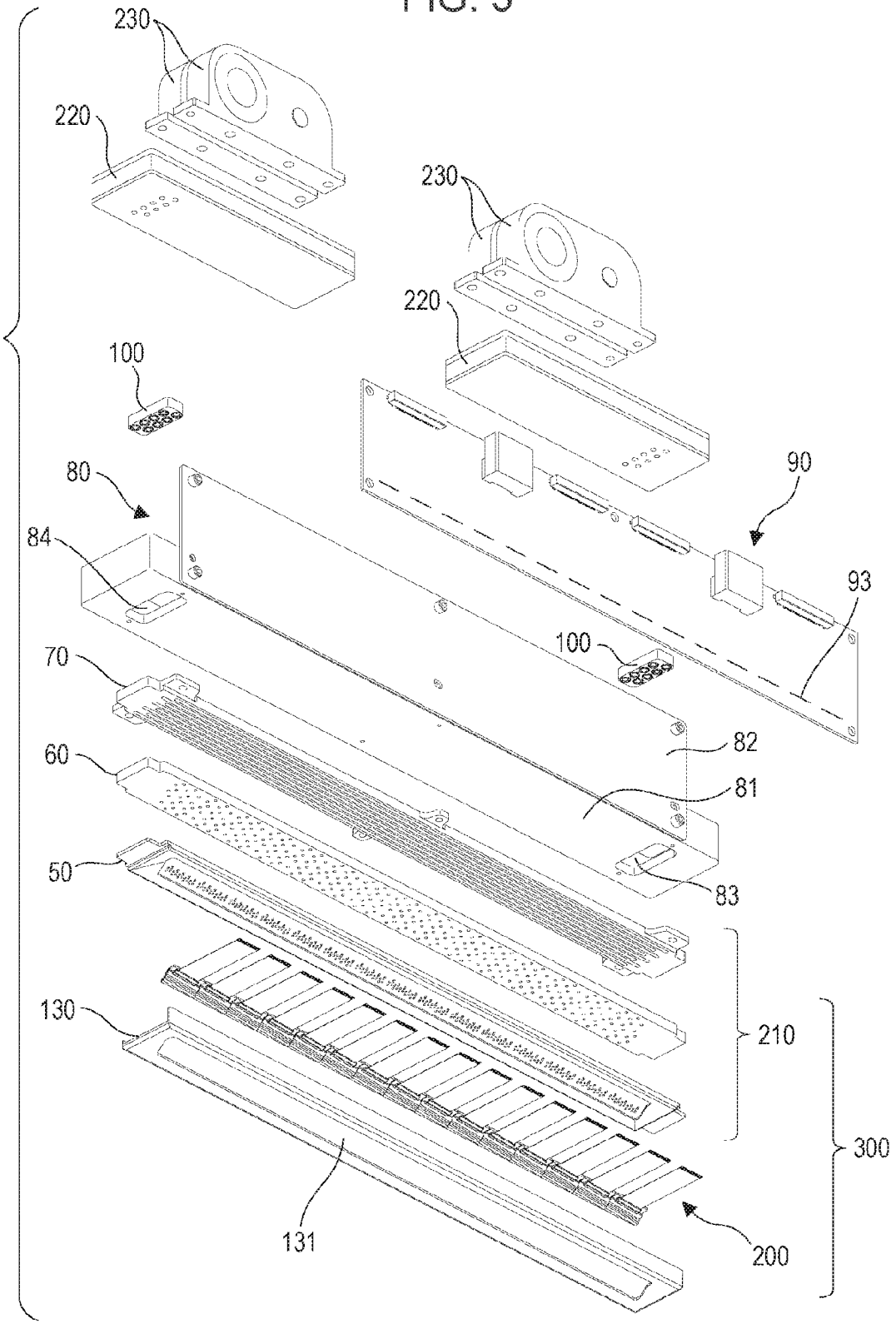
FIG. 5 is a disassembled perspective view of the liquid discharge head in FIG. 4.

FIG. 5 illustrates a disassembled perspective view of parts and units making up the liquid discharge head 3. The liquid discharge unit 300, liquid supply units 220, and electric wiring board 90 are attached to a case 80. The liquid connection portions 111 (FIG. 3) are provided to the liquid supply unit 220, and filters 221 (FIGS. 2 and 3) for each color, that communicate with each opening of the liquid connection portions 111 to remove foreign substances in the supplied ink, are provided inside the liquid supply units 220. Two liquid supply units 220 are each provided with filters 221 for two colors. The inks that have passed through the filters 221 are supplied to the respective negative pressure control units 230 provided on the corresponding liquid supply units 220. Each negative pressure control unit 230 is a unit made up of a pressure adjustment value for its respective color. The negative pressure control units 230 markedly attenuate change in pressure drop in the supply system of the recording apparatus 1000 (supply system on the upstream side of the liquid discharge head 3) occurring due to fluctuation in the flow rate of ink, by the operations of valve and spring members and the like provided therein. Accordingly, the negative pressure control units 230 are capable of stabilizing change of negative pressure at the downstream side from themselves (liquid discharge unit 300 side) within a certain range. Each negative pressure control unit 230 for each color has two pressure adjustment values built in, as described in FIG. 2. These pressure adjustment values are each set to different control pressures, and communicate with the liquid supply unit 220 via the common supply channel 211 in the liquid discharge unit 300 in the case of the high-pressure side and via the common recovery channel 212 in the case of the low-pressure side.

The case 80 is configured including a liquid discharge unit support member 81 and electric wiring board support member 82, and supports the liquid discharge unit 300 and electric wiring board 90 as well as securing rigidity of the liquid discharge head 3. The electric wiring board support member 82 is for supporting the electric wiring board 90, and is fixed by being screwed to the liquid discharge unit support member 81. The liquid discharge unit support member 81 serves to correct warping and deformation of the liquid discharge unit 300, and thus secure relative positional accuracy of the multiple recording element boards 10, thereby suppressing unevenness in the recorded article. Accordingly, the liquid discharge unit support member 81 preferably has sufficient rigidity. Examples of suitable materials include metal materials such as stainless steel and aluminum, and ceramics such as alumina. The liquid discharge unit support member 81 has openings 83 and 84 into which joint rubber members 100 are inserted. Ink supplied from a liquid supply unit 220 passes through a joint rubber member 100 and is guided to a third channel member 70 which is a part making up the liquid discharge unit 300.

The liquid discharge unit 300 is made up of multiple discharge modules 200 and a channel member 210, and a cover member 130 is attached to the face of the liquid discharge unit 300 that faces the recording medium. The cover member 130 is a member having a frame-shaped face where a long opening 131 is provided. The recording element boards 10 included in the discharge module 200 and a sealing member 110 (FIG. 9) are exposed from the opening 131, as illustrated in FIG. 5. The frame portion on the perimeter of the opening 131 functions as a contact surface for a cap member that caps off the liquid discharge head 3 when in recording standby. Accordingly, a closed space is preferably formed when capping, by coating the perimeter of the opening 131 with an adhesive agent, sealant, filling member, or the like, to fill in roughness and gaps on the discharge orifice face of the liquid discharge unit 300.

Next, description will be made regarding the configuration of the channel member 210 included in the liquid discharge unit 300. The channel member 210 is an article formed by laminating a first channel member 50, a second channel member 60, and the third channel member 70, as illustrated in FIG. 5. The channel member 210 distributes the ink supplied from the liquid supply unit 220 to each of the discharge modules 200, and returns ink recirculating from the discharge modules 200 to the liquid supply unit 220. The channel member 210 is fixed to the liquid discharge unit support member 81 by screws, thereby suppressing warping and deformation of the channel member 210.

Figure 6A:
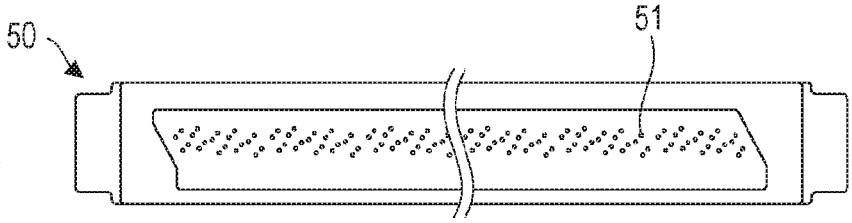
FIGS. 6A through 6F are diagrams illustrating the configuration of first through third channel members making up a channel member that the liquid discharge head in FIG. 4 has.
Figure 6B:
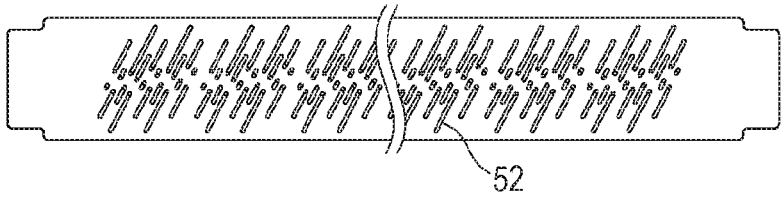
Figure 6C:
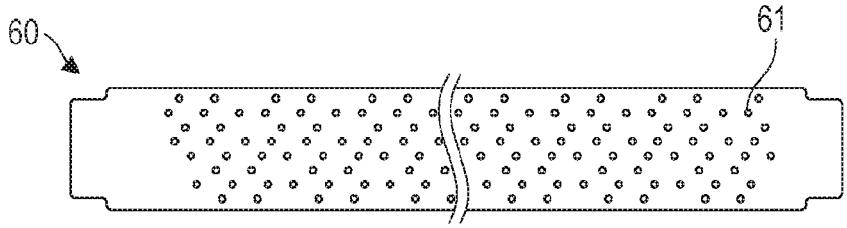
Figure 6D:
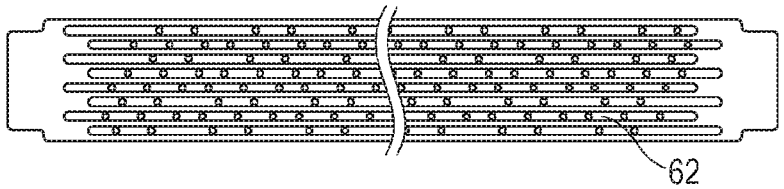
Figure 6E:
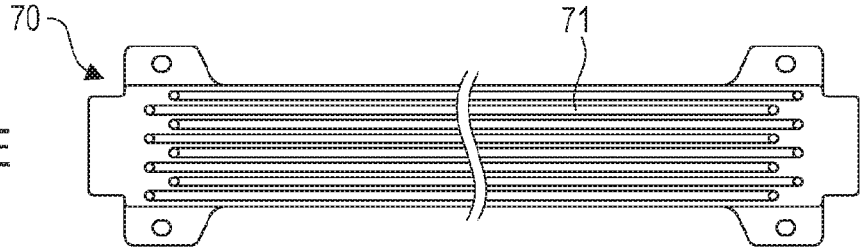
Figure 6F:
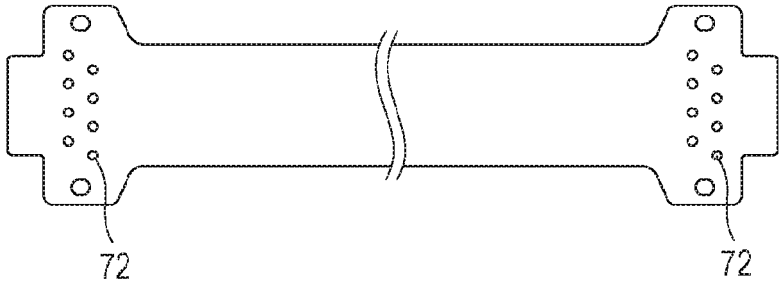
Figure 7:
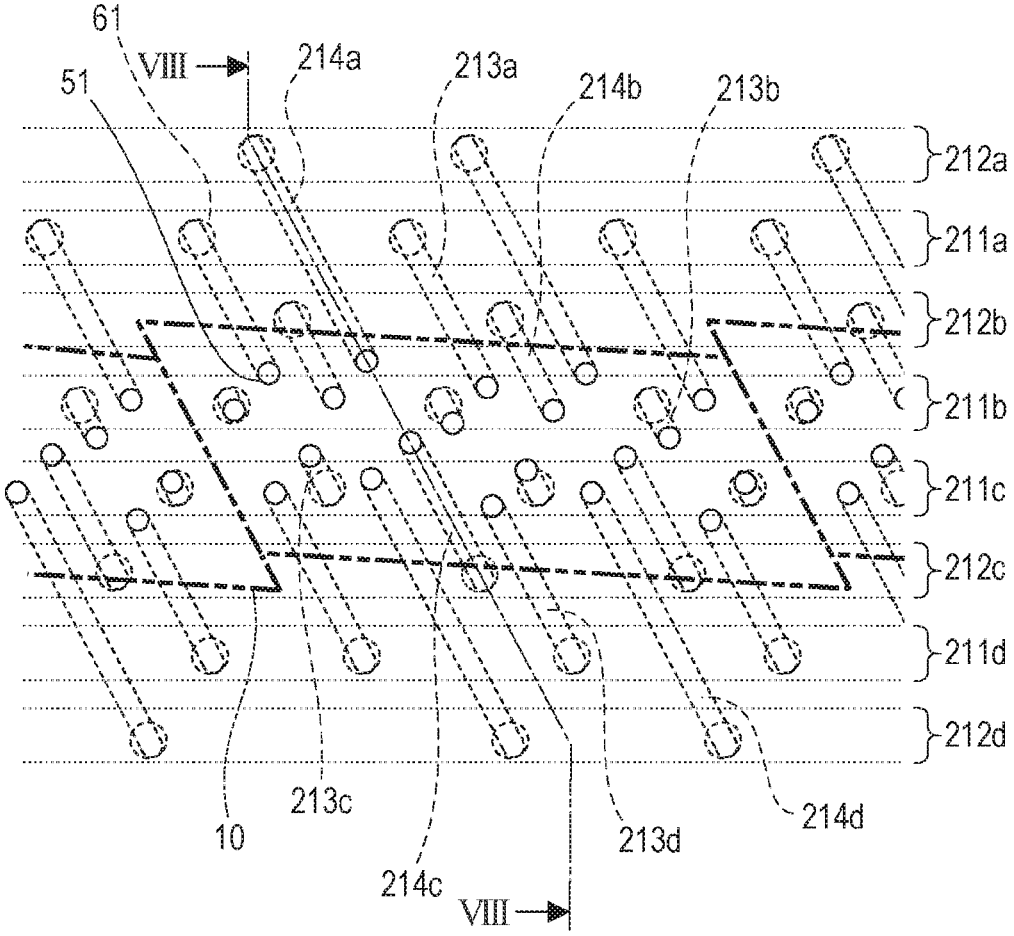
FIG. 7 is a diagram for describing connection relationships between channels within the channel member.

FIGS. 6A through 6F are diagrams illustrating the front and rear sides of the channel members making up the first through third channel members. FIG. 6A illustrates the side of the first channel member 50 on which the discharge modules 200 are mounted, and FIG. 6F illustrates the face of the third channel member 70 that comes in contact with the liquid discharge unit support member 81. The first channel member 50 and second channel member 60 have mutually adjoining channel member contact faces, illustrated in FIGS. 6B and 6C respectively, as do the second channel member 60 and third channel member 70 as illustrated in FIGS. 6D and 6E. The adjoining second channel member 60 and third channel member 70 have formed thereupon common channel grooves 62 and 71 which, when facing each other, form eight common channels extending in the longitudinal direction of the channel members. This forms a set of common supply channels 211 and common recovery channels 212 for each of the colors within the channel member 210 (FIG. 7). Communication ports 72 of the third channel member 70 communicate with the holes in the joint rubber members 100, so as to communicate with the liquid supply unit 220 by fluid connection. Multiple communication ports 61 are formed on the bottom face of the common channel grooves 62 of the second channel member 60, communicating with one end of individual channel grooves 52 of the first channel member 50. Communication ports 51 are formed at the other end of the individual channel grooves 52 of the first channel member 50 so as to communicate with the multiple discharge modules 200 by fluid connection via the communication ports 51. These individual channel grooves 52 allow the channels to be consolidated at the middle of the channel member.

The first through third channel members preferably are corrosion-resistant as to the ink, and formed from a material having a low linear expansion coefficient. Examples suitable materials include alumina, liquid crystal polymer (LCP), and composite materials (resin materials) where inorganic filler such as fine particles of silica or fiber or the like has been added to a base material such as polyphenyl sulfide (PPS), polysulfone (PSF), or denatured polyphenylene ether (PPE). The channel member 210 may be formed by laminating the three channel members and adhering using an adhesive agent, or in a case of selecting a composite resin material for the material, the three channel members may be joined by fusing.

Next, the connection relationship of the channels within the channel member 210 will be described with reference to FIG. 7. FIG. 7 is a partially enlarged transparent view of channels within the channel member 210 formed by joining the first through third channel members, as viewed from the side of the first channel member 50 on which the discharge modules 200 are mounted. The channel member 210 has, for each color, common supply channels 211 (211*a*, 211*b*, 211*c*, and 211*d*) and common recovery channels 212 (212*a*, 212*b*, 212*c*, and 212*d*) extending on the longitudinal direction of the liquid discharge head 3. Multiple individual supply channels 213 (213*a*, 213*b*, 213*c*, and 213*d*) formed of the individual channel grooves 52 are connected to the common supply channels 211 of each color via the communication ports 61. Multiple individual recovery channels 214 (214*a*, 214*b*, 214*c*, and 214*d*) formed of the individual channel grooves 52 are connected to the common recovery channels 212 of each color via the communication ports 61. This channel configuration enables ink to be consolidated at the recording element boards 10 situated at the middle of the channel members, from the common supply channels 211 via the individual supply channels 213. Ink can also be recovered from the recording element boards 10 to the common recovery channels 212 via the individual recovery channels 214.

Figure 8:
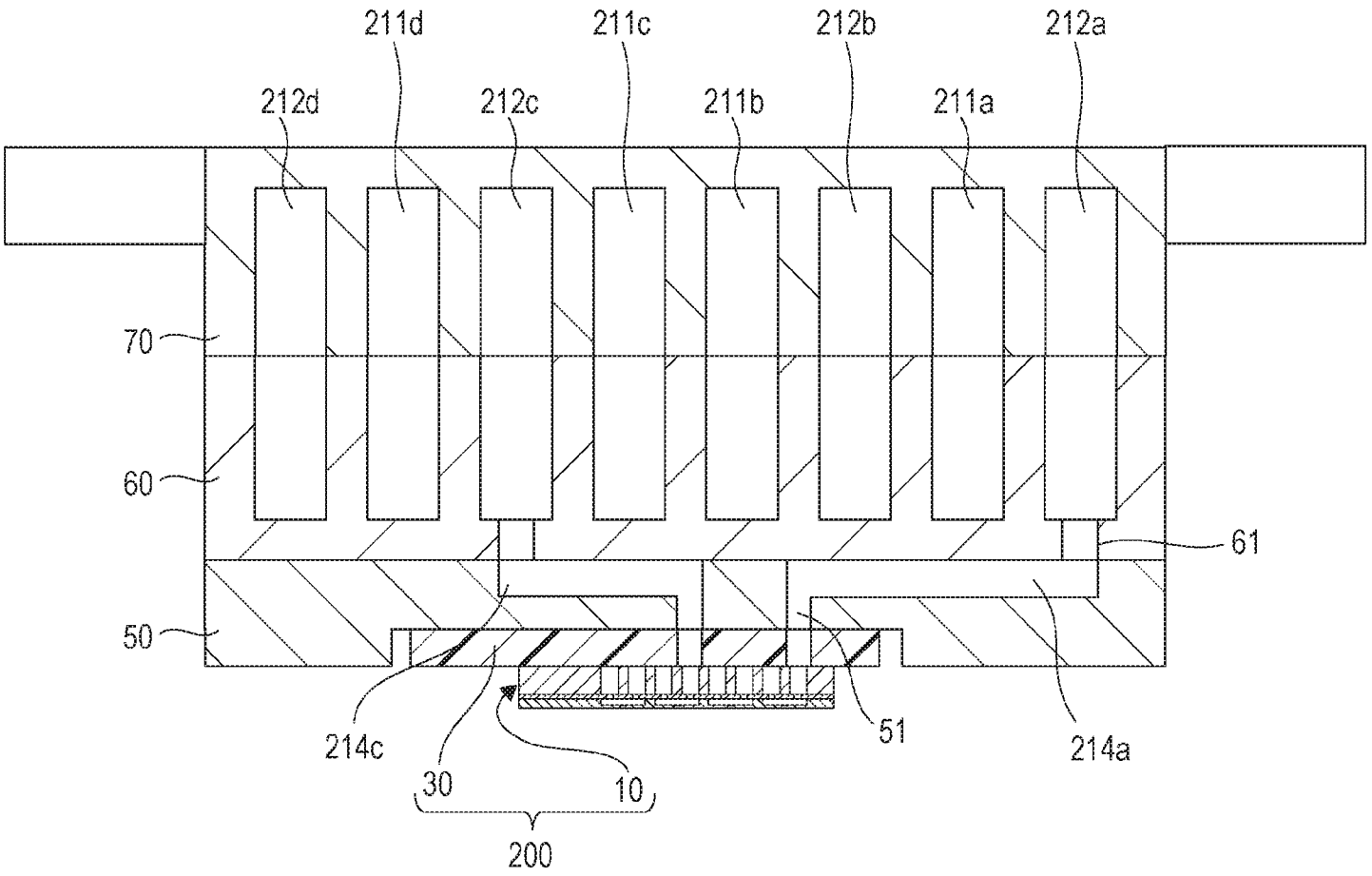
FIG. 8 is a cross-sectional view taken along line VIII-VIII in FIG. 7.

FIG. 8 is a cross-sectional view taken along line VIII-VIII in FIG. 7, illustrating that individual recovery channels (214*a* and 214*c*) communicate with the discharge module 200 via the communication ports 51. Although FIG. 8 only illustrates the individual recovery channels (214*a* and 214*c*), the individual supply channels 213 and the discharge module 200 communicate at a different cross-section, as illustrated in FIG. 7. Channels for supplying ink from the first channel member 50 to recording elements 15 (FIG. 10B), provided to the recording element board 10, are formed in a support member 30 included in the discharge module 200 and the recording element boards 10. Further, channels for recovering (recirculating) part or all of the ink supplied to the recording elements 15 are formed in the support member 30 and recording element boards 10. The common supply channels 211 of each color is connected to the negative pressure control unit 230 (high-pressure side) of the corresponding color via its liquid supply unit 220, and the common recovery channels 212 are connected to the negative pressure control units 230 (low-pressure side) via the liquid supply units 220. The negative pressure control units 230 generate pressure difference between the common supply channels 211 and common recovery channels 212. Accordingly, a flow occurs for each color in the liquid discharge head 3 according to the present application example where the channels are connected as illustrated in FIGS. 7 and 8, in the order of common supply channel 211→individual supply channels 213→recording element boards 10→individual recovery channels 214→common recovery channel 212.

Description of Discharge Module

Figure 9A:
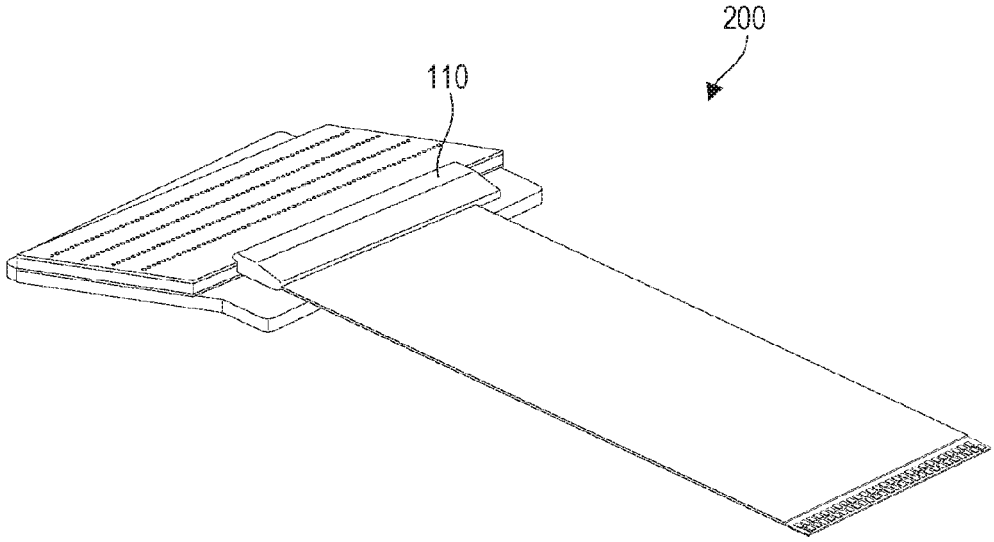
FIGS. 9A and 9B are diagrams illustrating a discharge module, FIG. 9A being a perspective view and FIG. 9B a disassembled view.
Figure 9B:
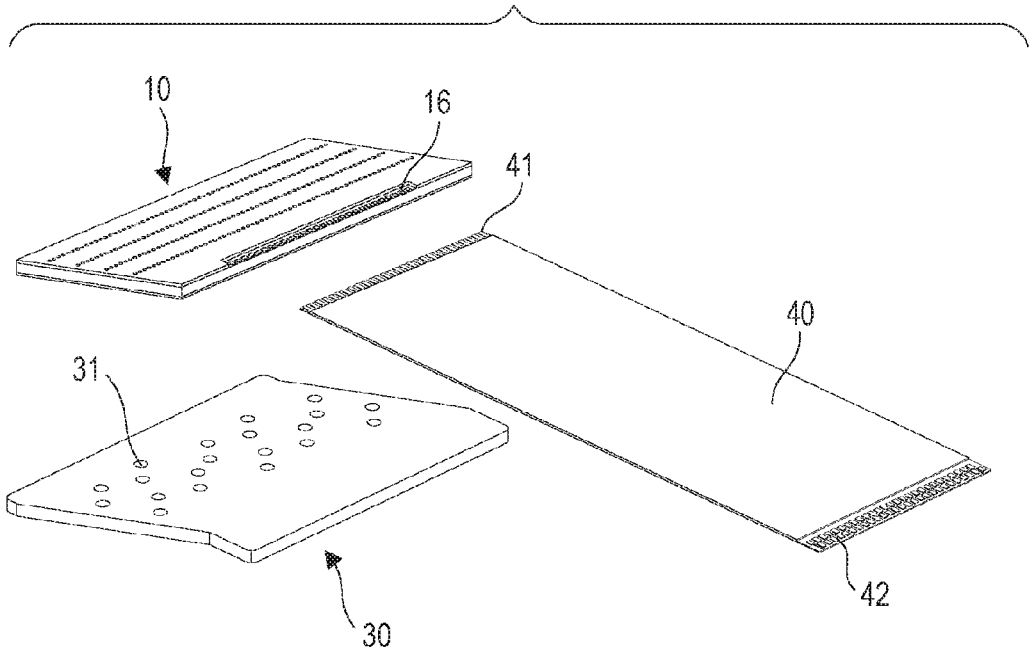

FIG. 9A illustrates a perspective view of one discharge module 200, and FIG. 9B illustrates a disassembled view thereof. The method of manufacturing the discharge module 200 is as follows. First, a recording element board 10 and flexible printed circuit board 40 are adhered to a support member 30 in which communication ports 31 have been formed beforehand. Subsequently, terminals 16 on the recording element board 10 are electrically connected to terminals 41 on the flexible printed circuit board 40 by wire bonding, following which the wire-bonded portion (electric connection portion) is covered and sealed by a sealant 110. Terminals 42 at the other end of the flexible printed circuit board 40 from the recording element board 10 are electrically connected to connection terminals 93 (FIG. 5) of the electric wiring board 90. The support member 30 is a support member that supports the recording element board 10, and also is a channel member communicating between the recording element board 10 and the channel member 210 by fluid connection. Accordingly, the support member 30 should have a high degree of flatness, and also should be able to be joined to the recording element board 10 with a high degree of reliability. Examples of suitable materials include alumina and resin materials.

Description of Structure of Recording Element Board

Figure 10A:
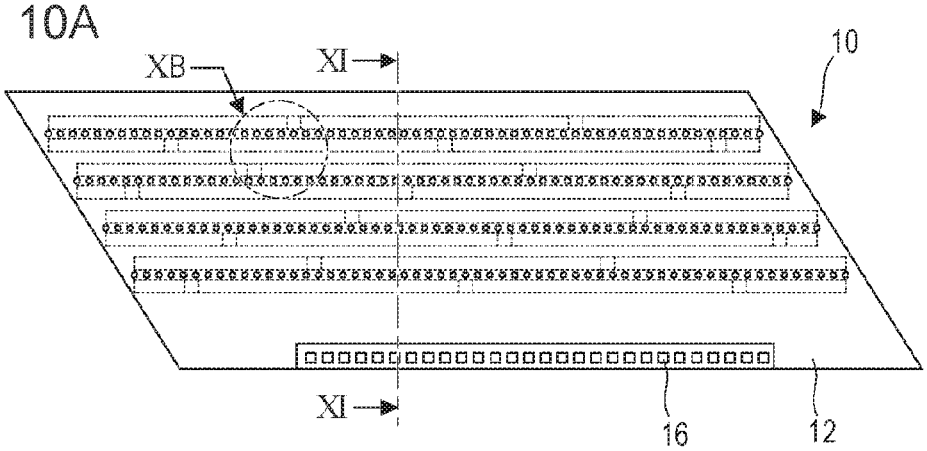
FIGS. 10A through 10C are diagrams illustrating the configuration of a recording element board.
Figure 10B:
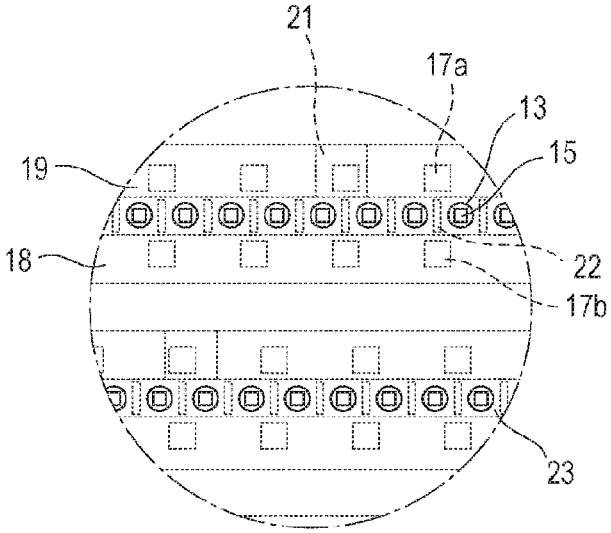
Figure 10C:
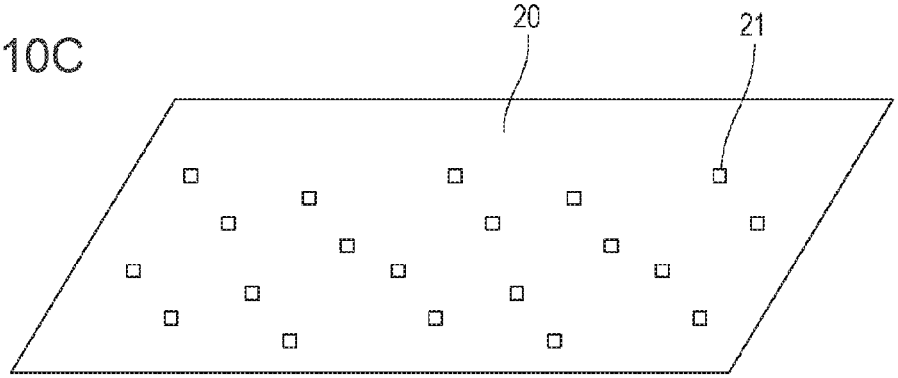

The configuration of the recording element board 10 according to the present application example will be described. FIG. 10A is a plan view of the side of the recording element board 10 on which discharge orifices 13 have been formed, FIG. 10B is an enlarged view of the portion indicated by XB in FIG. 10A, and FIG. 10C is a plan view of the rear face of the recording element board 10 from that in FIG. 10A. The recording element board 10 has a discharge orifice forming member 12, where four discharge orifice rows corresponding to the ink colors are formed, as illustrated in FIG. 10A. Note that hereinafter, the direction in which the discharge orifice rows, where multiple discharge orifices 13 are arrayed, extend, will be referred to as "discharge orifice row" direction.

The recording elements 15, which are heating elements to cause bubbling of the ink due to thermal energy, are disposed at positions corresponding to the discharge orifices 13, as illustrated in FIG. 10B. Pressure chambers 23 that contain the recording elements 15 are sectioned off by partitions 22. The recording elements 15 are electrically connected to the terminals 16 in FIG. 10A by electric wiring (omitted from illustration) provided to the recording element board 10. The recording elements 15 generate heat to cause the ink to boil, based on pulse signals input from a control circuit of the recording apparatus 1000, via the electric wiring board 90 (FIG. 5) and flexible printed circuit board 40 (FIG. 9). The force of bubbling due to this boiling discharges ink from the discharge orifices 13. A liquid supply channel 18 extends along one side of each discharge orifice row, and a liquid recovery channel 19 along the other, as illustrated in FIG. 10B. The liquid supply channels 18 and liquid recovery channels 19 are channels extending in the direction of the discharge orifice rows provided on the recording element board 10, and communicate with the discharge orifices 13 via supply channels 17*a* and recovery channels 17*b*, respectively. The supply channels 17*a* and recovery channels 17*b* extend in a direction intersecting the plane direction of a substrate 11, and communicate with the liquid supply channel 18 and liquid recovery channel 19, respectively.

Figure 11:
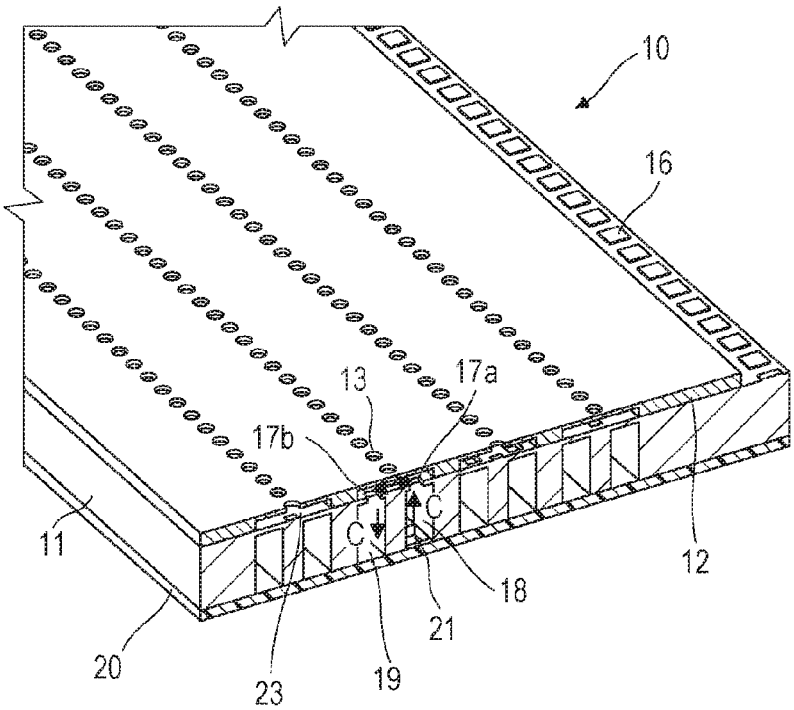
FIG. 11 is a perspective view illustrating the configuration of the recording element board including cross-section XI-XI in FIG. 10A and a cover.

A sheet-shaped cover 20 is laminated on the rear face from the face of the recording element board 10 on which the discharge orifices 13 are formed, the cover 20 having multiple openings 21 communicating with the liquid supply channel 18 and liquid recovery channel 19 which will be described later, as illustrated in FIGS. 10C and 11. In the present application example, three openings 21 are provided in the cover 20 for each liquid supply channel 18, and two openings 21 are provided for each liquid recovery channel 19. The openings 21 of the cover 20 communicate with the multiple communication ports 51 illustrated in FIG. 6A, as illustrated in FIG. 10B. The cover 20 functions as a lid that makes up part of the sides of the liquid supply channel 18 and liquid recovery channel 19 formed in the substrate 11 of the recording element board 10, as illustrated in FIG. 11. The cover 20 preferably is sufficiently corrosion-resistant as to the ink, and has to have a high degree of precision regarding the opening shapes of the openings 21 and the positions thereof from the perspective of color mixture prevention. Accordingly, a photosensitive resin material or silicon plate is preferably used as the material for the cover 20, with the openings 21 being formed by photolithography process. The cover 20 thus is for converting the pitch of channels by the openings 21. The cover 20 preferably is thin, taking into consideration pressure drop, and preferably is formed of a film material.

Next, the flow of ink within the recording element board 10 will be described. FIG. 11 is a perspective view, illustrating a cross-section of the recording element board 10 and cover 20 taken along plane XI-XI in FIG. 10A. The recording element board 10 is formed by laminating the substrate 11 formed of silicon (Si) and the discharge orifice forming member 12 formed of a photosensitive resin, with the cover 20 joined on the rear face of the substrate 11. The recording elements 15 are formed on the other face side of the substrate 11 (FIG. 10B) with the grooves making up the liquid supply channels 18 and liquid recovery channels 19 extending along the discharge orifice rows being formed at the reverse side thereof. The liquid supply channels 18 and liquid recovery channels 19 formed by the substrate 11 and cover 20 are respectively connected to the common supply channels 211 and common recovery channels 212 within the channel member 210, and there is differential pressure between the liquid supply channels 18 and liquid recovery channels 19. When ink is being discharged from multiple discharge orifices 13 of the liquid discharge head 3 and recording is being performed, ink in the liquid supply channels 18 provided in the substrate 11 flows as indicated by the arrows C in FIG. 11 at discharge orifices 13 not performing discharge operations, due to this differential pressure. That is to say, the ink flows from the liquid supply channel 18 to the liquid recovery channel 19 via the supply channel 17*a*, pressure chamber 23, and recovery channel 17*b*. This flow enables ink that has thickened due to evaporation from the discharge orifices 13, bubbles, foreign substance, and so forth, to be recovered to the liquid recovery channel 19 from the discharge orifices 13 and pressure chambers 23 where recording is not being performed. This also enables thickening of ink at the discharge orifices 13 and pressure chambers 23 to be suppressed. Ink recovered to the liquid recovery channels 19 is recovered in the order of the communication ports 51 in the channel member 210, the individual recovery channels 214, and the common recovery channel 212, via the openings 21 of the cover 20 and the liquid communication ports 31 of the support member 30 (see FIG. 9B). This ink is ultimately recovered to the supply path of the recording apparatus 1000.

That is to say, ink supplied from the recording apparatus main unit to the liquid discharge head 3 is supplied and recovered by flowing in the order described below. First, the ink flows from the liquid connection portions 111 of the liquid supply unit 220 into the liquid discharge head 3. The ink then is supplied to the joint rubber members 100, communication ports 72 and common channel grooves 71 provided to the third channel member 70, common channel grooves 62 and communication ports 61 provided to the second channel member 60, and individual channel grooves 52 and communication ports 51 provided to the first channel member 50. Thereafter, the ink is supplied to the pressure chambers 23 in the order of the liquid supply channels 18 and supply channels 17*a* provided to the substrate 11. Ink that has been supplied to the pressure chambers 23 but not discharged from the discharge orifices 13 flows in the order of the recovery channels 17*b* and liquid recovery channels 19 provided to the substrate 11, the openings 21 provided to the cover 20, and the communication ports 31 provided to the support member 30. Thereafter, the ink flows in the order of the communication ports 51 and individual channel grooves 52 provided to the first channel member 50, the communication ports 61 and common channel grooves 62 provided to the second channel member 60, the common channel grooves 71 and communication ports 72 provided to the third channel member 70, and the joint rubber members 100. The ink further flows outside of the liquid discharge head 3 from the liquid connection portions 111 provided to the liquid supply unit. In the first circulation path illustrated in FIG. 2, ink that has flowed in from the liquid connection portions 111 passes through the negative pressure control unit 230 and then is supplied to the joint rubber members 100. In the second circulation path illustrated in FIG. 3, ink recovered from the pressure chambers 23 passes through the joint rubber members 100, and then flows out of the liquid discharge head 3 from the liquid connection portions 111 via the negative pressure control unit 230.

Also, not all ink flowing in from one end of the common supply channel 211 of the liquid discharge unit 300 is supplied to the pressure chamber 23 via the individual supply channels 213*a*, as illustrated in FIGS. 2 and 3. There is ink that flows from the other end of the common supply channel 211 and through the liquid supply unit 220 without ever entering the individual supply channels 213*a*. Thus, providing channels where ink flows without going through the recording element board 10 enables backflow in the circulatory flow of ink to be suppressed, even in a case where the recording element board 10 has fine channels where the flow resistance is great, as in the case of the present application example. Accordingly, the liquid discharge head according to the present application example is capable of suppressing thickening of ink in pressure chambers and nearby the discharge orifices, thereby suppressing deviation of discharge from the normal direction and non-discharge of ink, so high image quality recording can be performed as a result.

Description of Positional Relationship among Recording Element Boards

Figure 12:
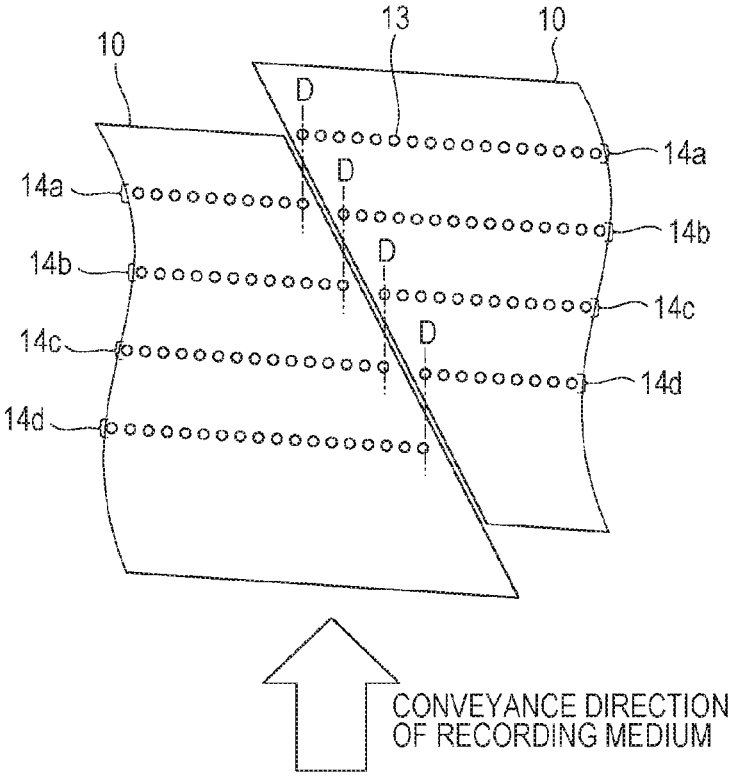
FIG. 12 is a plan view showing a partially enlarged illustration of adjacent portions of recording element boards in two adjacent discharge modules.

FIG. 12 is a plan view illustrating a partial enlargement of adjacent portions of recording element boards 10 for two adjacent discharge modules. The recording element boards 10 according to the present application example are shaped as parallelograms, as illustrated in FIGS. 10A through 10C. The discharge orifice rows (14*a* through 14*d*) where discharge orifices 13 are arrayed on the recording element boards 10 are dispose inclined to the conveyance direction of the recording medium by a certain angle, as illustrated in FIG. 12. At least one discharge orifice of discharge orifice rows at adjacent portions of the recording element board 10 is made to overlap in the conveyance direction of the recording medium thereby. In FIG. 12, two discharge orifices on the lines D are in a mutually overlapping relationship. This layout enables black streaks and blank portions in the recorded image to be made less conspicuous by driving control of the overlapping discharge orifices, even in a case where the positions of the recording element board 10 are somewhat deviated from the predetermined position. The configuration illustrated in FIG. 12 can be used even in a case where the multiple recording element boards 10 are laid out in a straight line (inline) instead of in a staggered arrangement. Thus, black streaks and blank portions at overlapping portions between the recording element boards 10 can be handled while suppressing increased length of the liquid discharge head 3 in the conveyance direction of the recording medium. Although the shape of the primary face of the recording element board 10 according to the present discharge orifice row is a parallelogram, this is not restrictive. The configuration can be suitably applied even in cases where the shape is a rectangle, a trapezoid, or another shape.

Description of Modification of Liquid Discharge Head Configuration

Figure 30:
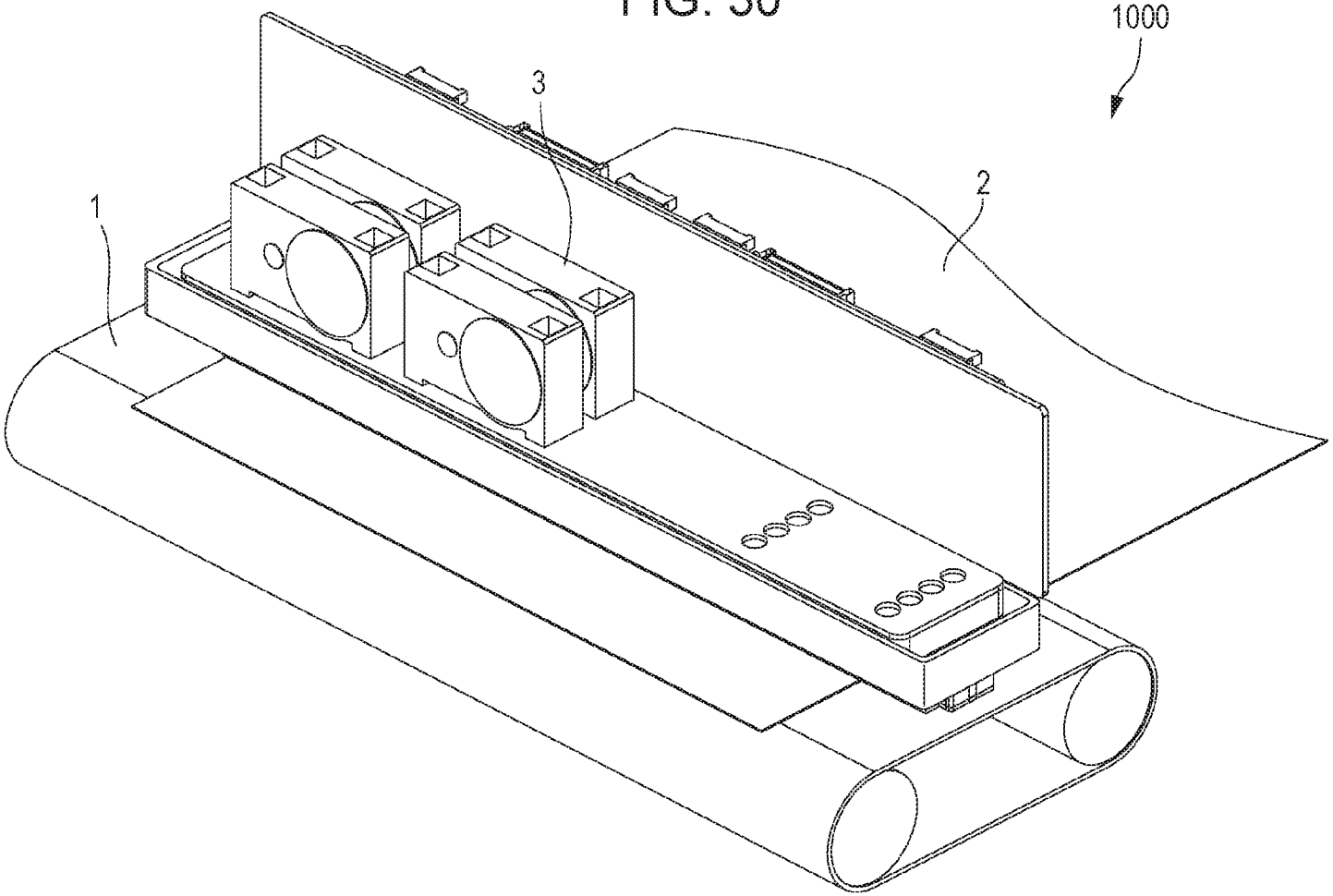
FIG. 30 is a diagram illustrating a modification of the liquid discharge head according to the first application example.
Figure 32A:
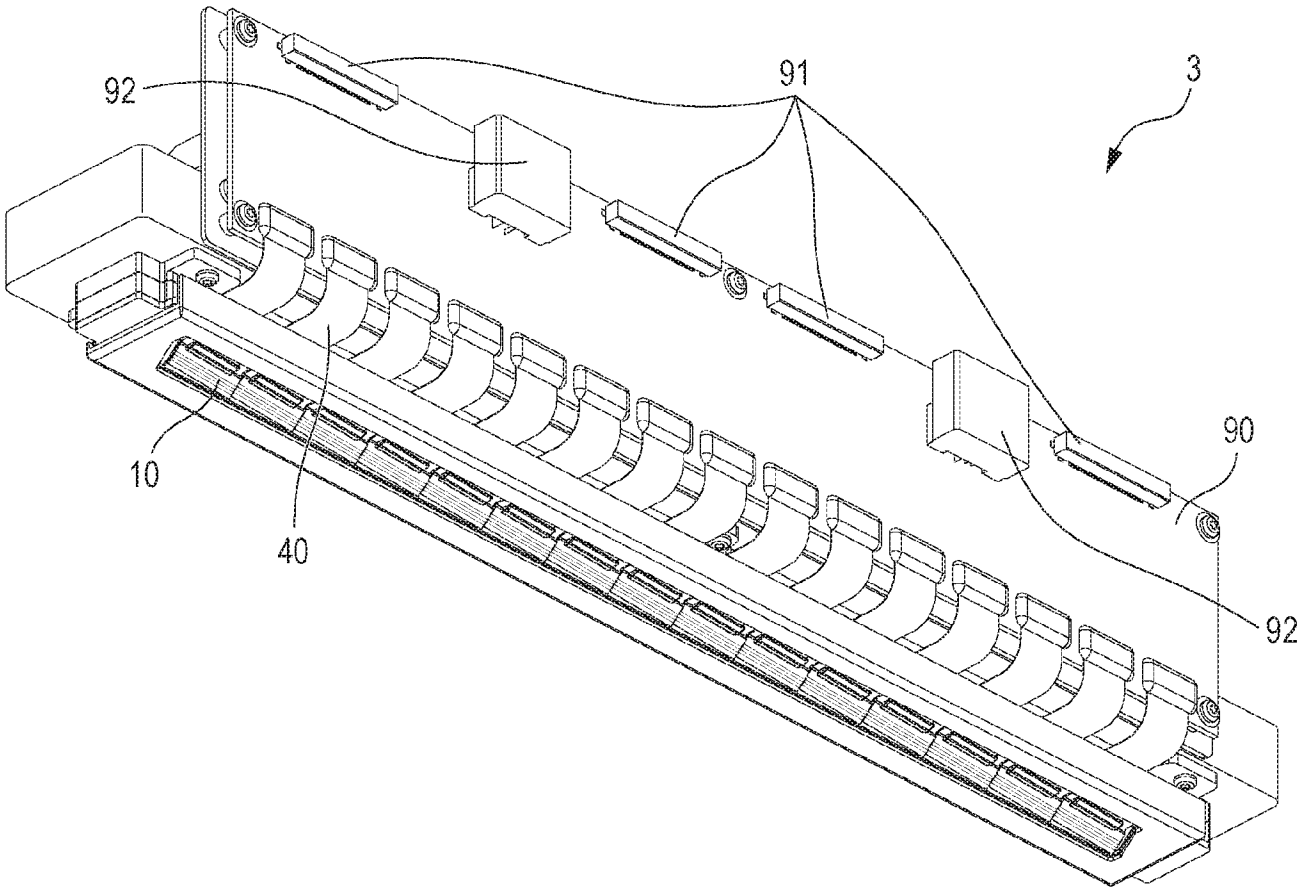
FIGS. 32A and 32B are diagrams illustrating a schematic configuration of a modification of the liquid discharge head according to the first application example exemplary embodiment.
Figure 32B:
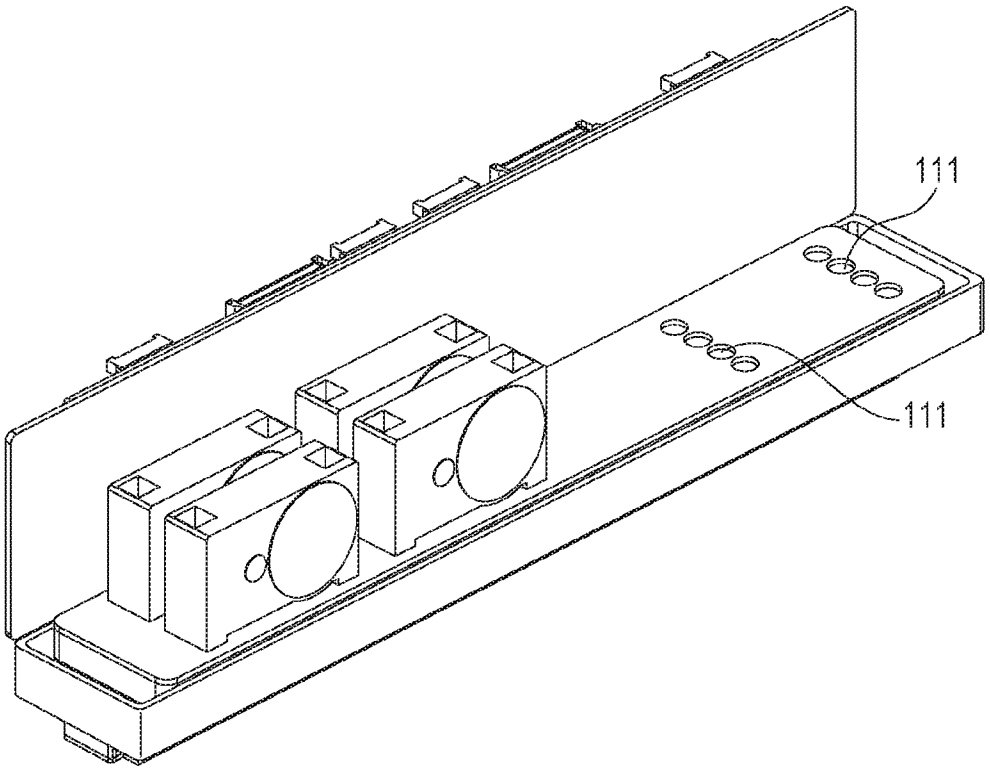
Figure 33:
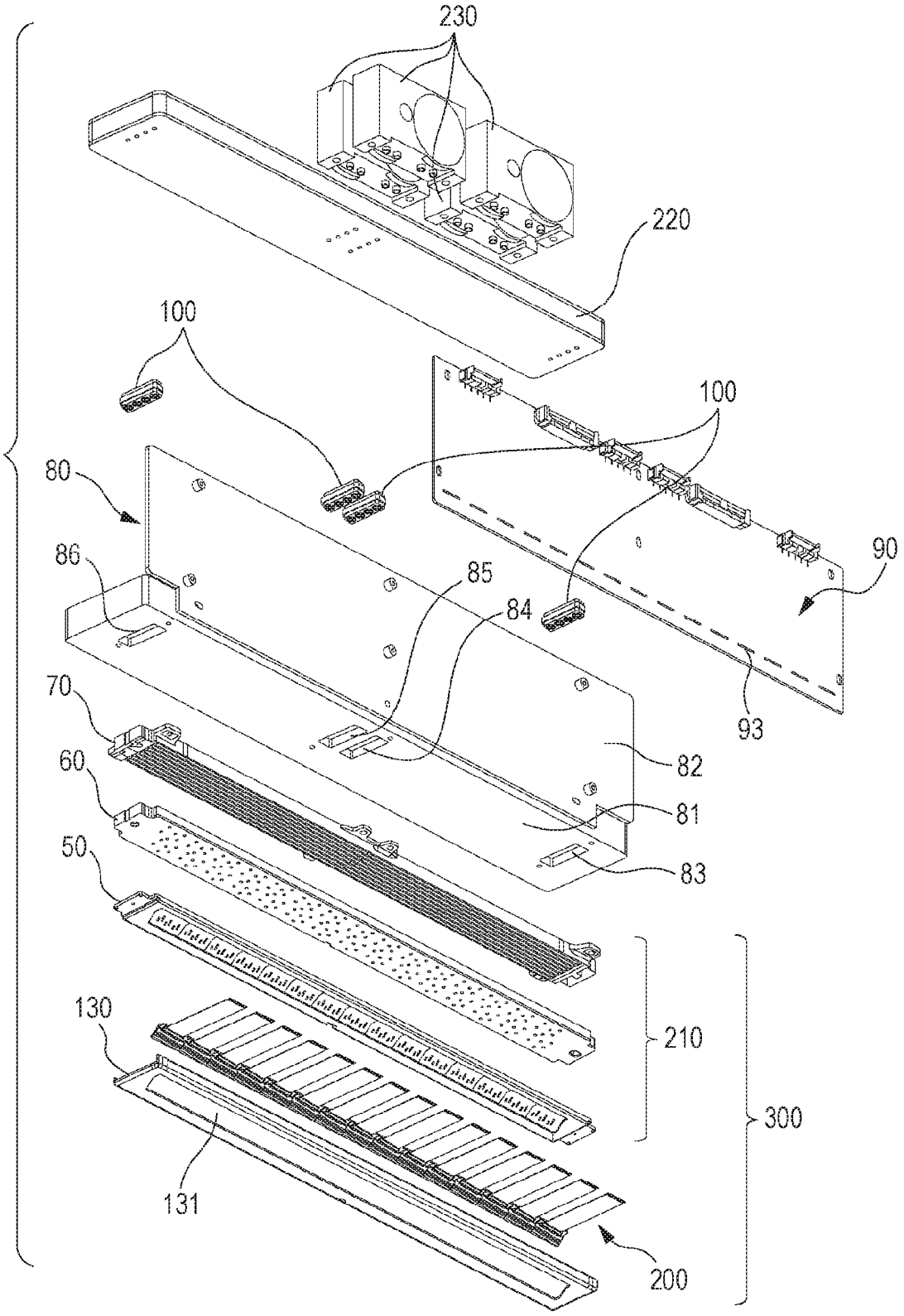
FIG. 33 is a diagram illustrating a schematic configuration of a modification of the liquid discharge head according to the first application example.

A modification of the above-described liquid discharge head configuration will be described with reference to FIGS. 30 and 32A through 34. Configurations and functions that are the same as the above-described example will be omitted from description, and points of difference will primarily be described. In this modification, the multiple liquid connection portions 111 that are connection portions between the outside of the liquid discharge head 3 and the liquid are disposed in a consolidated manner at one end side of the liquid discharge head 3 in the longitudinal direction, as illustrated in FIGS. 30, 32A, and 32B. Multiple negative pressure control units 230 are disposed in a consolidated manner at the other end side of the liquid discharge head 3 (FIG. 33). The liquid supply unit 220 included in the liquid discharge head 3 is configured as a long and slender unit corresponding to the length of the liquid discharge head 3, and has channels and filters 221 corresponding to the liquid of the four colors being supplied. The positions of the openings 83 through 86 provided on the liquid discharge unit support member 81 also are at different positions from the liquid discharge head 3 described above, as illustrated in FIG. 33.

Figure 34:
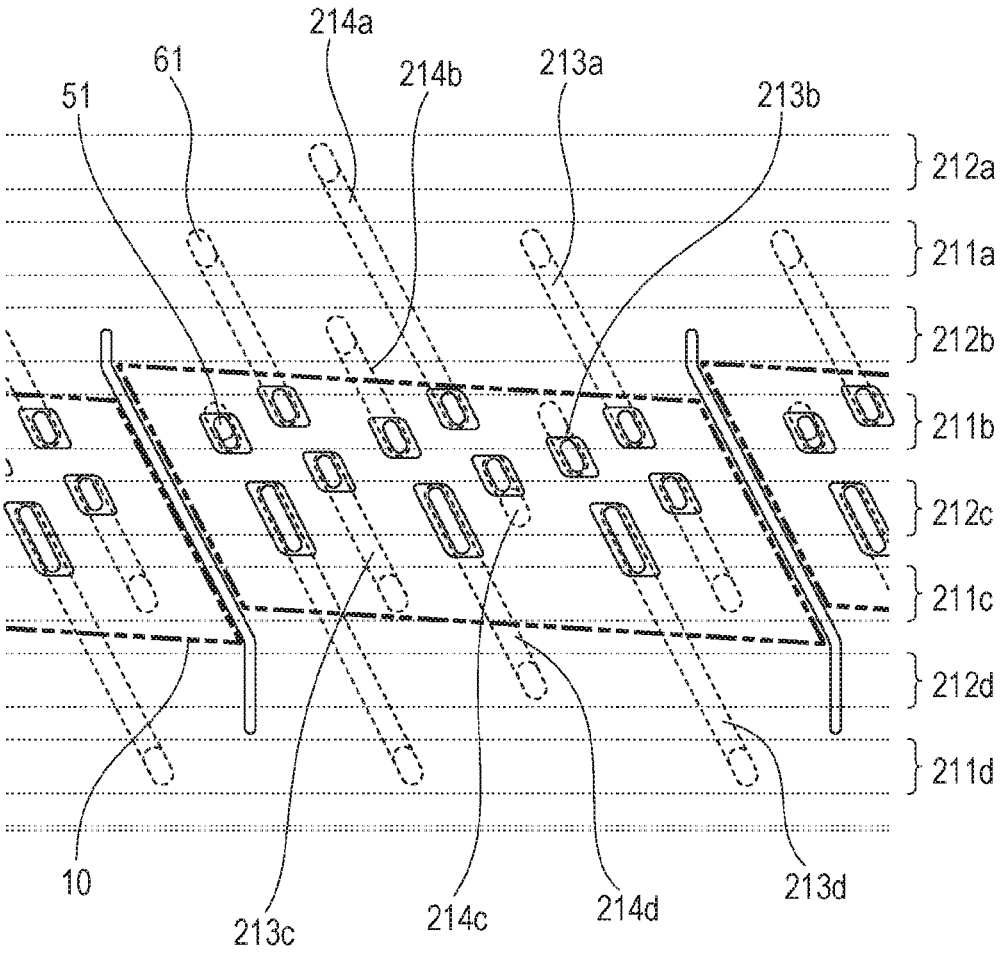
FIG. 34 is a diagram illustrating a schematic configuration of a modification of the liquid discharge head according to the first application example.

FIG. 34 illustrates the laminated states of the channel members 50, 60, and 70. Multiple recording element boards 10 are arrayed in a straight line on the upper face of the first channel member 50 that is the highest layer of the multiple channel members 50, 60, and 70. There are two individual supply channels 213 and one individual recovery channel 214 for each liquid color, as channels communicating with the openings 21 (FIG. 19) formed on the rear side of each recording element board 10. Corresponding to this, there also are two supply openings 21 and one recovery opening 21 for each liquid color, with regard to the openings 21 formed on the cover 20 provided to the rear face of the recording element boards 10. The common supply channels 211 and common recovery channels 212 extending in the longitudinal direction of the liquid discharge head 3 are arrayed alternatingly, as illustrated in FIG. 34.

Second Application Example

The configuration of an inkjet recording apparatus 1000 and liquid discharge head 3 according to a second application example will be described. Note that portions that differ from the first application example will primarily be described, and portions that are the same as the first application example will be omitted from description.

Description of Inkjet Recording Apparatus

Figure 13:
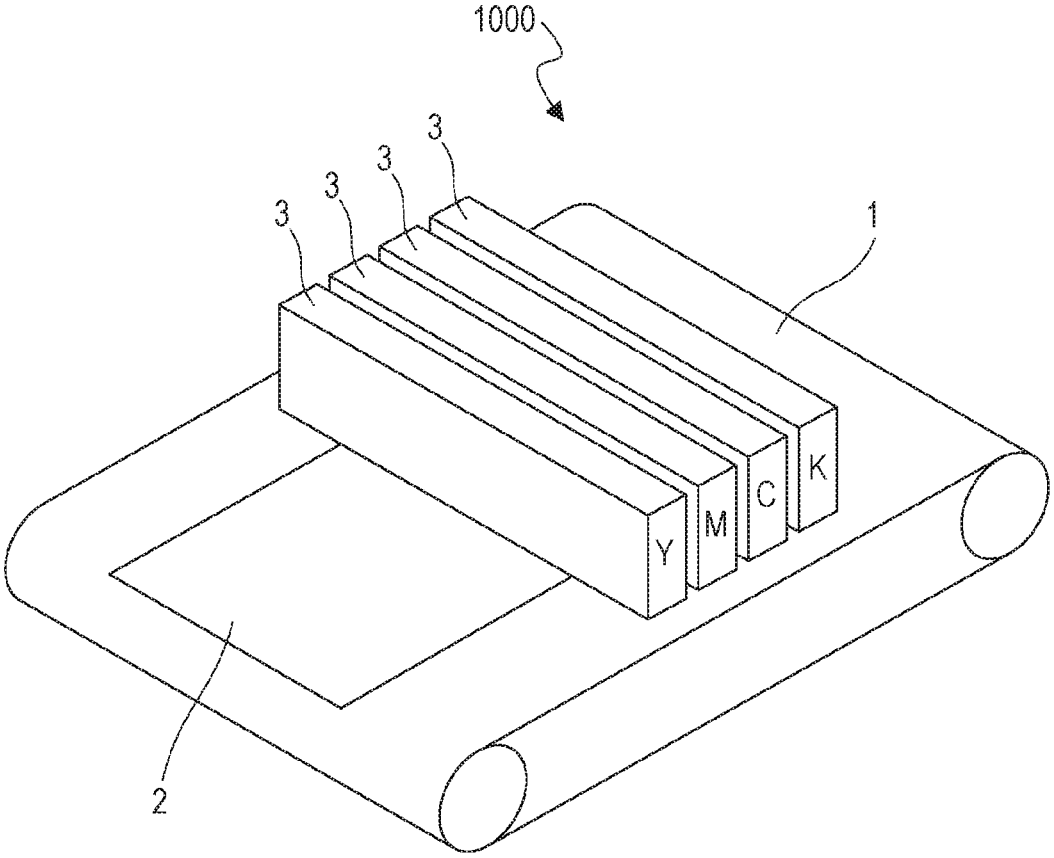
FIG. 13 is a diagram illustrating the configuration of the recording apparatus according to a second application example.
Figure 20A:
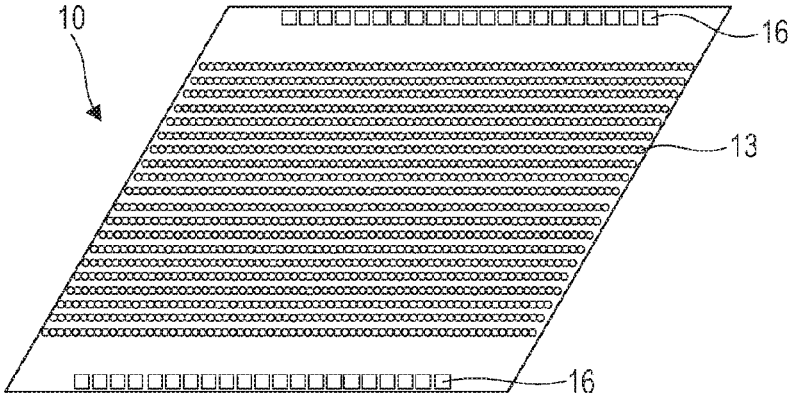
FIGS. 20A through 20C are diagrams illustrating the configuration of the recording element board.

FIG. 13 illustrates an inkjet recording apparatus according to the second application example. The recording apparatus 1000 according to the second application example differs from the first application example with regard to the point that full-color recording is performed on the recording medium by arraying four monochrome liquid discharge heads 3, each corresponding to one of CMYK ink. Although the number of discharge orifice rows usable per color in the first application example was one row, the number of discharge orifice rows usable per color in the second application example is 20 rows (FIG. 20A). This enables extremely high-speed recording to be performed, by allocating recording data to multiple discharge orifice rows. Even if there are discharge orifices that exhibit ink non-discharge, reliability is improved by a discharge orifice at a corresponding position in the conveyance direction of the recording medium in another row performing discharge in a complementary manner, and accordingly the arrangement is suitable for industrial printing. The supply system of the recording apparatus 1000, the buffer tank 1003, and the main tank 1006 (FIG. 2) are connected to the liquid discharge heads 3 by fluid connection, in the same way as in the first application example. Each liquid discharge head 3 is also electrically connected to an electric control unit that transmits electric power and discharge control signals to the liquid discharge head 3.

Description of Circulation Paths

The first and second circulation paths illustrated in FIGS. 2 and 3 can be used as the liquid circulation paths between the recording apparatus 1000 and the liquid discharge heads 3, in the same way as in the first application example.

Description of Structure of Liquid Discharge Head

Figure 14A:
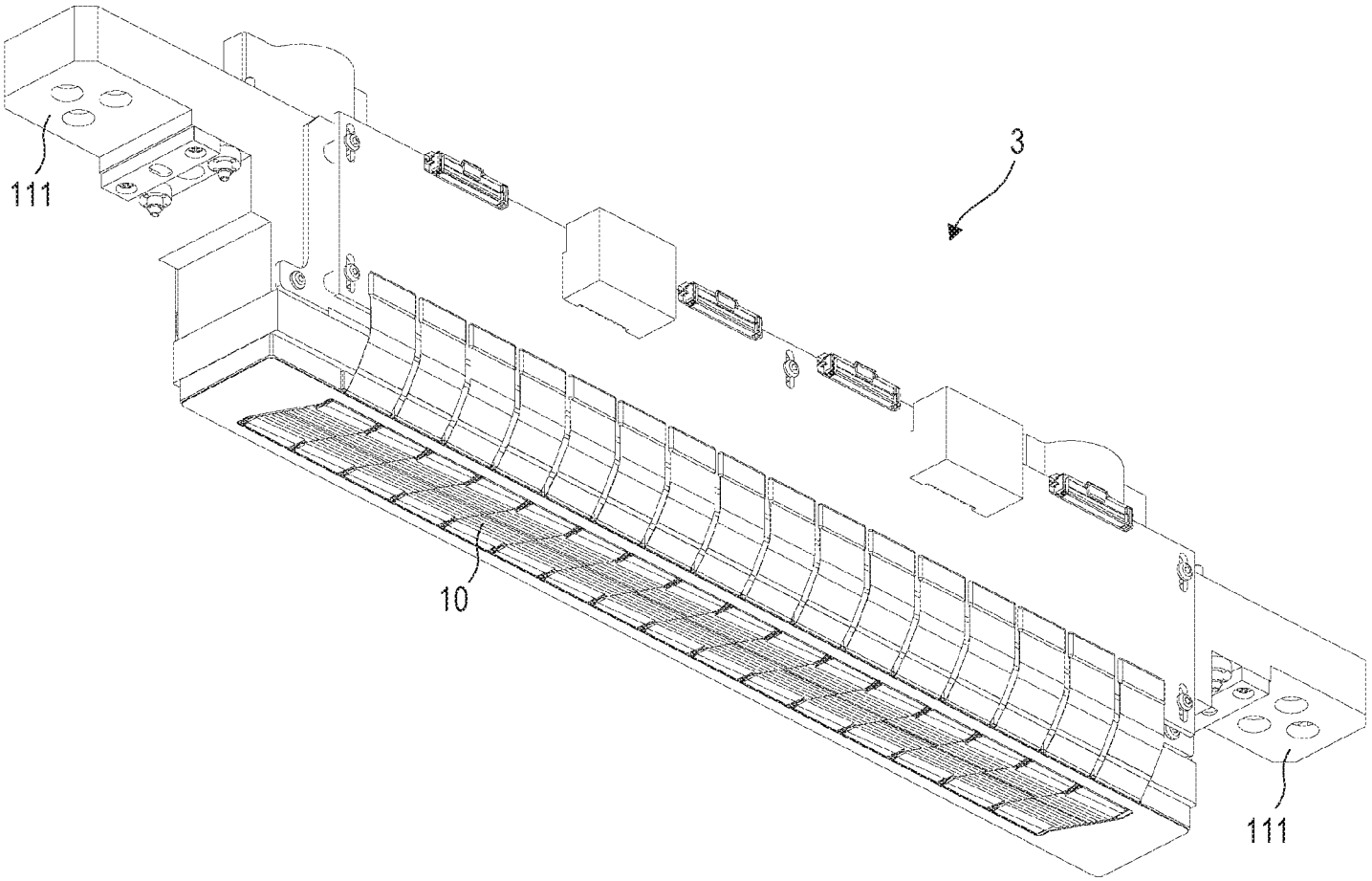
FIGS. 14A and 14B are perspective views of the liquid discharge head according to the second application example.
Figure 14B:
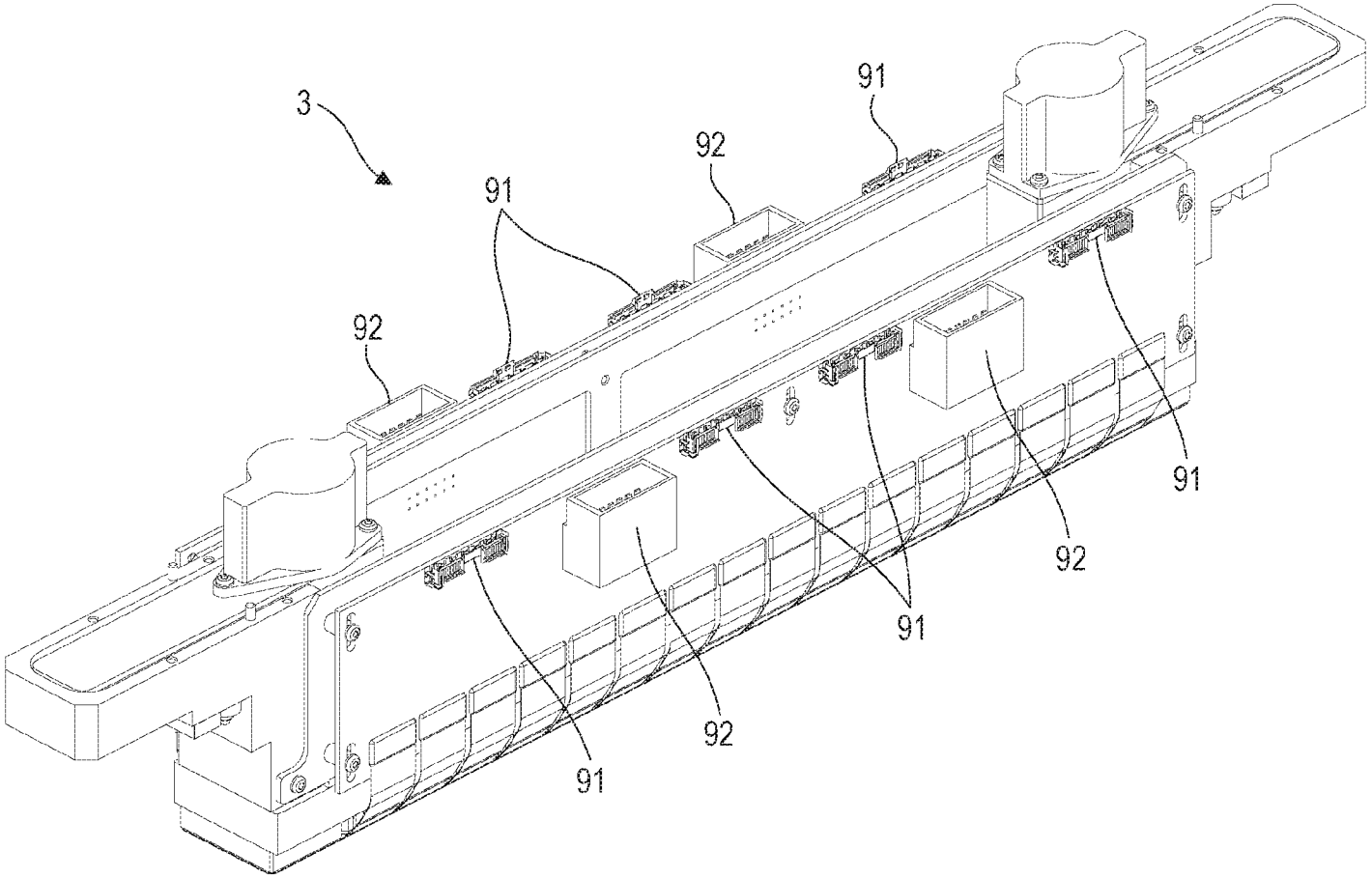

Description will be made regarding the structure of the liquid discharge head 3 according to the second application example. FIGS. 14A and 14B are perspective diagrams of the liquid discharge head 3 according to the present application example. The liquid discharge head 3 has 16 recording element boards 10 arrayed in a straight line in the longitudinal direction of the liquid discharge head 3, and is an inkjet line recording head that can record with ink of one color. The liquid discharge head 3 has the liquid connection portions 111, input terminals 91, and power supply terminals 92 in the same way as the first application example. The liquid discharge head 3 according to the application example differs from the first application example in that the input terminals 91 and power supply terminals 92 are disposed on both sides of the liquid discharge head 3, since the number of discharge orifice rows is greater. This is to reduce voltage drop and signal transmission delay that occurs at wiring portions provided to the recording element boards 10.

Figure 15:
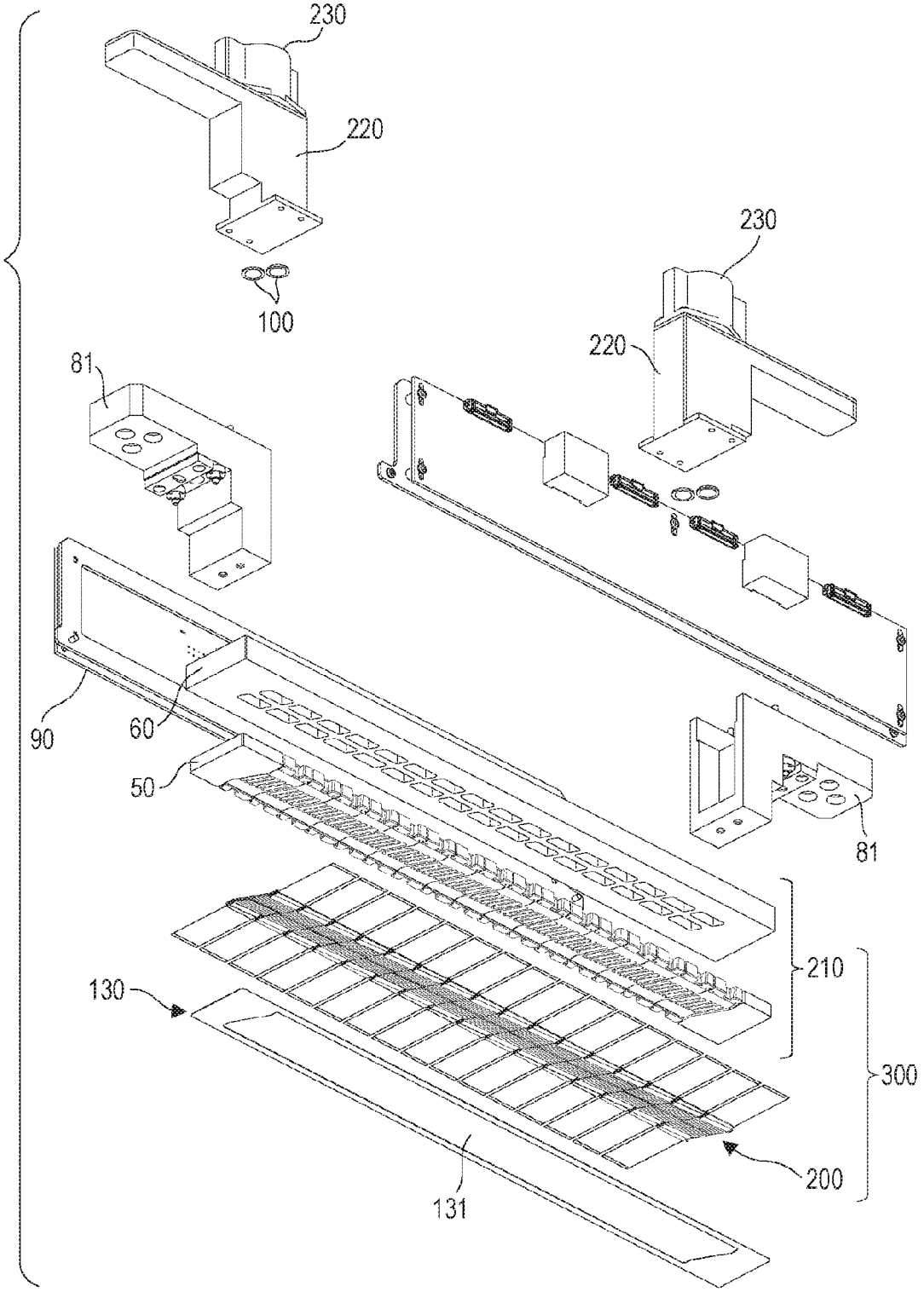
FIG. 15 is a disassembled perspective view of the liquid discharge head in FIG. 14.

FIGS. 14A and 14B are perspective views of the liquid discharge head 3, and FIG. 15 is a disassembled perspective view thereof, illustrating each part or unit making up the liquid discharge head 3 disassembled according to function. The roles of the units and members, and the order of liquid flow through the liquid discharge head, are basically the same as in the first application example, but the function by which the rigidity of the liquid discharge head is guaranteed is different. The rigidity of the liquid discharge head was primarily guaranteed in the first application example by the liquid discharge unit support member 81, but the rigidity of the liquid discharge head is guaranteed in the second application example by the second channel member 60 included in the liquid discharge unit 300. There are liquid discharge unit support members 81 connected to both ends of the second channel member 60 in the present application example. This liquid discharge unit 300 is mechanically enjoined to a carriage of the recording apparatus 1000, whereby the liquid discharge head 3 is positioned. Liquid supply units 220 having negative pressure control units 230, and the electric wiring board 90, are joined to the liquid discharge unit support members 81. Filters (omitted from illustration) are built into the two liquid supply units 220. The two negative pressure control units 230 are set to control pressure by high and low negative pressure that relatively differ from each other. When the high-pressure side and low-pressure side negative pressure control units 230 are disposed on the ends of the liquid discharge head 3 as illustrated in FIGS. 14A through 15, the flow of ink on the common supply channel 211 and the common recovery channel 212 that extend in the longitudinal direction of the liquid discharge head 3 are mutually opposite. This promotes heat exchange between the common supply channel 211 and common recovery channel 212, so that the temperature difference between the two common channels can be reduced. This is advantageous in that temperature difference does not readily occur among the multiple recording element boards 10 disposed along the common channels, and accordingly unevenness in recording due to temperature difference does not readily occur.

The channel member 210 of the liquid discharge unit 300 will be described in detail next. The channel member 210 is the first channel member 50 and second channel member 60 that have been laminated as illustrated in FIG. 15, and distributes ink supplied from the liquid supply unit 220 to the discharge modules 200. The channel member 210 also serves as a channel member for returning ink recirculating from the discharge modules 200 to the liquid supply unit 220. The second channel member 60 of the channel member 210 is a channel member in which the common supply channel 211 and common recovery channel 212 have been formed, and also primary undertakes the rigidity of the liquid discharge head 3. Accordingly, the material of the second channel member 60 preferably is sufficiently corrosion-resistant as to the ink and has high mechanical strength. Examples of suitably-used materials include stainless steel, titanium (Ti), alumina, or the like.

Figure 16A:
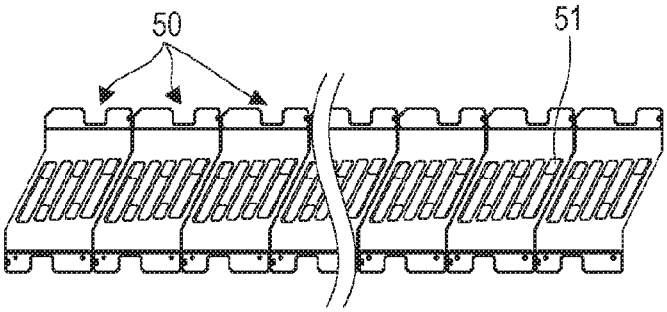
FIGS. 16A through 16E are diagrams illustrating the configuration of first and second flow channel members making up the channel member that the liquid discharge head in FIG. 14 has.
Figure 16B:
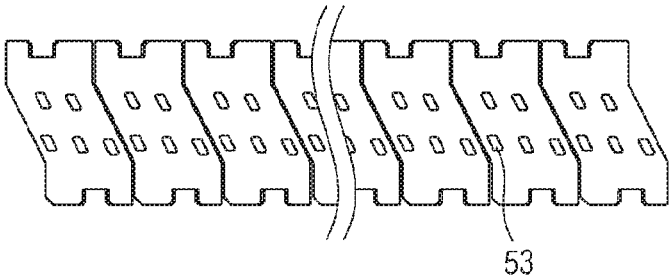
Figure 16C:
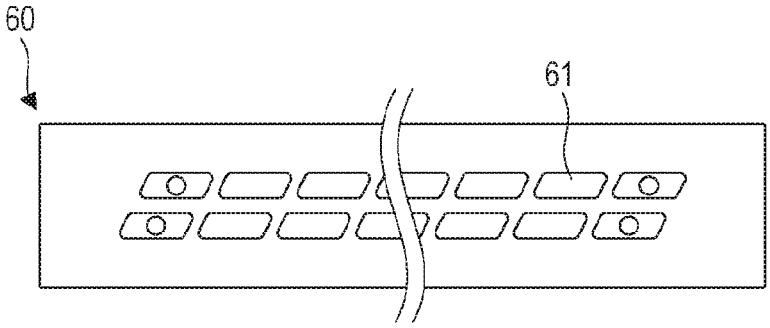
Figure 16D:
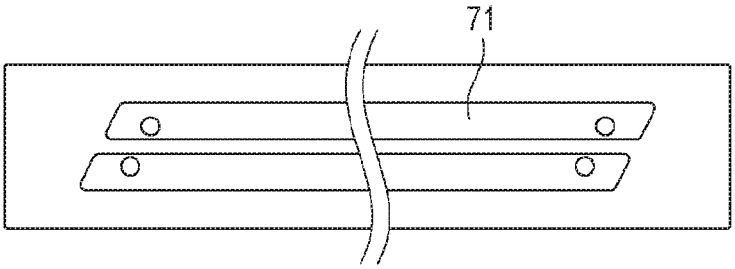
Figure 16E:
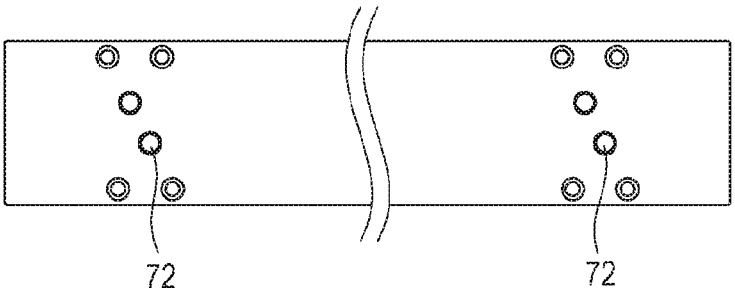

FIG. 16A illustrates the face of the first channel member 50 on the side where the discharge modules 200 are mounted, and FIG. 16B is a diagram illustrating the reverse face therefrom, that comes into contact with the second channel member 60. Unlike the case in the first application example, the first channel member 50 according to the second application example is an arrangement where multiple members corresponding to the discharge modules 200 are arrayed adjacently. Using this divided structure enables a length corresponding to the length of the liquid discharge head to be realized, and accordingly can particularly be suitably used in relatively long-scale liquid discharge heads corresponding to sheets of B2 size and even larger, for example. The communication ports 51 of the first channel member 50 communicate with the discharge modules 200 by fluid connection as illustrated in FIG. 16A, and individual communication ports 53 of the first channel member 50 communicate with the communication ports 61 of the second channel member 60 by fluid connection as illustrated in FIG. 16B. FIG. 16C illustrates the face of the second channel member 60 that comes in contact with the first channel member 50, FIG. 16D illustrates a cross-section of the middle portion of the second channel member 60 taken in the thickness direction, and FIG. 16E is a diagram illustrating the face of the second channel member 60 that comes into contact with the liquid supply unit 220. The functions of the channels and communication ports of the second channel member 60 are the same as in with one color worth in the first application example. One of the common channel grooves 71 of the second channel member 60 is the common supply channel 211 illustrated in FIG. 17, and the other is the common recovery channel 212. Both have ink supplied from one end side toward the other end side following the longitudinal direction of the liquid discharge head 3. Unlike the case in the first application example, the longitudinal directions of ink for the common supply channel 211 and common recovery channel 212 are mutually opposite directions.

Figure 17:
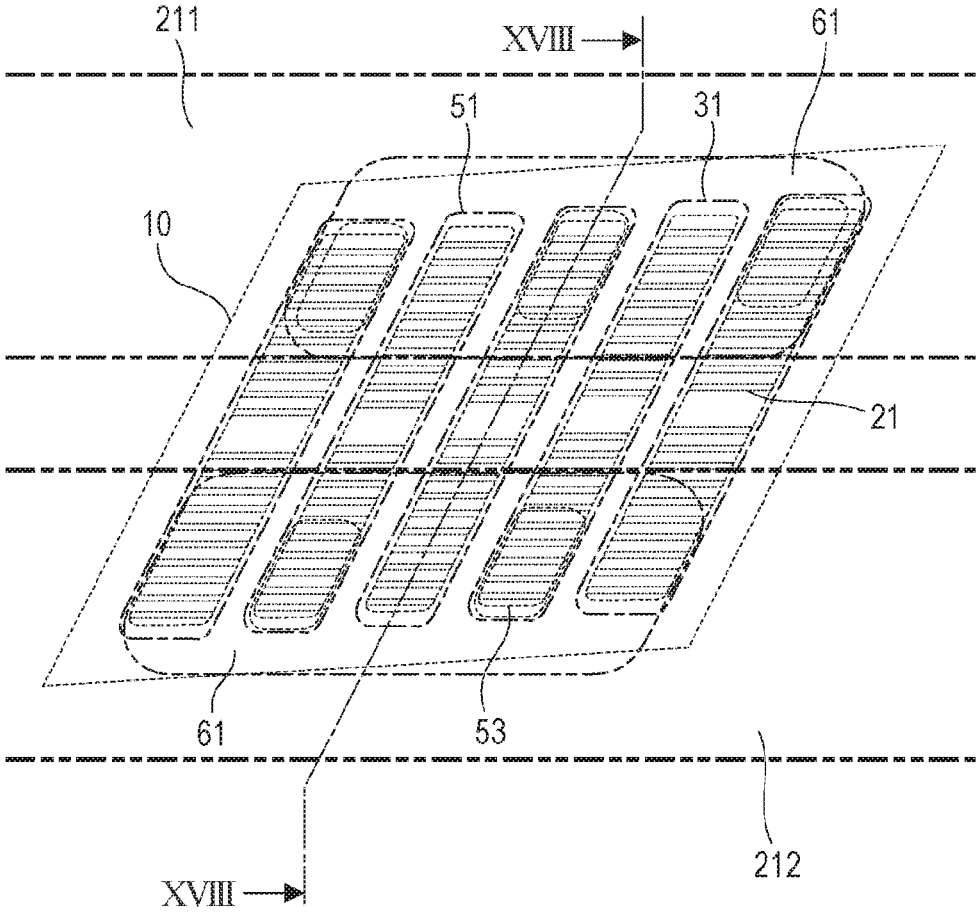
FIG. 17 is a diagram for describing connection relationships of liquid in the recording element board and channel member.

FIG. 17 is a transparent view illustrating the connection relationship regarding ink between the recording element boards 10 and the channel member 210. The set of the common supply channel 211 and common recovery channel 212 extending in the longitudinal direction of the liquid discharge head 3 is provided within the channel member 210, as illustrated in FIG. 17. The communication ports 61 of the second channel member 60 are each positioned with and connected to the individual communication ports 53 of the first channel member 50, thereby forming a liquid supply path from the communication ports 72 of the second channel member 60 to the communication ports 51 of the first channel member 50 via the common supply channel 211. In the same way, a liquid supply path from the communication ports 72 of the second channel member 60 to the communication ports 51 of the first channel member 50 via the common recovery channel 212 is also formed.

Figure 18:
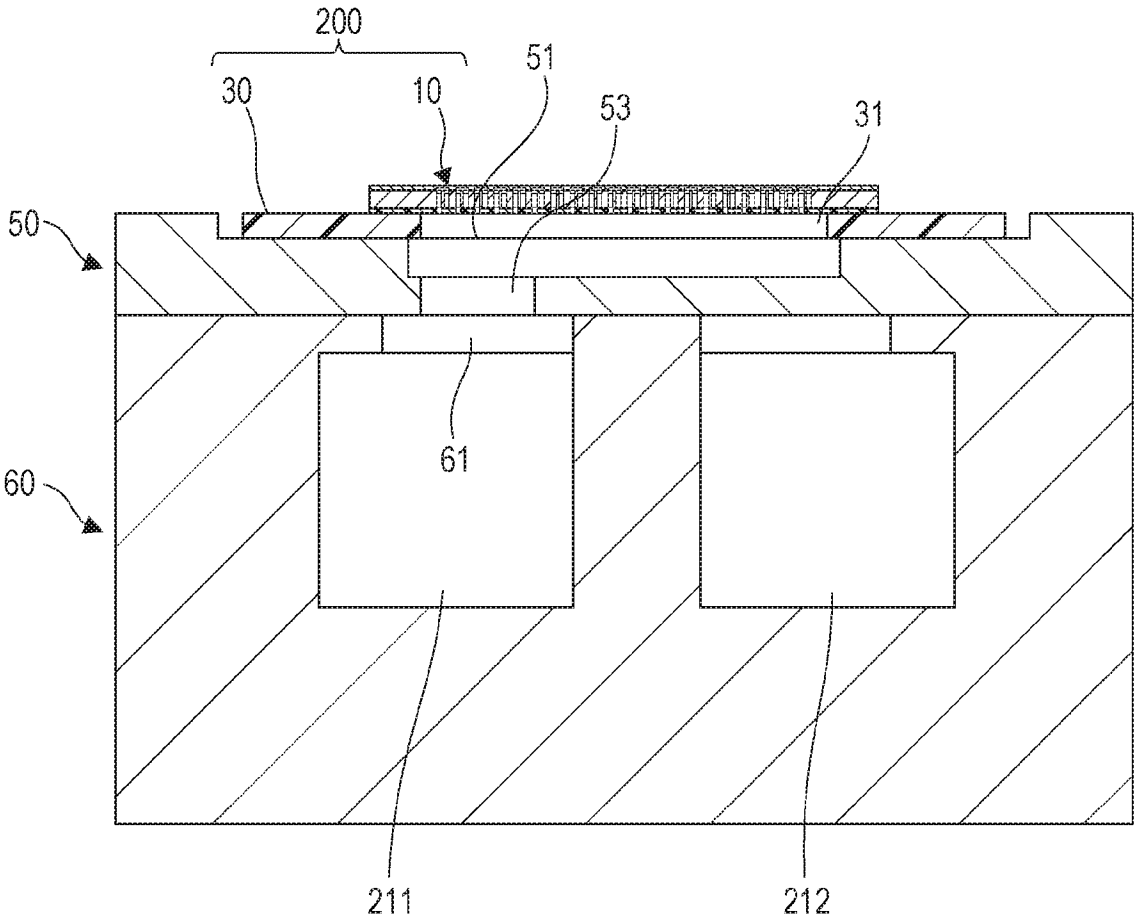
FIG. 18 is a cross-sectional view taken along line XVIII-XVIII in FIG. 17.

FIG. 18 is a diagram illustrating a cross-section taken along XVIII-XVIII in FIG. 17. FIG. 18 shows how the common supply channel 211 connects to the discharge module 200 through the communication port 61, individual communication port 53, and communication port 51. Although omitted from illustration in FIG. 18, it can be clearly seen from FIG. 17 that another cross-section would show an individual recovery channel 214 connected to the discharge module 200 through a similar path. Channels are formed on the discharge modules 200 and recording element boards 10 to communicate with the discharge orifices 13, and part or all of the supplied ink recirculates through the discharge orifices 13 (pressure chambers 23) that are not performing discharging operations, in the same way as in the first application example. The common supply channel 211 is connected to the negative pressure control unit 230 (high-pressure side), and the common recovery channel 212 to the negative pressure control unit 230 (low-pressure side), via the liquid supply unit 220, in the same way as in the first application example. Accordingly, a flow is generated by the differential pressure thereof, that flows from the common supply channel 211 through the discharge orifices 13 (pressure chambers 23) of the recording element board 10 to the common recovery channel 212.

Description of Discharge Module

Figure 19A:
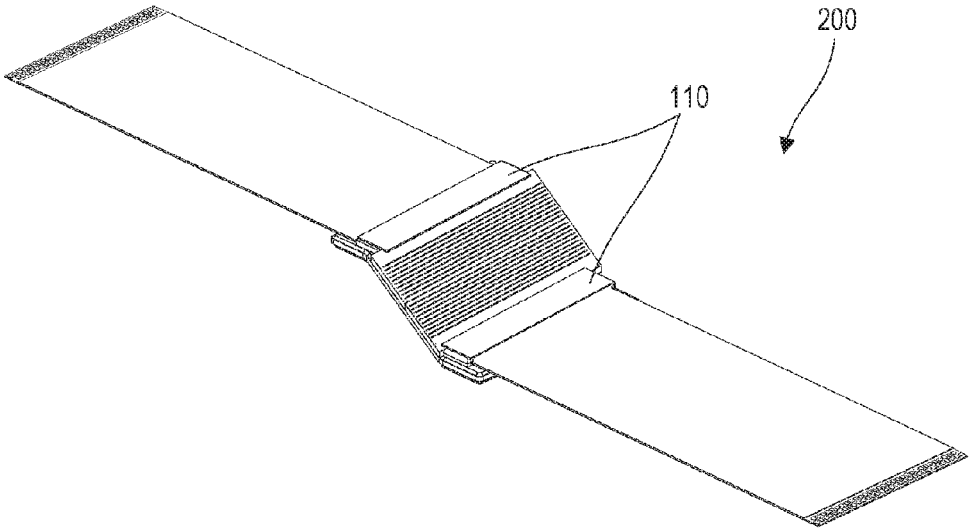
FIGS. 19A and 19B are diagrams illustrating a discharge module, FIG. 19A being a perspective view and FIG. 19B a disassembled view.
Figure 19B:
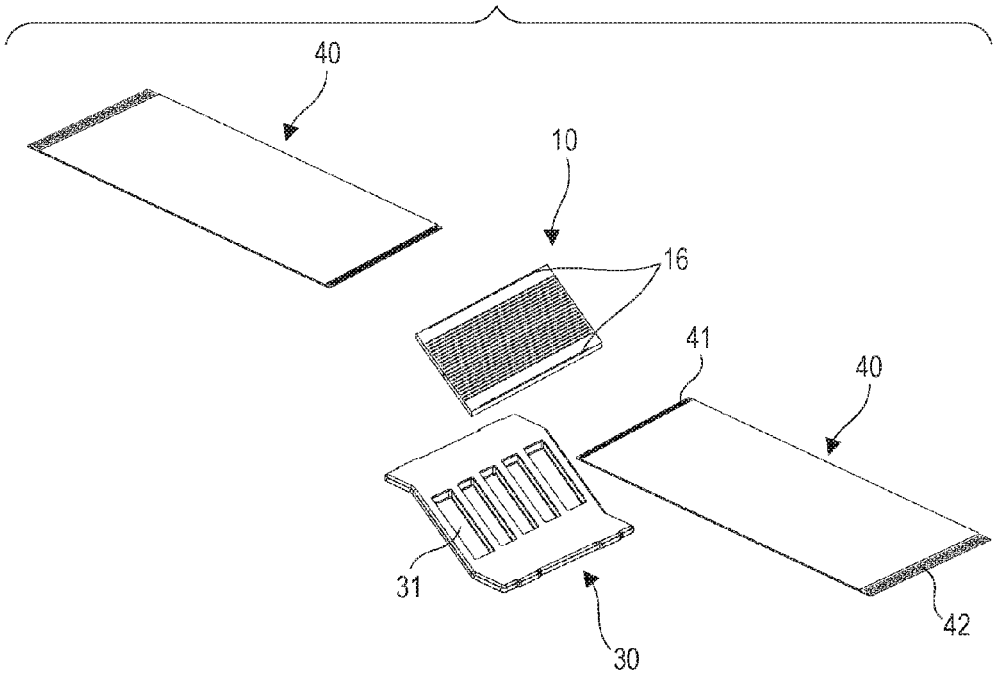

FIG. 19A is a perspective view of one discharge module 200, and FIG. 19B is a disassembled view thereof. The difference as to the first application example is the point that multiple terminals 16 are disposed arrayed on both sides (the long side portions of the recording element board 10) following the direction of the multiple discharge orifice rows of the recording element board 10. Another point is that two flexible printed circuit boards 40 are provided to one recording element board 10 and are electrically connected to the terminals 16. The reason is that the number of discharge orifice rows provided on the recording element board 10 is 20 rows, which is a great increase over the eight rows in the first application example. The object thereof is to keep the maximum distance from the terminals 16 to the recording elements 15 provided corresponding to the discharge orifice row short, hereby reducing voltage drop and signal transmission delay that occurs at wiring portions provided to the recording element board 10. Liquid communication ports 31 of the support member 30 are provided to the recording element board 10, and are opened so as to span all discharge orifice rows. Other points are the same as in the first application example.

Description of Structure of Recording Element Board

Figure 20B:
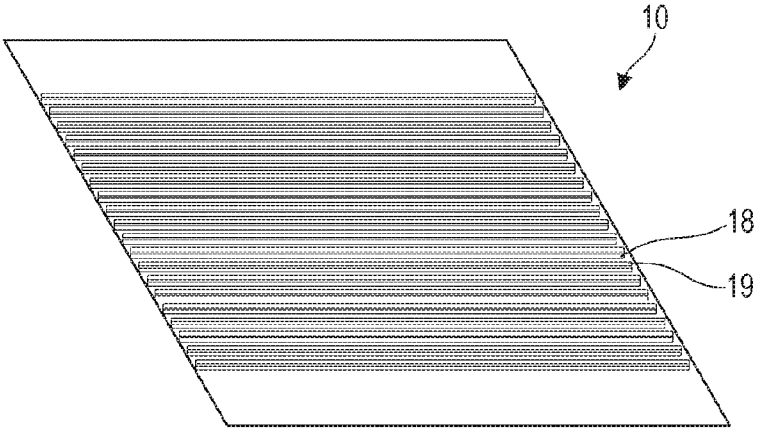
Figure 20C:
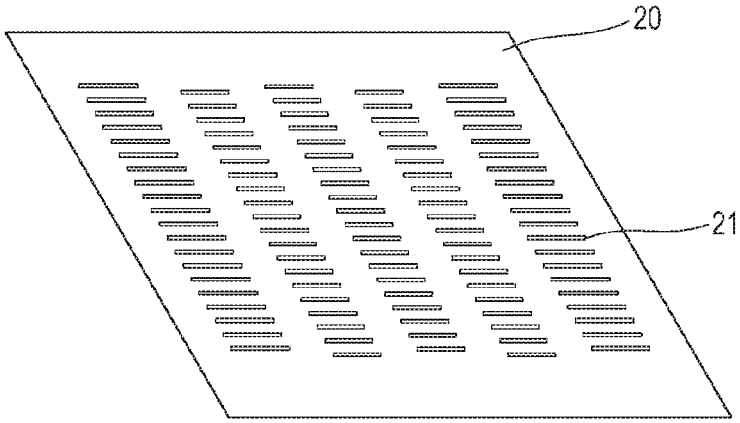

FIG. 20A is a schematic diagram illustrating the face of the recording element board 10 on the side where the discharge orifices 13 are disposed, and FIG. 20C is a schematic diagram illustrating the reverse face of that illustrated in FIG. 20A. FIG. 20B is a schematic diagram illustrating the face of the recording element board 10 in a case where the cover 20 provided on the rear face side of the recording element board 10 is removed in FIG. 20C. Liquid supply channels 18 and liquid recovery channels 19 are alternately provided on the rear face of the recording element board 10 following the discharge orifice row direction, as illustrated in FIG. 20B. Despite the number of discharge orifice rows being much greater than that in the first application example, a substantial difference from the first application example is that the terminals 16 are disposed on both side portions of the recording element board 10 following the discharge orifice row direction, as described above. The basic configuration is the same as that in the first application example, such as one set of a liquid supply channel 18 and liquid recovery channel 19 being provided for each discharge orifice row, openings 21 that communicate with the liquid communication ports 31 of the support member 30 being provided to the cover 20, and so forth.

Third Application Example

The configuration of an inkjet recording apparatus 1000 and liquid discharge head 3 according to a third application example will be described. The liquid discharge head 3 according to the third application example is a page-wide head that records a B2 size recording medium sheet with a single scan. The third application example is similar to the second application example with regard to many points, so points of difference as to the second application example will primarily be described below, and portions that are the same as the second application example will be omitted from description.

Description of Inkjet Recording Apparatus

Figure 35:
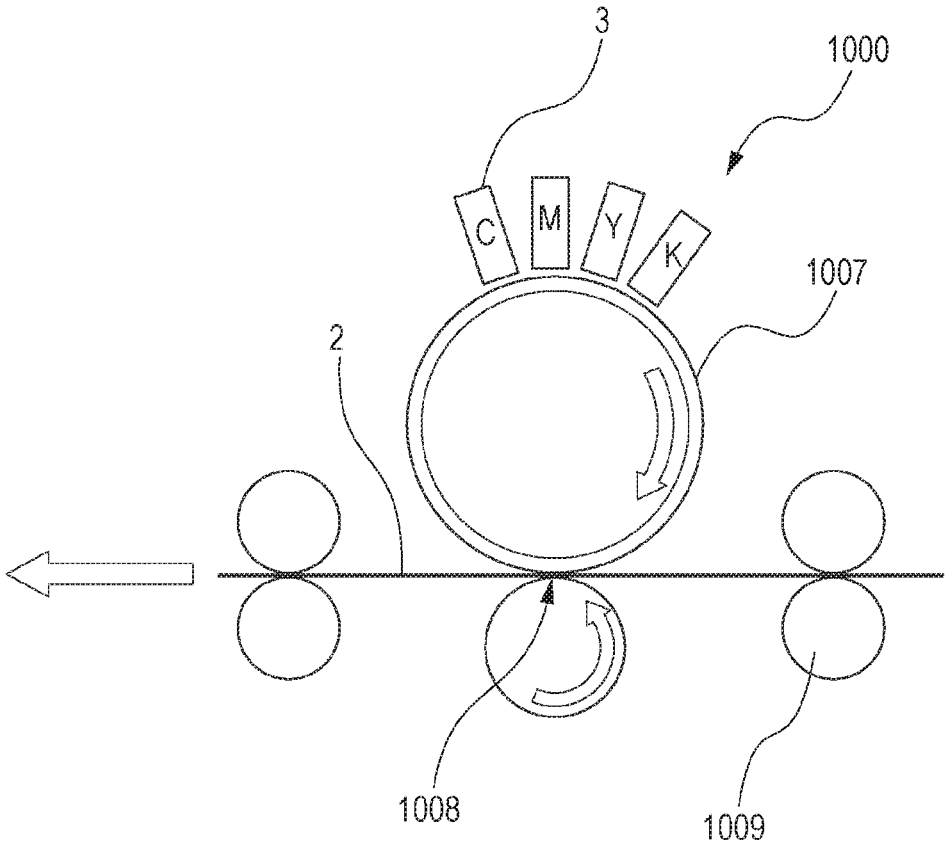
FIG. 35 is a diagram illustrating the schematic configuration of the recording apparatus according to a third application example.

FIG. 35 is a schematic diagram of an inkjet recording apparatus according to the present application example. The recording apparatus 1000 is of a configuration that does not directly record on the recording medium from the liquid discharge head 3, but rather discharges liquid on an intermediate transfer member (intermediate transfer drum 1007) and forms an image, following which the image is transferred onto the recording medium 2. The recording apparatus 1000 has four monochrome liquid discharge heads 3 corresponding to the four types of ink of CMYK, disposed in an arc following the intermediate transfer drum 1007. Thus, full-color recording is performed on the intermediate transfer member, the recorded image is dried to a suitable state on the intermediate transfer member, and then transferred by a transfer unit 1008 onto the recording medium 2 conveyed by a sheet conveyance roller 1009. Whereas the sheet conveyance system in the second application example was horizontal conveyance with the intent of primarily conveying cut sheets, the present application example is capable of handling continuous sheets supplied from a main roll (omitted from illustration). This sort of drum conveyance system can easily convey sheets with a certain tension applied, so there is less conveyance jamming when performing high-speed recording. Thus, the reliability of the apparatus improves, and is suitable for application to business printing and the like. The supply system of the recording apparatus 1000, the buffer tank 1003, and the main tank 1006 are connected to the liquid discharge heads 3 by fluid connection, in the same way as in the first and second application examples. Each liquid discharge head 3 is also electrically connected to an electric control unit that transmits electric power and discharge control signals to the liquid discharge head 3.

Description of Fourth Circulation Path

Figure 36:
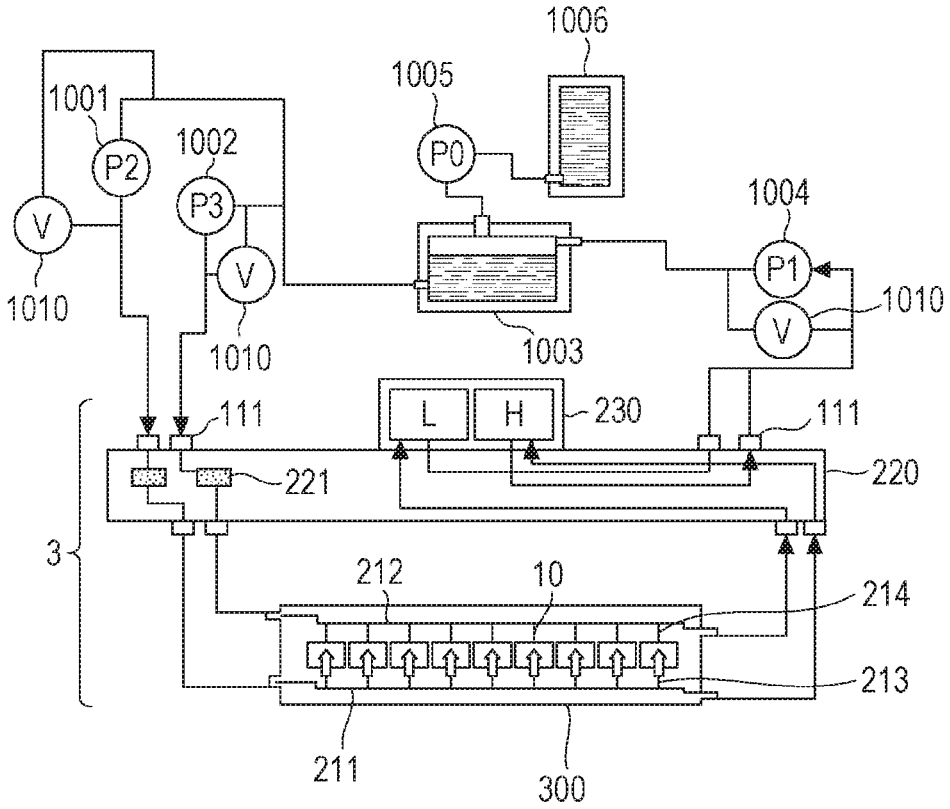
FIG. 36 is a diagram illustrating a fourth circulation path.

Although the first and second circulation paths illustrated in FIGS. 2 and 3 between the tanks of the recording apparatus 1000 and the liquid discharge head 3 are applicable as liquid circulation paths in the same way as in the second application example, a circulation path illustrated in FIG. 36 is suitable. A primary difference as to the second circulation path in FIG. 3 is that bypass valves 1010 are added that communicate with channels of each of the first circulation pumps 1001 and 1002 and the second circulation pump 1004. The bypass valves 1010 function to lower pressure at the upstream side of the bypass valve 1010 (first function), due to the valve opening when pressure exceeds a preset pressure. The bypass valves 1010 also function to open and close valves at a predetermined timing by signals from a control board at the recording apparatus main unit (second function).

According to the first function, excessively large or excessively small pressure can be kept from being applied to the channel at the downstream side of the first circulation pumps 1001 and 1002 and the upstream side of the second circulation pump 1004. For example, in a case where the functions of the first circulation pumps 1001 and 1002 malfunction, excessive flow rate or pressure may be applied to the liquid discharge head 3. This may cause liquid to leak from the discharge orifices 13 of the liquid discharge head 3, or joined portions within the liquid discharge head 3 to be damaged. However, in a case where bypass vales are added to the first circulation pumps 1001 and 1002 as in the present application example, opening the bypass valves 1010 releases the liquid path to the upstream side of the circulation pumps, so trouble such as that described above can be suppressed, even if excessive pressure occurs.

Also, due to the second function, when stopping circulation operations, all bypass valves 1010 are quickly opened after the first circulation pumps 1001 and 1002 and second circulation pump 1004 stop, based on control signals from the main unit side. This allows the high negative pressure (e.g., several kPa to several tens of kPa) at the downstream portion of the liquid discharge head 3 (between the negative pressure control unit 230 and the second circulation pump 1004) to be released in a short time. In a case of using a positive-displacement pump such as a diaphragm pump as the circulation pump, a check valve usually is built into the pump. However, opening the bypass valves 1010 enables pressure release at the downstream side of the liquid discharge head 3 to be performed from the downstream buffer tank 1003 side as well. Although pressure release of the downstream side of the liquid discharge head 3 can be performed just from the upstream side as well, there is pressure drop in the channels at the upstream side of the liquid discharge head 3 and the channels within the liquid discharge head 3. Accordingly, there is the concern that pressure discharge may take time, the pressure within the common channel within the liquid discharge head 3 may temporarily drop too far, and the meniscus at the discharge orifices may be destroyed. Opening the bypass valves 1010 at the downstream side of the liquid discharge head 3 promotes pressure discharge at the downstream side of the liquid discharge head 3, so the risk of destruction of the meniscus at the discharge orifices is reduced.

Description of Structure of Liquid Discharge Head

Figure 37A:
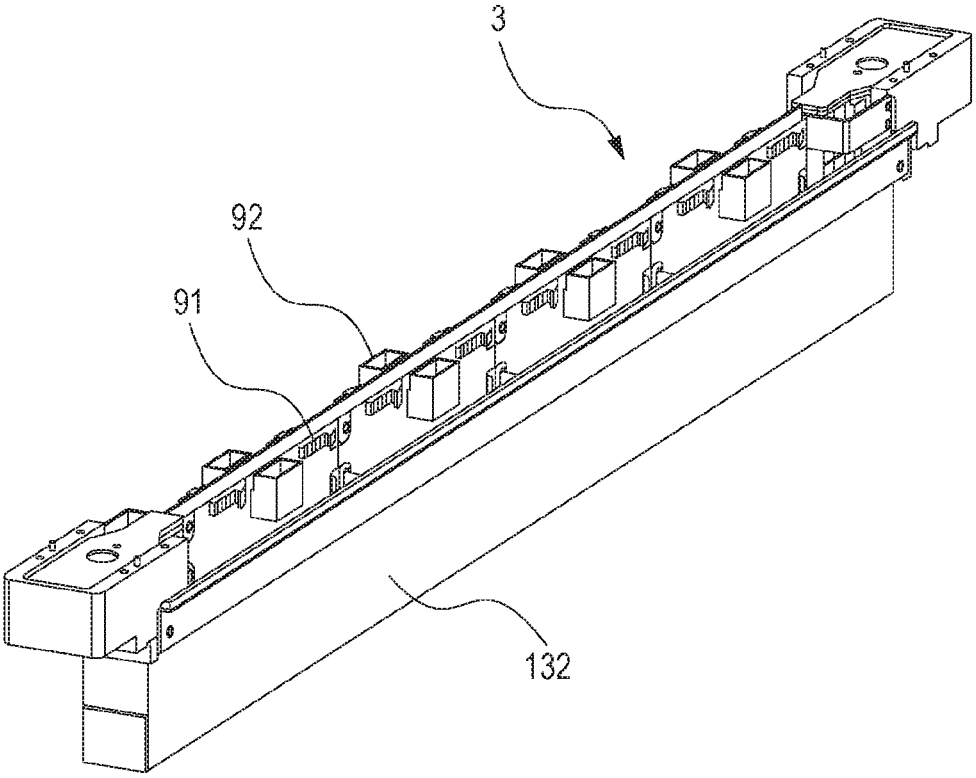
FIGS. 37A and 37B are diagrams illustrating the liquid discharge head according to the third application example.
Figure 37B:
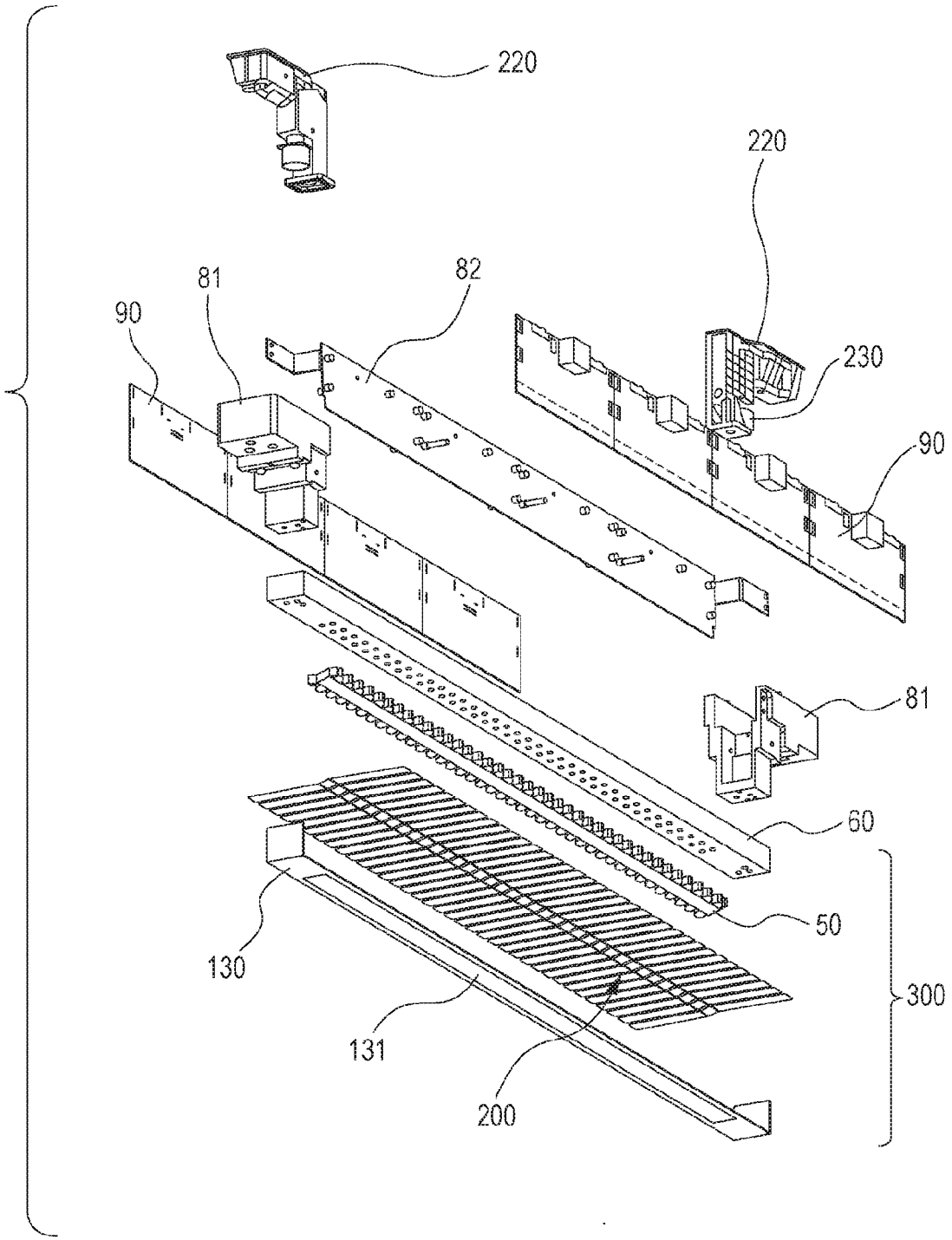

The structure of the liquid discharge head 3 according to the third application example will be described. FIG. 37A is a perspective view of the liquid discharge head 3 according to the present application example, and FIG. 37B is a disassembled perspective view thereof. The liquid discharge head 3 has 36 recording element boards 10 arrayed in a straight line (inline) in the longitudinal direction of the liquid discharge head 3, and is a line type (page-wide) inkjet recording head that records using a single-color liquid. The liquid discharge head 3 has the signal input terminals 91 and power supply terminals 92 in the same way as in the second application example, and also is provided with a shield plate 132 to protect the longitudinal side face of the head.

FIG. 37B is a disassembled perspective view of the liquid discharge head 3, illustrating each part or unit making up the liquid discharge head 3 disassembled according to function (the shield plate 132 is omitted from illustration). The roles of the units and members, and the order of liquid flow through the liquid discharge head 3, are basically the same as in the second application example. The third application example differs from the second application example primarily with regard to the points of the electric wiring board 90 being divided into a plurality and disposed, the position of the negative pressure control units 230, and the shape of the first channel member 50. In the case of a liquid discharge head 3 having a length corresponding to a B2 size recording medium for example, as in the case of the present application example, eight electric wiring boards 90 are provided since the amount of electric power the liquid discharge head 3 uses is great. Four each of the electric wiring boards 90 are attached to both sides of the slender electric wiring board support member 82 attached to the liquid discharge unit support member 81.

Figure 38A:
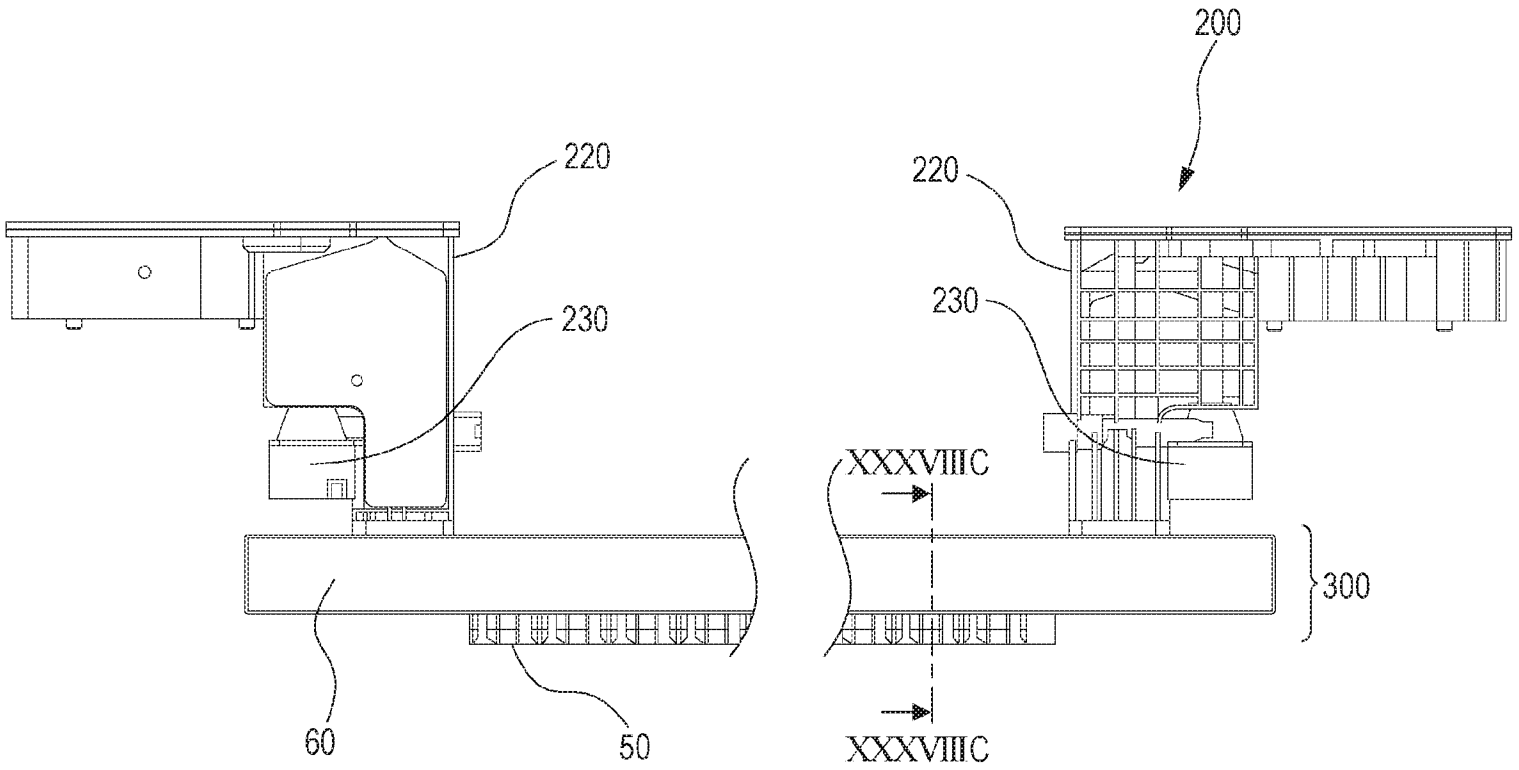
FIGS. 38A through 38C are diagrams illustrating the liquid discharge head according to the third application example.
Figure 38B:
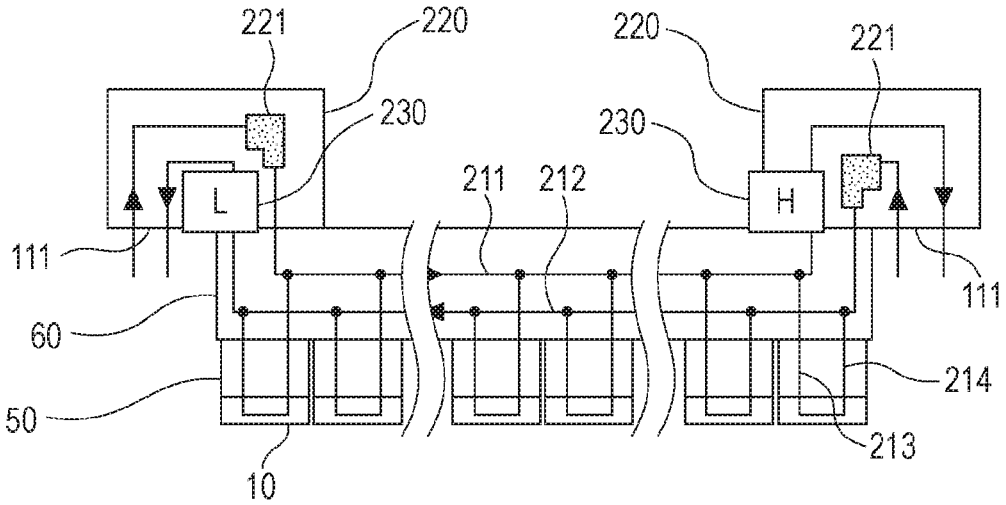
Figure 38C:
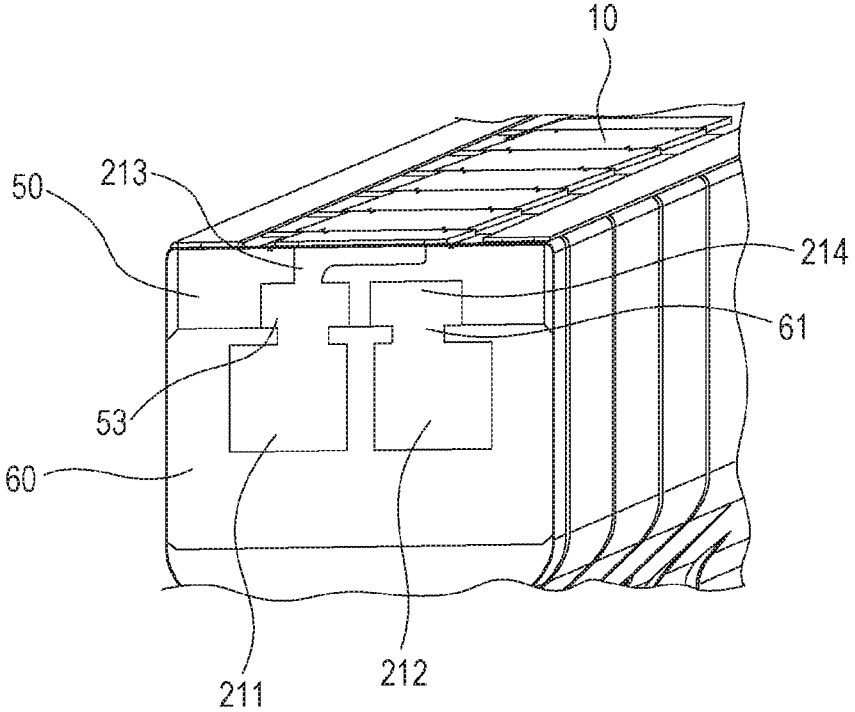

FIG. 38A is a side view of the liquid discharge head 3 that has the liquid discharge unit 300, liquid supply units 220, and negative pressure control units 230, FIG. 38B is a schematic diagram illustrating the flow of liquid, and FIG. 38C is a perspective view illustrating a cross-section taken along line XXXVIIIC-XXXVIIIC in FIG. 38A. Parts of the configuration have been simplified to facilitate understanding.

The liquid connection portions 111 and filters 221 are provided within the liquid supply units 220, with the negative pressure control units 230 being integrally formed beneath the liquid supply units 220. This enables the distance in the height direction between the negative pressure control units 230 and the recording element boards 10 to be reduced as compared to the second application example. This configuration reduces the number of channel connection portions within the liquid supply units 220, and is advantageous not only regarding improved reliability regarding leakage of recording liquid, but also in that the number of parts and assembly processes can be reduced.

Also, the water head difference between the negative pressure control units 230 and the face where the discharge orifices are formed is relatively smaller, and accordingly can be suitably applied to a recording apparatus where the inclination angle of the liquid discharge head 3 differs for each liquid discharge head 3, such as illustrated in FIG. 35. The reason is that the reduced water head difference enables the negative pressure difference applied to the discharge orifices of the respective recording element boards 10 can be reduced even if each of the multiple liquid discharge heads 3 is used at a different inclination angle. Reducing the distance from the negative pressure control units 230 to the recording element boards 10 also reduces the pressure drop difference due to fluctuation in flow of the liquid, since the flow resistance is reduced, and is preferable from the point that more stable negative pressure control can be performed.

FIG. 38B is a schematic diagram illustrating the flow of the recording liquid within the liquid discharge head 3. The circuitry is the same as the circulation path illustrated in FIG. 36, but FIG. 38B illustrates the flow of liquid at each component within the actual liquid discharge head 3. A set of the common supply channel 211 and common recovery channel 212 is provided within the slender second channel member 60, extending in the longitudinal direction of the liquid discharge head 3. The common supply channel 211 and common recovery channel 212 are configured so that the liquid flows in mutually opposite directions, with filters 221 disposed at the upstream side of these channels to trap foreign substances intruding from the connection portions 111 or the like. This arrangement where the liquid flows in mutually opposite directions in the common supply channel 211 and common recovery channel 212 is preferable from the point that the temperature gradient in the longitudinal direction within the liquid discharge head 3 is reduced. The flow direction of the common supply channel 211 and common recovery channel 212 is shown as being in the same direction in FIG. 36 to simplify explanation.

A negative pressure control unit 230 is disposed at the downstream side of each of the common supply channel 211 and common recovery channel 212. The common supply channel 211 has branching portions to multiple individual supply channels 213 along the way, and the common recovery channel 212 has branching portions to multiple individual recovery channels 214 along the way. The individual supply channels 213 and individual recovery channels 214 are formed within multiple first channel members 50. Each of the individual channels communicates with openings 21 (see FIG. 20C) of the cover 20 provided to the reverse face of the recording element boards 10.

The negative pressure control units 230 indicated by H and L in FIG. 38B are high-pressure side (H) and low-pressure side (L) units. The respective negative pressure control units 230 are back-pressure type pressure adjustment mechanisms, set to control the pressure upstream of the negative pressure control units 230 to relatively high (H) and low (L) negative pressures. The common supply channel 211 is connected to the negative pressure control unit 230 (high-pressure side), and the common recovery channel 212 is connected to the negative pressure control unit 230 (low-pressure side). This generates differential pressure between the common supply channel 211 and common recovery channel 212. This differential pressure causes the liquid to flow from the common supply channel 211, through the individual supply channels 213, discharge orifices 13 (pressure chambers 23) within the recording element boards 10, and the individual recovery channels 214 in that order, and to the common recovery channel 212.

FIG. 38C is a perspective view illustrating a cross-section taken along line XXXVIIIC-XXXVIIIC in FIG. 38A. Each discharge module 200 in the present application example is configured including a first channel member 50, recording element boards 10, and flexible printed circuit boards 40. The present application example does not have the support member 30 (FIG. 18) described in the second application example, with the recording element boards 10 having the cover 20 being directly joined to the first channel member 50. The common supply channel 211 provided to the second channel member 60 supplies liquid from the communication ports 61 provided on the upper face thereof to the individual supply channels 213, via the individual communication ports 53 formed on the lower face of the first channel member 50. Thereafter, the liquid passes through the pressure chambers 23, and is recovered to the common recovery channel 212 via the individual recovery channels 214, individual communication ports 53, and communication ports 61, in that order.

Unlike the arrangement illustrated in the second application example illustrated in FIGS. 16A and 16B, the individual communication ports 53 on the lower face of the first channel member 50 (the face toward the second channel member 60) are openings of a sufficient size with regard to the communication ports 61 formed on the upper face of the second channel member 60. According to this configuration, even in a case where there is positional deviation at the time of mounting the discharge module 200 to the second channel member 60, fluid communication can be realized in a sure manner between the first channel member 50 and the second channel member 60, so yield will improve when manufacturing the head, thereby reducing costs.

Examples of the liquid discharge head 3 have been described using the first through third application examples. The recording element board 10 that the liquid discharge head 3 described here has can be configured as first through fourth embodiments, which will be described below. The above-described application examples are applicable to the embodiments.

First Embodiment

Figure 21A:
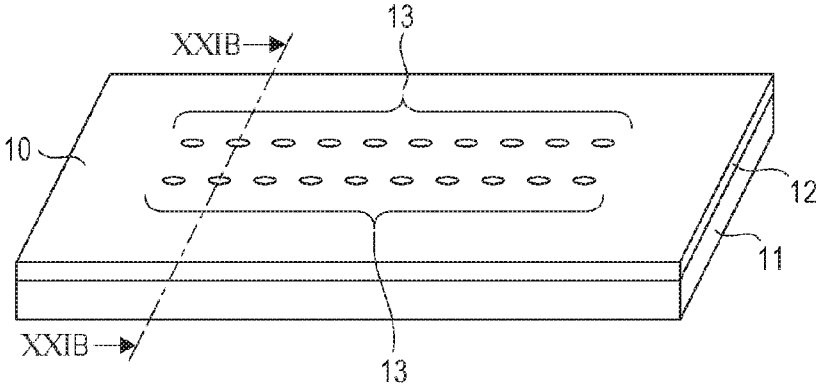
FIGS. 21A through 21C are diagrams for describing a first embodiment of the recording element board.
Figure 21B:
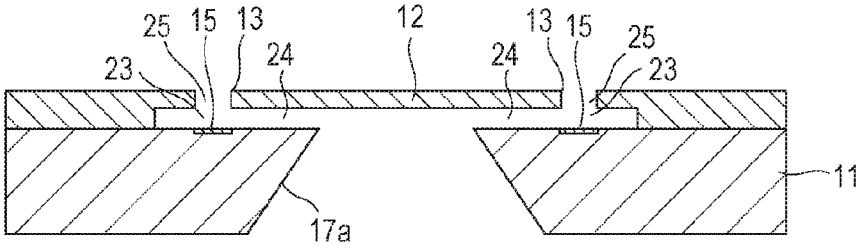
Figure 21C:
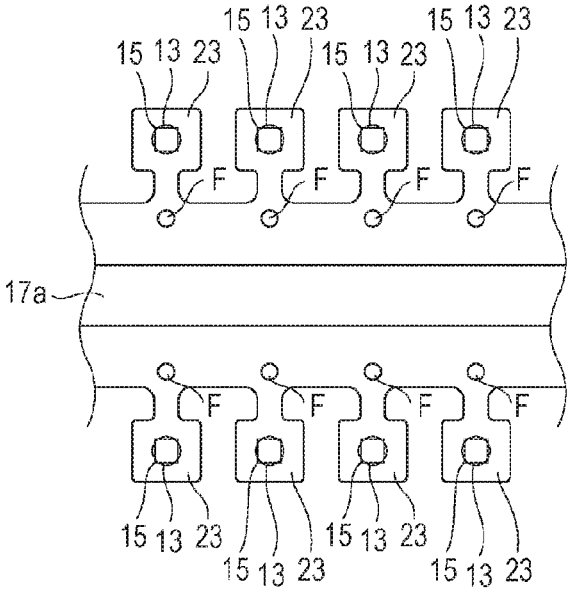

FIGS. 21A through 21C are diagrams for describing a first embodiment of the recording element board 10 that the liquid discharge head 3 has. FIG. 21A is a perspective view illustrating the outer appearance of the recording element board 10 according to the first embodiment. The recording element board 10 has the substrate 11 and discharge orifice forming member 12. Multiple discharge orifices 13 are formed on the discharge orifice forming member 12.

FIG. 21B is a cross-sectional view taken along XXIB-XXIB in FIG. 21A. The recording element board 10 further includes liquid discharge channels (nozzles) 25, pressure chambers 23, channels 24, and recording elements 15. A liquid discharge channel 25 is a space communicating with a discharge orifice 13, penetrating the discharge orifice forming member 12 at a position facing a pressure chamber 23 and recording element 15. The outside end portion of the liquid discharge channel 25, i.e., the end portion at the opposite side from the recording element 15, makes up the discharge orifice 13 that is a hole for discharging ink. In the present specification, a discharge orifice 13 is an opening situated on the outer face of the discharge orifice forming member 12 and faces the recording medium, and the liquid discharge channel 25 is a through hole that penetrates the discharge orifice forming member 12.

The pressure chamber 23 is a space that communicates with the discharge orifices 13 and liquid discharge channel 25, and is formed between the substrate 11 and the discharge orifice forming member 12. The recording element 15 is a heating resistance element, provided on the substrate 11 within the pressure chamber 23 and facing the discharge orifice 13. The channel 24 is a space communicating with the pressure chamber 23, formed between the substrate 11 and the discharge orifice forming member 12. A supply channel 17*a* that is a through hole communicating with the channel 24 is formed in the substrate 11. According to this configuration, ink flowing in from the supply channel 17*a* is supplied to the pressure chamber 23 via the channel 24. The ink within the pressure chamber 23 is externally discharged from the discharge orifices 13 by discharging energy applied by the recording elements 15. In the present embodiment, the supply channel 17*a* is provided to one side of each recording element 15.

FIG. 21C is an enlarged transparent view of the recording element board 10 from the side on which the discharge orifices 13 are formed. Multiple pressure chambers 23 are formed on either side of the supply channel 17*a*, with a noise filter F provided at the entrance to each pressure chamber 23. The recording element 15 within the pressure chamber 23 is provided at a position matching the discharge orifice 13 when viewed from the opening side of the discharge orifice 13.

Figure 22A:
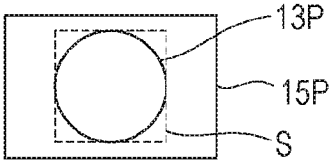
FIGS. 22A through 22F are diagrams for describing dimensions of a comparative example and the process of ink discharge.

FIGS. 22A through 22F are diagrams for explaining a recording element board according to a comparative example. FIG. 22A is a diagram illustrating a state where the outer shapes of a recording element 15 and discharge orifice 13 have been projected onto the substrate 11, as viewed from a direction perpendicular to the substrate 11. In this comparative example, a rectangular shape S, that circumscribes the outline of a discharge orifice projection region 13P where the discharge orifice 13 has been projected on the substrate 11, exists on the inner side of the outline of a heat-generating region projection region 15P where the heat-generating region of the recording element 15 has been projected on the substrate 11. Note that the heat-generating region projection region 15P is somewhat smaller than the area of the recording element 15. The reason is that the perimeter region of the recording element 15 does not serve as a substantial heat-generating region when the recording element 15 is driven. In the present embodiment, a region from the perimeter of the recording element 15 to 2 μm inward is not a substantial heat-generating region.

Figure 22B:
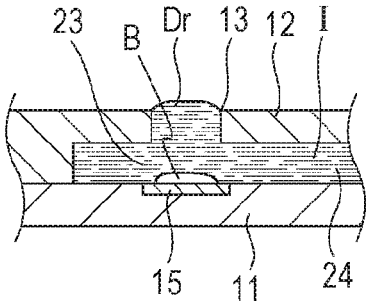
Figure 22C:
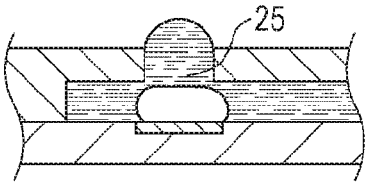
Figure 22D:
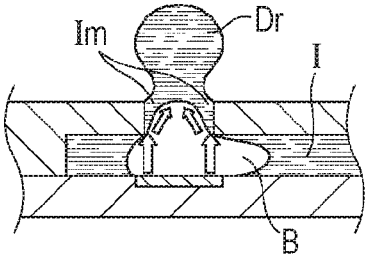
Figure 22E:
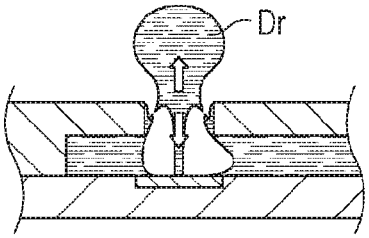
Figure 22F:
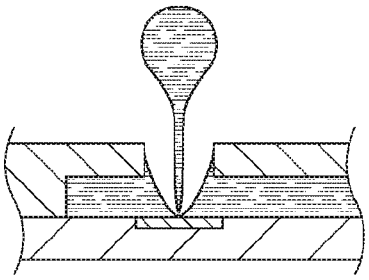

FIGS. 22B through 22F are diagrams for describing states of ink discharged using the recording element board according to the comparative example, having the discharge orifice 13 and recording element 15 illustrated in FIG. 22A. FIG. 22B illustrates a state where the channel 24 and pressure chamber 23 of the recording element board are filled with ink, and the recording element 15 has been driven. Driving the recording element 15 generates thermal energy that is applied to the ink within the pressure chamber 23. Applying thermal energy to the ink causes a bubble B to form. The volume of the bubble B then increases, which pushes the ink within the pressure chamber 23 through the liquid discharge channel 25 toward the outside from the discharge orifice 13, as illustrated in FIG. 22C. As the bubble B continues to grow larger, the bubble B enters the liquid discharge channel 25, so that a discharged ink droplet Dr and ink I within the channel 24 are in a divided state as illustrated in FIG. 22D. The flow of the bubble B generated at the recording element 15 directly below the end portion of the discharge orifice 13 is a discharge direction perpendicular to the substrate 11 at the channel 24 as indicated by the arrows, i.e., the discharge direction. This flow of the bubble B strikes against the walls of the liquid discharge channel 25, and becomes a flow in the direction toward the middle of the discharge orifice 13 within the liquid discharge channel 25. After growing to the maximum volume, the volume of the bubble B begins to decrease. As the bubble B shrinks, the rear portion of the discharged ink droplet Dr moves toward the recording element 15 as illustrated in FIG. 22E. Speed difference in opposite directions occurs between the leading end and the rear portion of the discharged ink droplet Dr at this time, with regard to the direction of discharge of ink, thereby forming a slender droplet tail. Thereafter, the discharged ink droplet Dr is separated from the ink I and flies outwards from the discharge orifice 13, as illustrated in FIG. 22F. The droplet tail eventually further separates into a main droplet and satellites, due to the speed difference and surface tension of the ink.

As described above, the flow of the bubble B generated above the recording element 15 directly beneath the end portion of the discharge orifice 13 is perpendicular to the substrate 11 within the pressure chamber 23 when discharging the ink, i.e., in the discharge direction. Thereafter, the flow of ink of the bubble B strikes against the walls of the liquid discharge channel 25, and becomes a flow in the direction toward the middle of the discharge orifice 13 within the liquid discharge channel 25. Accordingly, a relatively thick liquid film Im is formed between the discharged ink droplet Dr and the ink I. A thick liquid film Im means that the position where the bubble B communicates with the atmosphere is close to the recording element 15, so the timing of the bubble B communicating with the atmosphere is delayed. Accordingly, the droplet tail of the discharged ink droplet Dr becomes longer. A longer droplet tail of the discharged ink droplet Dr means that the discharged ink droplet Dr more readily separates into a main droplet and satellites while in flight. If satellites are generated, there is a concern that there will be more ink that does not land at the intended position, resulting in lower image quality.

Figure 23A:
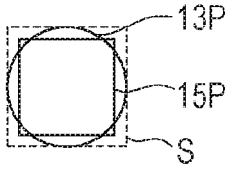
FIGS. 23A through 23F are diagrams for describing dimensions of the recording element board in FIG. 21 and the process of ink discharge.

Next, the recording element board 10 according to the first embodiment will be described. FIGS. 23A through 23F are diagrams for describing the configuration of the recording element board 10 according to the first embodiment. FIG. 23A is a diagram illustrating a state where the outer shapes of a recording element 15 and discharge orifice 13 have been projected onto the substrate 11, as viewed from a direction perpendicular to the substrate 11. In the present embodiment, a rectangular shape S that circumscribes the outline of a discharge orifice projection region 13P where the discharge orifice 13 has been projected on the substrate 11 contains the outline of a heat-generating region projection region 15P where the heat-generating region of the recording element 15 has been projected on the substrate 11. Note that the term "contain" here includes a case where the outline of the heat-generating region projection region 15P is the same as the rectangular shape S (overlaid). Also note that the heat-generating region projection region 15P is somewhat smaller than the area of the recording element 15, in the same way as in the above-described comparative example. Two opposing sides of the rectangular shape S are generally parallel to the direction in which the liquid flows through the channel 24. Alternatively, two opposing sides of the rectangular shape S are generally parallel to the direction of the discharge orifice row where the discharge orifices 13 are arrayed.

Figure 23B:
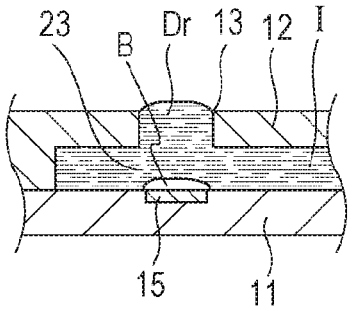
Figure 23C:
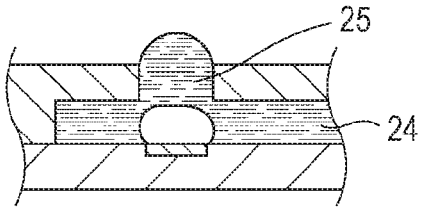
Figure 23D:
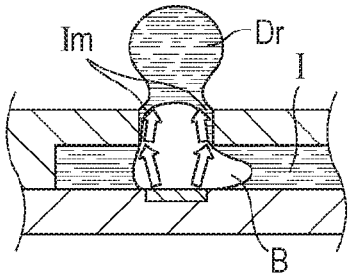
Figure 23E:
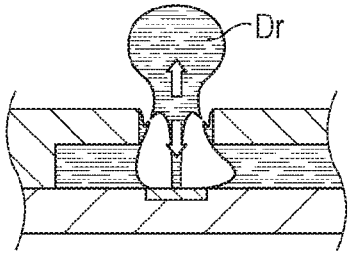
Figure 23F:
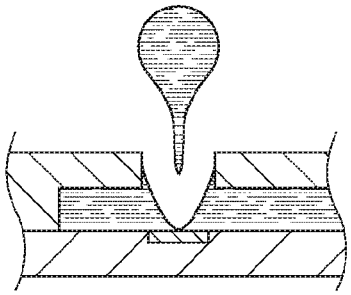

FIGS. 23B through 23F are diagrams for describing states of ink discharged using the recording element board 10 according to the first embodiment having the discharge orifice 13 and recording element 15 illustrated in FIG. 23A. FIGS. 23B through 23F illustrate the flow of the bubble B in a case where the heat-generating region projection region 15P is contained by the rectangular shape S that circumscribes the discharge orifice projection region 13P. Driving the recording element 15 and applying thermal energy to the ink causes a bubble B to form, as illustrated in FIG. 23B. The volume of the bubble B then increases, as illustrated in FIG. 23C. The flow of the bubble B in the pressure chamber 23 becomes a flow having a speed component toward the walls of the liquid discharge channel 25, and when the bubble B inters inside of the liquid discharge channel 25, the flow of the portion of the bubble B that has entered therein becomes a flow that follows the outer edge of the liquid discharge channel 25, i.e., the flow of the bubble B is a flow substantially parallel to the outer edge of the liquid discharge channel 25 (inner wall surface of the liquid discharge channel 25). The direction of this flow differs depending on the size of the recording element 15 and so forth, and was a direction heading toward the center of the discharge orifice 13 in the comparative example, as compared to the example in FIGS. 23A through 23F. In a case where the heat-generating region projection region 15P is the same as the rectangular shape S or contained in the rectangular shape S, The flow is relatively closer to following the wall surface of the liquid discharge channel 25 as compared with the comparative example. That is to say, the direction of the flow is closer to the direction heading toward the perimeter of the discharge orifice 13 as compared to the comparative example. The direction of the flow of the bubble B being closer to the direction heading toward the perimeter of the discharge orifice 13 promotes a thinner liquid film Im between the discharged ink droplet Dr and the ink I inside the channel. Accordingly, the bubble B communicates with the atmosphere at an earlier timing as compared to the comparative example, and the droplet tail of the discharged ink droplet Dr is shorter. A shorter droplet tail of the discharged ink droplet Dr means that the droplet more readily comes together as one in flight, and satellites are not readily formed. This arrangement where satellites do not form as readily improves printing quality. Thus, it is a point of embodiments that the component of the flow following the outer perimeter (inner wall surface) of the liquid discharge channel 25 in the flow of the bubble B entering the liquid discharge channel 25 from the pressure chamber 23 is made to be greater, while suppressing the component toward the center of the discharge orifice 13. Later-described dimensions for the liquid discharge head 3 can be set as appropriate, to realize such a bubble flow.

Second Embodiment

Figure 24A:
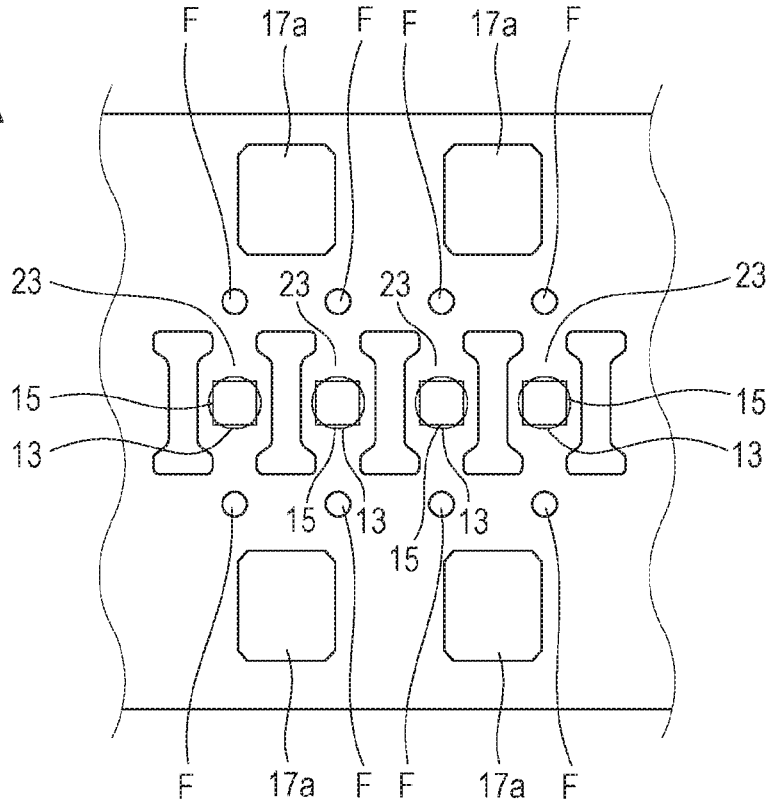
FIGS. 24A and 24B are plan view for describing a second embodiment of the recording element board.
Figure 24B:
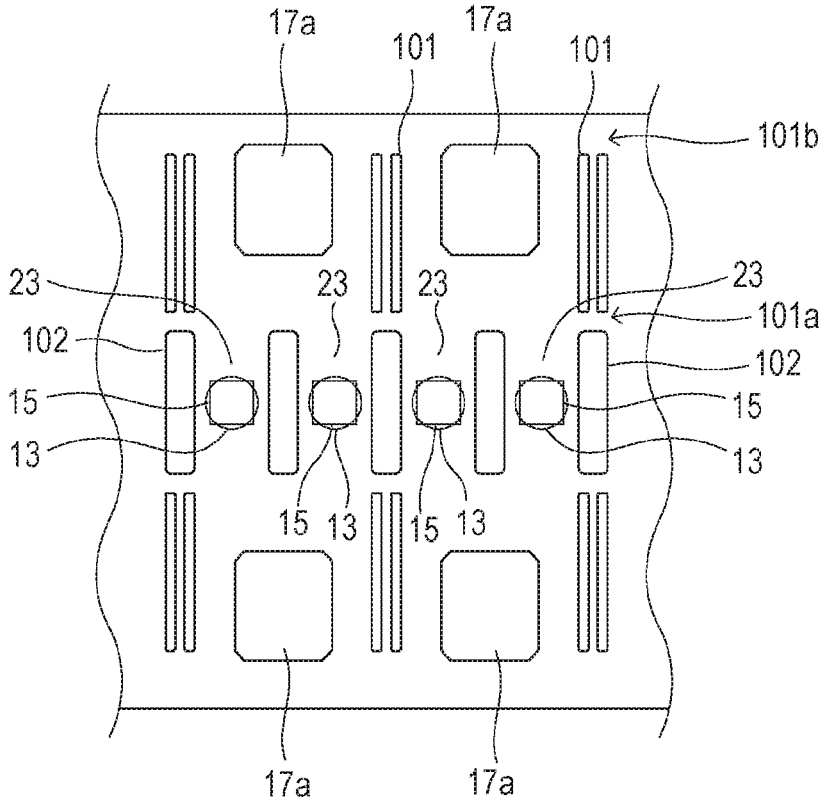
Figure 25A:
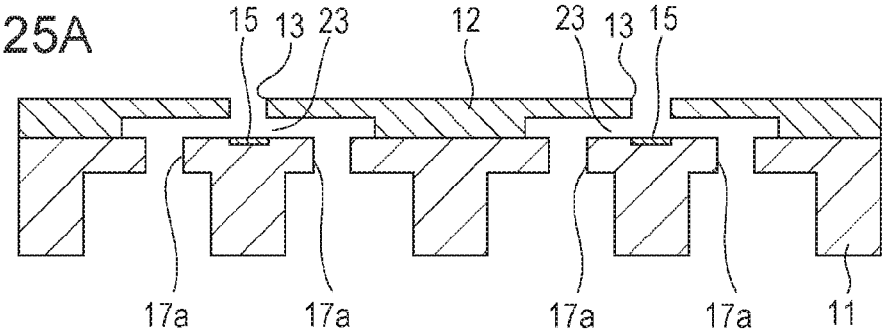
FIGS. 25A through 25F are diagrams for describing dimensions of the recording element board according to the second embodiment and the process of ink discharge.
Figure 25B:
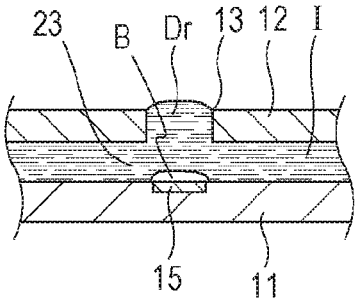
Figure 25C:
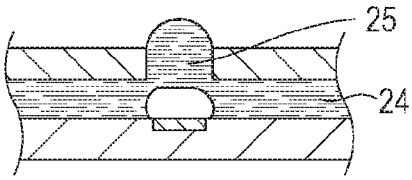
Figure 25D:
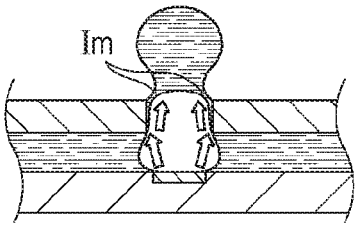
Figure 25E:
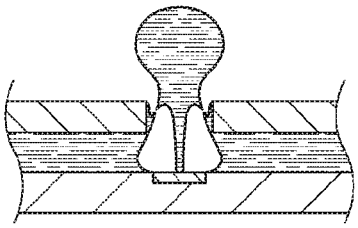
Figure 25F:
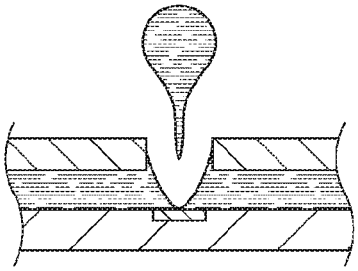

The recording element board 10 according to a second embodiment will be described. FIGS. 24A and 24B are top views of the recording element board 10 according to the present embodiment. FIG. 25A is a diagram schematically illustrating the cross-sectional configuration of the recording element board 10 according to the present embodiment. In the second embodiment, each recording element 15 has the supply channel 17*a* formed on both sides of the recording element 15. The ink is supplied to the two supply channels 17*a* situated at symmetrical positions on both sides of the pressure chamber 23 across the recording element 15.

FIGS. 25B through 25F are diagrams for describing states of ink discharged using the recording element board 10 according to the second embodiment. In the first embodiment, the supply channel 17*a* was only formed to one side of the recording element 15, so the expansion of the bubble B when bubbling was asymmetrical regarding the sideways direction.

In contrast, supply channels 17*a* are formed on both sides of the recording element 15 in the second embodiment, so the pressure chamber 23 and channel 24 are formed substantially symmetrically, and the bubble B expands symmetrically. Thinning of the liquid film Im is more readily symmetrically promoted due to the bubble B spreading symmetrically, and accordingly, the discharge direction of the discharged ink droplet Dr more readily becomes a direction perpendicular to the substrate 11. Thus, the ink droplet is more likely to land at the desired position on the recording medium, so even higher printing quality than the first embodiment can be expected.

Figures 26A, 26B, 26C, 26D, 26E, 26F, 26G:
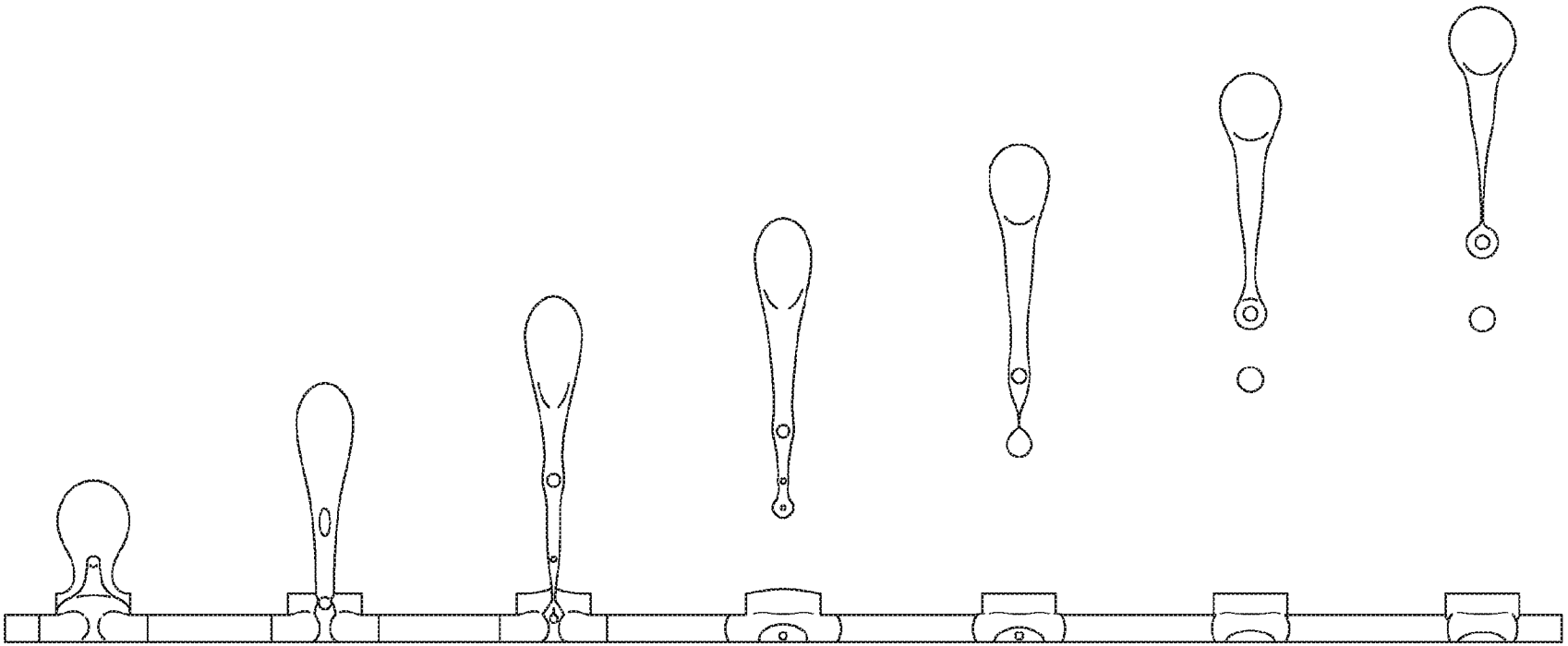
FIGS. 26A through 26N are succession drawings illustrating the process of ink discharge in the comparative example and the second embodiment.
Figures 26H, 26I, 26J, 26K, 26L, 26M, 26N:
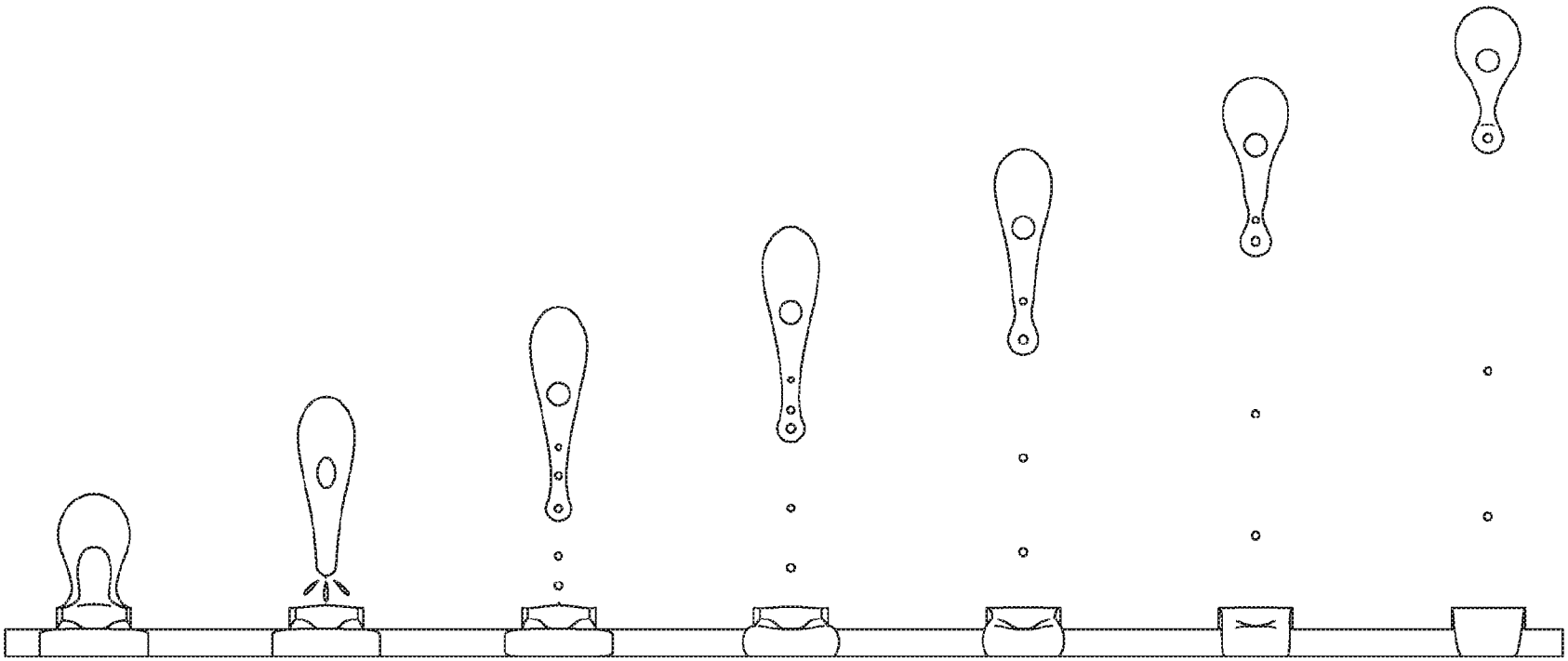

FIGS. 26A through 26N are succession drawings illustrating the discharge state when discharging ink using the recording element board 10 according to the second embodiment. FIGS. 26A through 26G are of the comparative example, and FIGS. 26H through 26N are of the present embodiment. In the comparative example illustrated in FIGS. 26A through 26G, the outer shape of the discharge orifice 13 was a circular shape 18 μm in diameter, and the heat-generating region projection region 15P of the recording element 15 was formed as a square where the length of one side was 19 μm. In this example, the outline of the heat-generating region projection region 15P is the same as the rectangular shape S circumscribing the outline of the discharge orifice projection region 13P. Next, in the present embodiment illustrated in FIGS. 26H through 26N, the outer shape of the discharge orifice 13 was a circular shape 18 μm in diameter, and the heat-generating region projection region 15P of the recording element 15 was formed as a square where the length of one side was 15 μm. In this example, the outline of the heat-generating region projection region 15P is contained in the rectangular shape S circumventing the outline of the discharge orifice projection region 13P. In each of the examples in FIGS. 26A through 26N, the height of the channel 24 of the pressure chamber 23, i.e., the cross-sectional length of the channel 24 in the direction perpendicular to the substrate 11, was 7 μm, and the distance from the discharge orifice 13 to the recording element 15 was 12 μm. It can be seen by comparing FIGS. 26A through 26G with FIGS. 26H through 26N that the length of the droplet tail is shorter in FIGS. 26H through 26N as compared with FIGS. 26A through 26G. Thus, generation of satellites can be reduced.

Figure 27A:
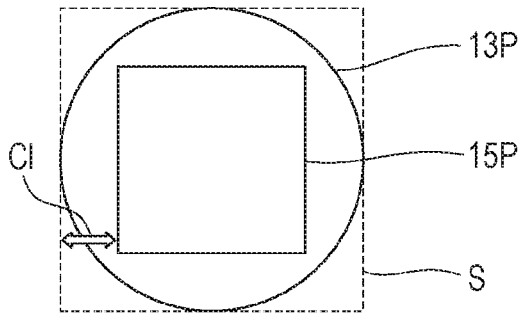
FIGS. 27A and 27B are diagrams illustrating the relationship between a distance C1 between the discharge orifice and recording element, and the amount of time until the bubble communicates with the atmosphere.
Figure 27B:
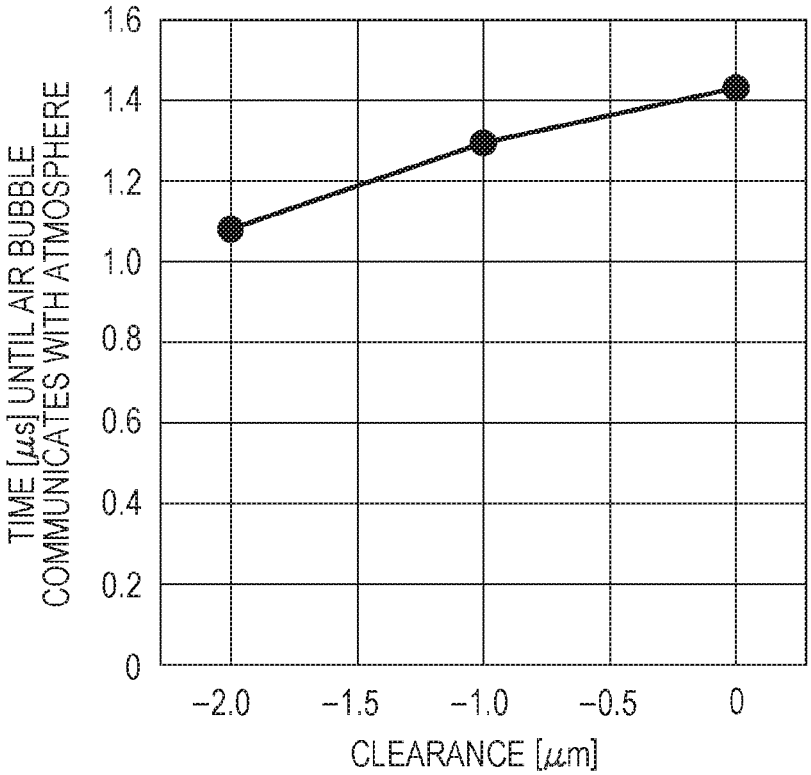

FIGS. 27A and 27B illustrate the relationship between the amount of time from applying discharge energy to the recording element 15 until the bubble B communicates with the atmosphere, and the size of the recording element 15 relative to the discharge orifice 13, when using the recording element board 10 according to the present embodiment. The relative size of the recording element 15 is indicated by a distance C1 between the heat-generating region projection region 15P and the discharge orifice projection region 13P, as illustrated in FIG. 27A. This distance C1 is the distance from one side of the heat-generating region projection region 15P to one side of the rectangular shape S circumscribing the discharge orifice projection region 13P. The value of distance C1 is a negative value here when the heat-generating region projection region 15P is on the inner side of the rectangular shape S. The discharge orifice 13 here is a circular shape 18 μm in diameter, and the outer shape of the effective bubbling region of the recording element 15 is a square. The height of the channel 24 in the direction perpendicular to the substrate 11 is 7 μm, and the distance from the discharge orifice 13 to the recording element 15 is 12 μm. The distance from the discharge orifice 13 to the recording element 15 is the distance from the surface of the face on which the discharge orifice 13 is formed to the surface of the substrate 11 on which the discharge orifice 13 is formed.

It can be seen from FIG. 27B that the smaller the value of the distance C1 is, i.e., the larger the clearance value is, the shorter the time from driving the recording elements 15 until the bubble B communicates with the atmosphere is. In other words, the smaller the outline of the heat-generating region projection region 15P is in comparison with the rectangular shape S circumscribing the discharge orifice projection region 13P, the shorter the amount of time till the bubble B communicates with the atmosphere is. The shorter the amount of time till the bubble B communicates with the atmosphere, and the droplet tail of the discharged ink droplet Dr is shorter, which means that the droplet more readily comes together as one in flight, and satellites are not readily formed. Satellites not readily being formed means that the discharged ink droplet Dr is more likely to land at the desired position, so printing quality improves. The effects of reduced time until the bubble B communicates with the atmosphere has a tendency to increase the greater the distance C1 is (the greater the spacing is), so a region where the distance C1 is −2 μm or less can be suitably applied as well.

In order to further improve the effects of the present embodiment, the height of the channel 24 preferably is low. The reason is that the lower the height of the channel 24 is, the stronger the flow from near the discharge orifice 13 toward the perimeter of the discharge orifices 13 by the recording element 15 is. Reducing the height of the channel 24 also serves to suppress inclusion of foreign substance into the channel 24. This enables effects the same as those of the noise filter F to be had at the outlet portion of the supply channel 17*a*, so a configuration can be made without using the noise filter F. Reducing the height of the channel 24 also makes the flow resistance from the supply channel 17*a* to the pressure chamber 23 to be sufficiently great, so a throttle resistance unit (omitted from illustration) on the path from the supply channel 17*a* to the pressure chamber 23 becomes unnecessary.

For example, in an arrangement where the distance from the discharge orifice 13 to the recording element 15 is 9.5 μm, the diameter of the discharge orifice 13 is 20 μm, the recording element 15 is a square of which each side is 14 μm, and the width of the pressure chamber 23 is 35 μm, the height of the channel 24 can be made to be 5 μm. In this case, foreign substances larger than 5 μm, which is the height of the channel 24, cannot go beyond the supply channel 17*a*. Accordingly, the noise filter F becomes unnecessary if the height of the channel 24 is low. Also, if the distance from the supply channel 17*a* to the pressure chamber 23 is 60 μm, the flow resistance is sufficiently great. Accordingly, the energy generated by the recording element 15 can be sufficiently applied to the discharged ink droplet Dr, while the influence of pressure on the adjacent pressure chamber 23 is reduced, so the throttle resistance unit is unnecessary. The distance from the discharge orifice 13 to the recording element 15 preferably is at least smaller than twice the height of the channel 24 in order to sufficiently apply the energy generated by the recording element 15 to the discharged ink droplet Dr. This enables discharge with good energy efficiency.

There is a need to raise the ink refill frequency in order to raise the printing speed. To this end, measures are preferably taken such as reducing the distance from the supply channel 17*a* to the pressure chamber 23, making raising the height of part of the channel 24 from the supply channel 17*a* to the pressure chamber 23, and so forth. In this case, the influence of pressure waves (the influence of crosstalk) on adjacent pressure chambers 23 is great, so a wall 101 is preferably provided between supply channels 17*a*, as illustrated in FIG. 24B. In a case of providing a wall 101 between supply channels 17*a*, the supply channel 17*a* may become clogged with foreign substance or the like during the manufacturing process of the liquid discharge head 3 or during usage thereof, resulting in a situation where ink is not supplied to a particular pressure chamber 23. Accordingly, this wall 101 is preferably separated from a wall 102 of the pressure chamber 23 to form a gap, so that even in a case where the supply channel 17*a* happens to be blocked, supply of ink is not stopped. This gap is even more preferably formed on both ends of the wall 101, specifically at two locations, which are at the side thereof closer to the pressure chamber 23 than the supply channel 17*a*, and the opposite side. The former, a gap 101*a* provided at the end of the wall 101 closer to the pressure chamber 23, preferably is formed narrower than the latter, a gap 101*b* farther from the pressure chamber 23, in order to suppress the influence of pressure waves when supplying ink. For example, the former gap 101*a* preferably is around 3 to 7 μm, while the latter gap 101*b* preferably is around 15 to 30 μm.

Third Embodiment

Figure 28A:
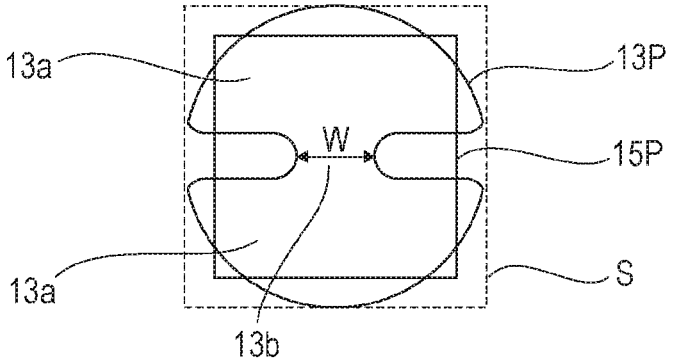
FIGS. 28A through 28E are diagrams for describing a third embodiment of the recording element board.
Figure 28B:
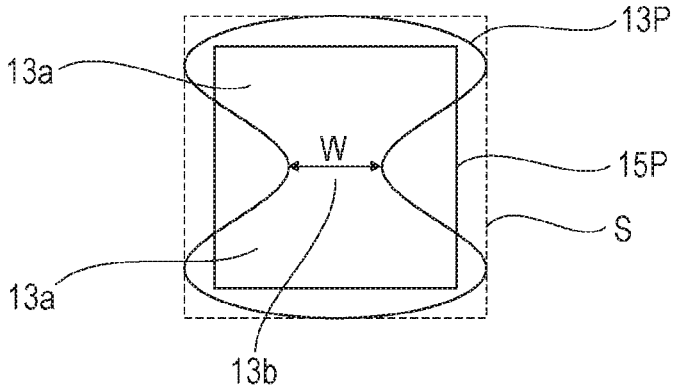

Although the shape of the discharge orifice 13 has been described as being circular in the first and second embodiments, the shape of the discharge orifice 13 is not restricted to being circular. For example, the discharge orifice 13 may have a shape including multiple arc portions 13*a* that form a part of the perimeter of the discharge orifice 13, and protrusions 13*b* that connect the multiple arc portions 13*a*. FIGS. 28A and 28B illustrate examples of discharge orifices 13 having such shapes. A recording element board 10 having discharge orifices 13 with such shapes can further intensity the effects of promoting a thinner liquid film Im, when the rectangular shape S circumscribing the outline of the discharge orifice projection region 13P contains the heat-generating region projection region 15P. Accordingly, the amount of time for the bubble B to communicate with the atmosphere can be further reduced, and occurrence of satellites can be reduced. If a width W between the protrusions 13*b* illustrated in FIGS. 28A and 28B is too wide, the effects of promoting a thinner liquid film Im becomes smaller, but if too narrow, the droplet may split into two. Accordingly, the width W of the protrusions 13*b* preferably is around 2 to 8 μm.

Figure 28C:
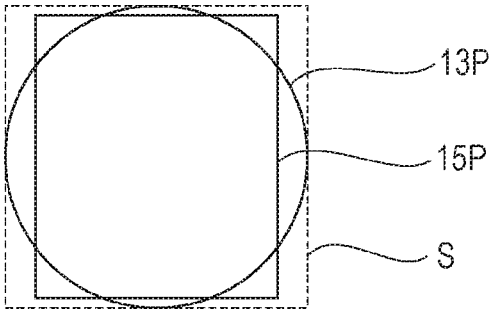

Although the shape of the heat-generating region projection region 15P has been described as being square in the first and second embodiments, and in the present embodiment as illustrated in FIGS. 28B and 28B, the shape of the heat-generating region projection region 15P is not restricted to these examples. For example, the shape of the recording element 15 and the shape of the heat-generating region projection region 15P maybe rectangular, where the lengths of adjacent sides are differ, as illustrated in FIG. 28C. A rectangular recording element 15 is suitable for a case of arraying recording elements 15 with a high density.

Figure 28D:
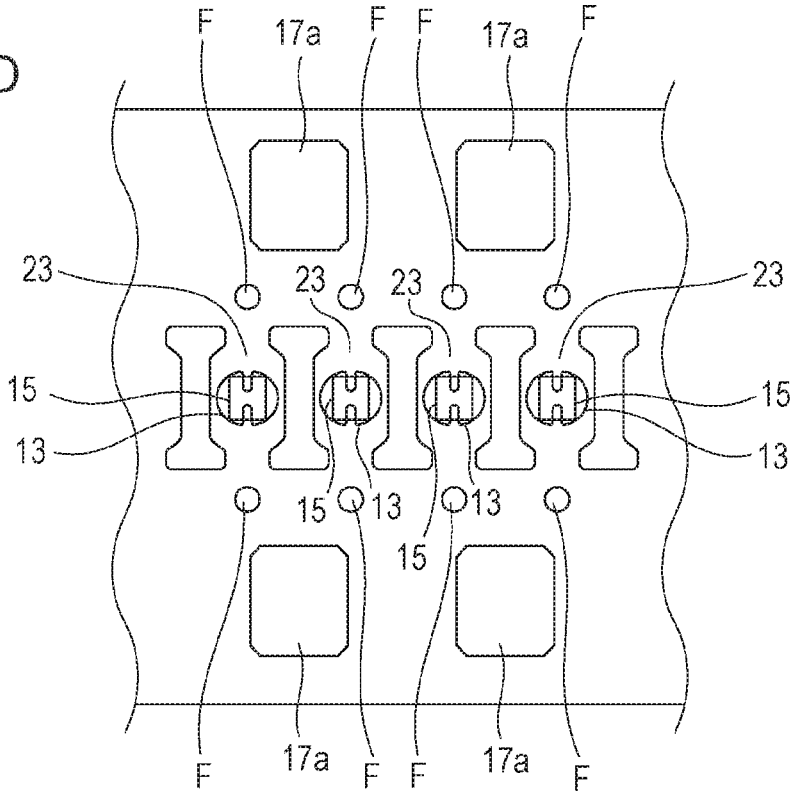
Figure 28E:
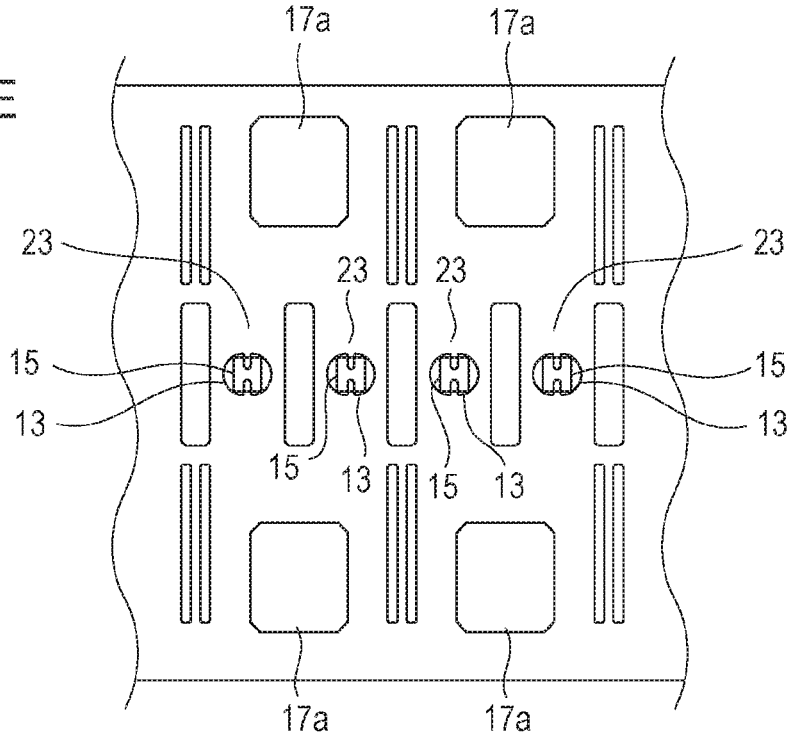

FIGS. 28D and 28E are plan views of the recording element board 10 according to the present embodiment. The discharge orifices 13 are preferably arrayed so that the two arc potions 13*a* are aligned in the direction of the discharge orifice row, as illustrated in FIGS. 28D and 28E. This is to reduce the effects on the printing image quality of deviation of landing position of droplets, which occurs in a case where the shape of the discharge orifices 13 is not symmetrical and unevenness occurs.

Fourth Embodiment

Although examples where the supply channel 17*a* is provided to one side of the recording element 15 and to both sides of the recording element 15 have been described in the first through third embodiments, the present disclosure is not restricted to these examples. The recording element board 10 according to a fourth embodiment has a supply channel 17*a* and a recovery channel 17*b* communicating with the pressure chamber 23. FIGS. 29A through 29D are diagrams for describing the recording element board 10 according to the fourth embodiment.

Figure 29A:
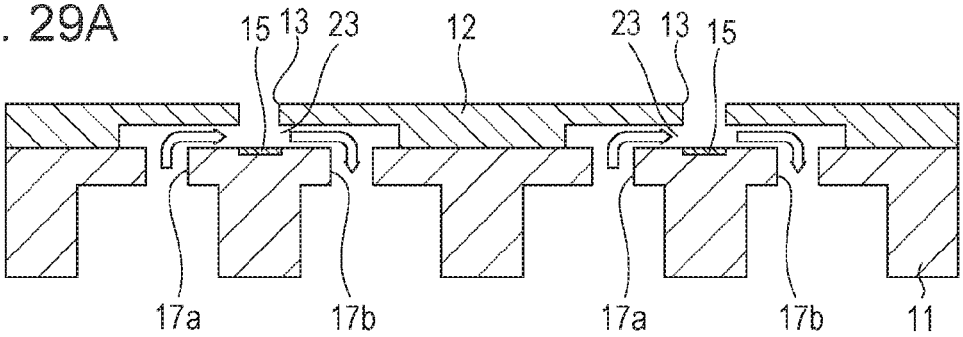
FIGS. 29A through 29D are diagrams for describing a fourth embodiment of the recording element board.
Figure 29B:
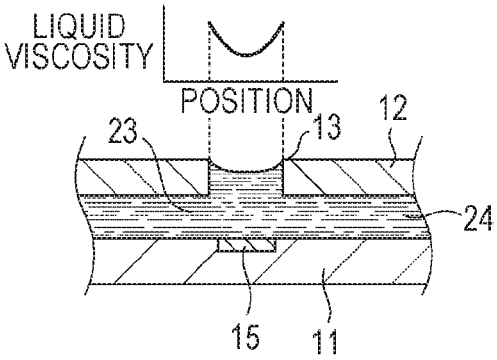

The present embodiment includes the supply channel 17*a* and recovery channel 17*b* that communicate with the pressure chamber 23. The supply channel 17*a* functions as a channel to cause ink to flow into the pressure chamber 23, and the recovery channel 17*b* functions as a channel to recover ink from the pressure chamber 23. The supply channel 17*a* and recovery channel 17*b* both are provided as through holes that penetrate through the substrate 11. Thus, ink within the pressure chamber 23 is circulated. In a case where ink is not being circulated, the viscosity of ink nearby the discharge orifice 13 gradually increases due to evaporation from the discharge orifices 13, and the ink becomes more difficult to discharge. Particularly, the closer to the perimeter of the discharge orifice 13, the higher the viscosity of the ink becomes, as illustrated in FIG. 29B.

Figure 29C:
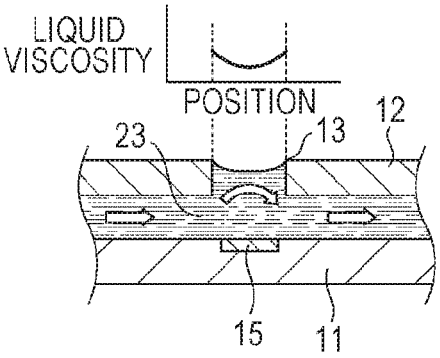
Figure 29D:
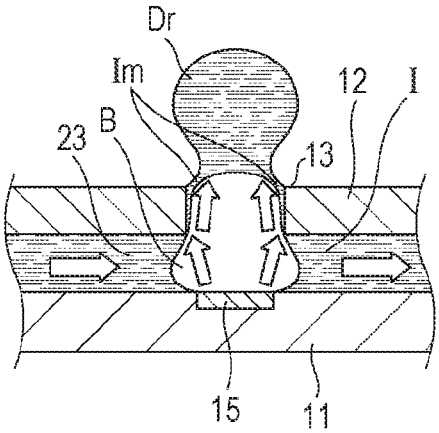

The outline of the heat-generating region projection region 15P is contained in the rectangular shape S that circumscribes the outline of the discharge orifice projection region 13P in the present embodiment as well. Note that the term "contain" includes a case where the outline of the heat-generating region projection region 15P is the same as the rectangular shape S. It is also important in the present embodiment as well, that the direction of the flow of the bubble B is toward the perimeter of the discharge orifice 13, as described above, but when the viscosity of ink rises, this flow is weakened. Accordingly, a configuration where the ink is circulated s in the present embodiment enables the ink near the discharge orifice 13 to be constantly refreshed, and increase in the viscosity of ink near the discharge orifice 13 can be suppressed, as illustrated in FIG. 29C. In this case, reduced flow toward the perimeter of the discharge orifices 13 when the bubble B strikes against the walls of the discharge orifice 13 can be suppressed, and a thinner liquid film Im between the discharged ink droplet Dr and the ink I within the channel can be promoted, as illustrated in FIG. 29D. Accordingly, printing quality can be further improved over the first through third embodiments.

As described above, the component of the flow following the outer perimeter (inner wall surface) of the liquid discharge channel 25 in the flow of the bubble B entering the liquid discharge channel 25 from the pressure chamber 23 is made to be greater, while suppressing the component toward the center of the discharge orifice 13. Description has been made so far by way of embodiments, but the present disclosure is not restricted to the above embodiments. Various modifications can be made to the configuration that one skilled in the art can understand, without departing from the technical idea of the present disclosure.

For example, multiple examples have been given in the above embodiments regarding the shape of the discharge orifice 13, but the shape is not restricted to those illustrated in the drawings, and various shapes can be made within the technical idea of the present disclosure.

For example, the discharge orifice 13, pressure chamber 23, and channel 24 are formed of a single discharge orifice forming member 12 in the above embodiments, but the present disclosure is not restricted to this example. The discharge orifice 13, pressure chamber 23, and channel 24 may be formed combining multiple members.

For example, an example of the height of the channel 24 and the distance between the discharge orifice 13 and recording element 15 in the direction perpendicular to the substrate 11 has been given in the above embodiments, but the present disclosure is not restricted to this example. It is effective to suitably set (1) the height of the channel 24, and (2) the distance between the discharge orifice 13 and recording element 15, in order for the flow of the bubble that has entered into the liquid discharge channel 25 from the pressure chamber 23 to have a greater component of the flow following the perimeter (inner wall surface) of the liquid discharge channel 25. The height of the channel 24 preferably is 7 μm or less, and the distance between the discharge orifice 13 and recording element 15 preferably is 12 μm or less. If the height of the channel 24 is 8 μm or more, the component heading toward the center of the discharge orifice 13 becomes great in the flow of the bubble that has entered into the liquid discharge channel 25, which is undesirable. Further, the distance from the discharge orifice 13 to the recording element 15 preferably is less than or equal to twice the height of the channel 24. Although the dimensions of other components in the liquid discharge head, the physical properties of the liquid, and so forth also affect the flow of the bubble, besides the above dimensions of the liquid discharge head, the dimensions of (1) and (2) above are dominant.

Although the liquid discharge head used in the embodiments has been described by way of an example of a common inkjet recording apparatus, the liquid discharge head according to the present embodiment can be applied to all liquid discharge apparatuses in general.

Note that the term "record" in the present specification is not restricted to cases of forming meaningful information such as characters and shapes, and no distinction is made between whether that being recorded is meaningful or meaningless, or whether or not that being recorded is has been elicited to be recognized by humans. Further, "record" is a concept that broadly encompasses cases of forming images, designs, patterns, and so forth on recording media, and also cases of processing media.

In the present specification, the term "ink" should be accorded the same broad interpretation as the above term "record", and includes liquid whereby images, designs, patterns, and so forth are formed by application to recording media, liquid whereby recording media is processed, and liquid provided for processing of ink. Accordingly, the term "ink" is a concept encompassing all liquids capable of being used in recording.

Thus, according to the present disclosure, the timing of the air bubble communicating with the atmosphere can be made earlier, so the slender tail trailing behind following the main droplet can be made shorter, satellites cut loose from the main droplet can be reduced, and image quality can be improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-002957, filed Jan. 8, 2016 and No. 2016-239369 filed Dec. 9, 2016, which are hereby incorporated by reference herein in their entirety.

What is claimed is:

1. A recording element board, comprising:

a discharge orifice forming member including a discharge orifice configured to discharge liquid;

a pressure chamber communicating with the discharge orifice;

a recording element configured to generate thermal energy to cause bubbling of the liquid, the recording element being disposed in the pressure chamber facing the discharge orifice;

a channel communicating with the pressure chamber; and a substrate on which the recording element is formed, wherein the height of the pressure chamber in a direction perpendicular to the substrate is 7 μm or less, wherein a bubble generated inside the pressure chamber by driving of the recording element communicates with the atmosphere after the bubble comes into contact with a surface of the discharge orifice forming member closer to the recording element being disposed, and wherein a square shape, circumscribing an outline of a discharge orifice projection region where the discharge orifice has been projected to the substrate in a direction perpendicular to the substrate, contains completely therein a heat-generating region projection region where a heat-generating region of the recording element has been projected on the substrate.

2. A recording element board, comprising:

a discharge orifice configured to discharge liquid;

a recording element configured to generate thermal energy to cause bubbling of the liquid, the recording element being disposed facing the discharge orifice;

a pressure chamber having the recording element within;

a liquid discharge channel communicating with the discharge orifice and the pressure chamber;

a channel communicating with the pressure chamber;

a discharge orifice forming member including the discharge orifice and the liquid discharge channel; and a substrate on which the recording element is formed, wherein the bubble generated within the pressure chamber by the driving of the recording element enters inside the liquid discharge channel after the bubble comes into contact with a surface of the discharge orifice forming member closer to the recording element being disposed, and subsequently, the bubble communicates with the atmosphere, wherein the flow of the bubble that has entered inside the liquid discharge channel becomes a flow following the wall surface of the liquid discharge channel, and wherein a square shape, circumscribing an outline of a discharge orifice projection region where the discharge orifice has been projected to the substrate in a direction perpendicular to the substrate, contains a heat-generating region projection region where a heat-generating region of the recording element has been projected on the substrate.

3. The recording element board according to claim 2, wherein the height of the pressure chamber in a direction perpendicular to the substrate is 7 μm or less.

4. The recording element board according to claim 1, wherein the distance between the discharge orifice and the recording element in a direction perpendicular to the substrate is 12 μm or less.

5. The recording element board according to claim 1, wherein the distance between the discharge orifice and the recording element in a direction perpendicular to the substrate is less than or equal to twice the height of the channel.

6. The recording element board according to claim 1, wherein the substrate has a supply channel configured to supply liquid to the pressure chamber, and a recovery channel configured to recover liquid from the pressure chamber.

7. The recording element board according to claim 6, wherein the supply channel and the recovery channel extend in a direction intersecting the plane direction of substrate.

8. The recording element board according to claim 6, wherein the supply channel is formed at one side of the pressure chamber, and the recovery channel is formed at the other side of the pressure chamber.

9. The recording element board according to claim 1, wherein the discharge orifice includes a plurality of arc portions forming a part of a perimeter portion of the discharge orifice, and a plurality of protrusions protruding from end portions of the plurality of arc portions toward the center of the discharge orifice and connecting the plurality of arc portions.

10. The recording element board according to claim 1, wherein a plurality of the pressure chambers are arrayed, and a wall is provided between the pressure chambers that are adjacent.

11. The recording element board according to claim 10, wherein the wall is provided with gaps for liquid to flow between adjacent pressure chambers.

12. The recording element board according to claim 11, wherein a plurality of the gaps are provided to the wall, and of the plurality of gaps, a gap provided to a side closer to the pressure chamber is narrower than a gap provided to a side farther from the pressure chamber.

13. The recording element board according to claim 12, wherein the gap provided at a side farther from the pressure chamber is formed between an end of the wall, and a discharge orifice forming member where the discharge orifice is provided.

14. A liquid discharge head, comprising:

a discharge orifice forming member including a discharge orifice configured to discharge liquid;

a pressure chamber communicating with the discharge orifice;

a recording element configured to generate thermal energy to cause bubbling of the liquid, the recording element being disposed in the pressure chamber facing the discharge orifice;

a channel communicating with the pressure chamber; and a substrate on which the recording element is formed, wherein the height of the channel in a direction perpendicular to the substrate is 7 μm or less, wherein a bubble generated inside the pressure chamber by driving of the recording element communicates with the atmosphere after the bubble comes into contact with a surface of the discharge orifice forming member closer to the recording element being disposed, and wherein a square shape, circumscribing an outline of a discharge orifice projection region where the discharge orifice has been projected to the substrate in a direction perpendicular to the substrate, contains completely therein a heat-generating region projection region where a heat-generating region of the recording element has been projected on the substrate.

15. The liquid discharge head according to claim 14, wherein the liquid within the pressure chamber is circulated between the inside of the pressure chamber and the outside of the pressure chamber.

16. The liquid discharge head according to claim 14, wherein the recording element is driven and liquid is discharged from the discharge orifice in a state where the liquid within the pressure chamber is being circulated.

* * * * *